US011988431B2

(12) United States Patent
Lee et al.

(10) Patent No.: US 11,988,431 B2
(45) Date of Patent: May 21, 2024

(54) ICEMAKER AND REFRIGERATOR

(71) Applicant: LG ELECTRONICS INC., Seoul (KR)

(72) Inventors: Donghoon Lee, Seoul (KR); Yongjun Bae, Seoul (KR); Wookyong Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 331 days.

(21) Appl. No.: 17/281,972

(22) PCT Filed: Oct. 2, 2019

(86) PCT No.: PCT/KR2019/012974
§ 371 (c)(1),
(2) Date: Mar. 31, 2021

(87) PCT Pub. No.: WO2020/071821
PCT Pub. Date: Apr. 9, 2020

(65) Prior Publication Data

US 2021/0341202 A1 Nov. 4, 2021

(30) Foreign Application Priority Data

Oct. 2, 2018 (KR) ..... 10-2018-0117808
Sep. 11, 2019 (KR) ..... 10-2019-0112991

(51) Int. Cl.
*F25C 1/18* (2006.01)
*F25C 1/04* (2018.01)

(52) U.S. Cl.
CPC ..... *F25C 1/18* (2013.01); *F25C 1/04* (2013.01); *F25C 2400/10* (2013.01); *F25C 2400/14* (2013.01); *F25C 2700/14* (2013.01)

(58) Field of Classification Search
CPC ..... F25C 1/18; F25C 1/04; F25C 2400/10; F25C 2400/14; F25C 2700/14
See application file for complete search history.

(56) References Cited

U.S. PATENT DOCUMENTS

2012/0023996 A1 2/2012 Herrera et al.
2013/0081412 A1* 4/2013 Son ..... F25C 5/04 62/340

(Continued)

FOREIGN PATENT DOCUMENTS

EP 3059526 8/2016
JP 2005326035 11/2005

(Continued)

OTHER PUBLICATIONS

International Search Report (with English Translation) and Written Opinion dated Feb. 5, 2020 issued in Application No. PCT/KR2019/012974.

(Continued)

*Primary Examiner* — Elizabeth J Martin
(74) *Attorney, Agent, or Firm* — KED & ASSOCIATES, LLP

(57) ABSTRACT

A refrigerator according to the present disclosure includes a first tray configured to form a portion of each of a plurality of ice making cells, and a second tray configured to be rotatable with respect to the first tray and to form the other portion of each of the plurality of ice making cells, in which water supply is performed at the water supply position of the second tray, when water supply is completed, the second tray is moved to the ice making position, and one or more of the first tray and the second tray is provided with a communication hole for communicating the plurality of ice making cells at the ice making position of the second tray.

21 Claims, 24 Drawing Sheets

(56) References Cited

U.S. PATENT DOCUMENTS

| | | | | |
|---|---|---|---|---|
| 2013/0327082 | A1 | 12/2013 | Son et al. | |
| 2014/0165599 | A1 | 6/2014 | Boarman et al. | |
| 2014/0167321 | A1 | 6/2014 | Culley et al. | |
| 2014/0182325 | A1 | 7/2014 | Lee et al. | |
| 2018/0231294 | A1 | 8/2018 | Song et al. | |
| 2019/0331387 | A1* | 10/2019 | Choi | F25C 5/22 |

FOREIGN PATENT DOCUMENTS

| | | |
|---|---|---|
| JP | 2011064373 | 3/2011 |
| KR | 10-2009-0019322 | 2/2009 |
| KR | 10-0935746 | 1/2010 |
| KR | 10-2013-0009332 | 1/2013 |
| KR | 20130009332 | 1/2013 |
| KR | 10-2016-0026011 | 3/2016 |
| KR | 10-1643635 | 7/2016 |
| KR | 10-1850918 | 5/2018 |

OTHER PUBLICATIONS

Korean Office Action dated May 8, 2023.
Korean Notice of Allowance dated Nov. 11, 2023 issued in Application No. 10-2018-0117808.

* cited by examiner (a)

(b)

(a)

(b)

ICEMAKER AND REFRIGERATOR

CROSS-REFERENCE TO RELATED APPLICATIONS

This application is a U.S. National Stage Application under 35 U.S.C. § 371 of PCT Application No. PCT/KR2019/012974, filed Oct. 2, 2019, which claims priority to Korean Patent Application Nos. 10-2018-0117808, filed Oct. 2, 2018 and 10-2019-0112991, filed Sep. 11, 2019, whose entire disclosures are hereby incorporated by reference.

TECHNICAL FIELD

Embodiments provide an ice maker and a refrigerator.

BACKGROUND ART

When supercooling occurs when water is frozen, opaque ice occurs while a phase change occurs rapidly. Supercooling refers to a state in which a phase change does not occur and latent heat is not released at a temperature the freezing point or less. When ice is frozen in the freezer, opaque ice is easily observed, which is the result of the supercooled water becoming cloudy due to the rapid phase change. It is important to control the supercooling to control the transparency of the ice. In order to make transparent ice, it is necessary to release or prevent supercooling.

In general refrigerators, it is difficult to find a technology that considers supercooling of water in relation to ice making. This is thought to be due to the fact that the development of ice making technology has focused on the ice making speed rather than the quality of ice.

The most widely used method to reduce the supercooling phenomenon is the addition of a nucleation agent. The nucleation agent can lower the degree of supercooling of the material through effects such as lowering the nucleation barrier and reducing the crystallization time.

However, this supercooling-related technology is difficult to apply to the production of ice for food and beverage. The use of nucleation agents is subject to several restrictions and can sometimes be inappropriate for making ice for food and beverage. As an extension of water intake, ice that are not clean and pure ice but contains additives may cause consumer rejection.

In addition, it is expected that it will be very difficult to find an additive that is harmless to the human body while reliably having an effect of preventing supercooling, and there is a hassle of storing the nucleation agent in a refrigerator and injecting the nucleation agent during ice making.

DISCLOSURE

Technical Problem

The present embodiment provides an ice maker and a refrigerator capable of quickly exiting the supercooling phenomenon even if the supercooling phenomenon does not occur or the supercooling phenomenon occurs during the ice making process, and a method for controlling the same.

Technical Solution

An ice maker according to an aspect includes a first tray configured to form a portion of each of the plurality of ice making cells, and a second tray configured to be rotatable with respect to the first tray and to form the other portion of each of the plurality of ice making cells.

Water supply may be performed at the water supply position of the second tray, when water supply is completed, the second tray may be moved to the ice making position, and one or more of the first tray and the second tray may be provided with a communication hole or passage for communicating the plurality of ice making cells at the ice making position of the second tray.

The first tray may include a first contact surface, and the second tray may include a second contact surface. The communication hole may be provided in one or more of the first contact surface and the second contact surface.

The communication hole may be provided on the first contact surface and may be recessed in a direction away from the second tray from the first contact surface. The second tray may be located under the first tray, and a direction away from the second tray may be an upward direction.

The communication hole may be provided on the second contact surface and may be recessed in a direction away from the first tray from the second contact surface. The second tray may be located under the first tray, and a direction away from the first tray may be a downward direction.

At the water supply position, at least a portion of the second contact surface may be spaced apart from the first contact surface. At the water supply position, all of the second contact surfaces may be spaced apart from the first contact surface. In the ice making position, all of the first contact surface may be in contact with the second contact surface.

The communication hole may have a semicircular or polygonal cross section.

The communication hole may be disposed on an extension line connecting the centers of each of the plurality of ice making cells.

A refrigerator according to the other aspect may include a storage chamber configured to store food, a cooler configured to supply cold air to the storage chamber, a first tray configured to form a portion of each of a plurality of ice making cells, that is a space in which water is phase-changed into ice by the cold air, and a second tray configured to be rotatable with respect to the first tray and to form the other portion of each of the plurality of ice making cells, in which water supply is performed at the water supply position of the second tray, when water supply is completed, the second tray is moved to the ice making position, and one or more of the first tray and the second tray is provided with a communication hole for communicating the plurality of ice making cells at the ice making position of the second tray.

Advantageous Effects

According to an embodiment of the present disclosure, when supercooling occurs, the supercooling may be released by rotating a tray. Supercooling can be released by only adding logic that rotates the tray without the need for a separate device for canceling supercooling.

As a result of the experiment, since the supercooling occurring near −3° C. does not have a significant effect on the transparency, it is determined whether the supercooling occurs up to −3° C., and if supercooling continues after −3° C. or less, the supercooling can be released by rotating the tray.

Furthermore, by continuously measuring the temperature of the tray and repeatedly performing the measurement until it is confirmed that the supercooling is released, the supercooling can be released.

According to another embodiment of the present disclosure, the effect of releasing supercooling in one cell can be transferred to another cell by connecting the respective cells to each other. By making a small groove between the partition walls between cells, if the supercooling is released on one side, the supercooling is transferred to the other cell, so that supercooling may be released in all cells. In the end, the supercooling of all cells can be released by released the supercooling of one cell without the need to release the supercooling of all the cells in the tray.

According to another embodiment of the present disclosure, since, when ice making, other parts other than the tray do not come into contact with water and ice, and foreign substances such as nucleation agents are not added, this embodiment is an appropriate and safe method for eating and drinking. There is no structure that consumes or wears, so the effect does not decrease even in repeated operation. this embodiment is also a safe way to apply in a refrigerator. There is an advantage in that noise and vibration are not generated during operation, so that it does not cause inconvenience to users in close proximity.

In addition, according to another embodiment of the present disclosure, the supercooling can be released at the initial stage of the supercooling, so that transparent ice can be provided. In particular, it can be prevented ice from becoming opaque in a case where supercooling is released without a difference of 3 degrees or more from the freezing temperature.

MODE FOR INVENTION

Figure 1:
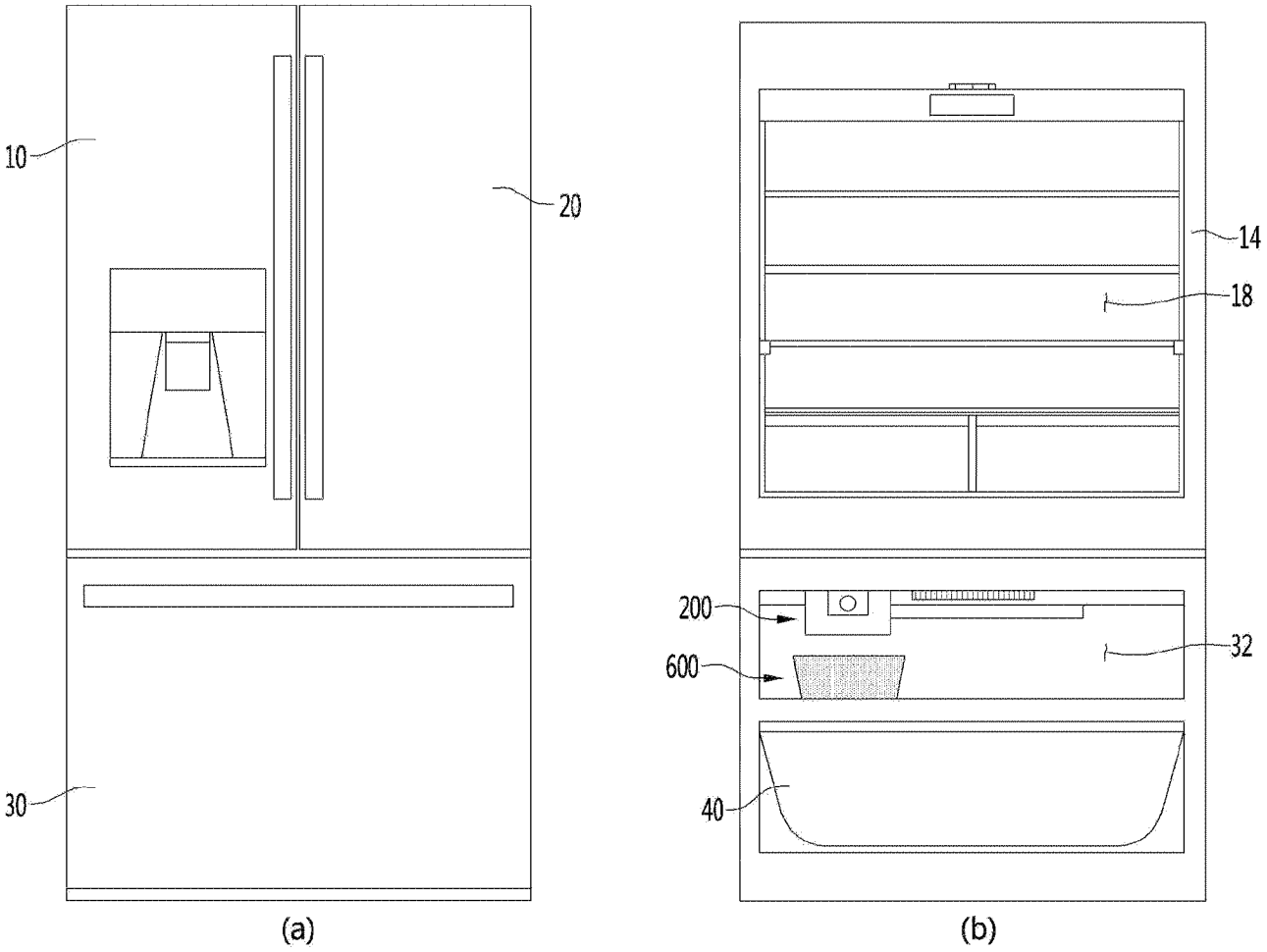
FIG. 1 is a front view of a refrigerator according to an embodiment.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

The refrigerator according to an embodiment may include a tray assembly defining a portion of an ice making cell that is a space in which water is phase-changed into ice, a cooler supplying cold air to the ice making cell, a water supply part supplying water to the ice making cell, and a controller. The refrigerator may further include a temperature sensor detecting a temperature of water or ice of the ice making cell. The refrigerator may further include a heater disposed adjacent to the tray assembly. The refrigerator may further include a driver to move the tray assembly. The refrigerator may further include a storage chamber in which food is stored in addition to the ice making cell. The refrigerator may further include a cooler supplying cold to the storage chamber. The refrigerator may further include a temperature sensor sensing a temperature in the storage chamber. The controller may control at least one of the water supply part or the cooler. The controller may control at least one of the heater or the driver.

The controller may control the cooler so that cold is supplied to the ice making cell after moving the tray assembly to an ice making position. The controller may control the second tray assembly so that the second tray assembly moves to an ice separation position in a forward direction so as to take out the ice in the ice making cell when the ice is completely made in the ice making cell. The controller may control the tray assembly so that the supply of the water supply part after the second tray assembly moves to the water supply position in the reverse direction when the ice is completely separated. The controller may control the tray assembly so as to move to the ice making position after the water supply is completed.

According to an embodiment, the storage chamber may be defined as a space that is controlled to a predetermined temperature by the cooler. An outer case may be defined as a wall that divides the storage chamber and an external space of the storage chamber (i.e., an external space of the refrigerator). An insulation material may be disposed between the outer case and the storage chamber. An inner case may be disposed between the insulation material and the storage chamber.

According to an embodiment, the ice making cell may be disposed in the storage chamber and may be defined as a space in which water is phase-changed into ice. A circumference of the ice making cell refers to an outer surface of the ice making cell irrespective of the shape of the ice making cell. In another aspect, an outer circumferential surface of the ice making cell may refer to an inner surface of the wall defining the ice making cell. A center of the ice making cell refers to a center of gravity or volume of the ice making cell. The center may pass through a symmetry line of the ice making cell.

According to an embodiment, the tray may be defined as a wall partitioning the ice making cell from the inside of the storage chamber. The tray may be defined as a wall defining at least a portion of the ice making cell. The tray may be configured to surround the whole or a portion of the ice making cell. The tray may include a first portion that defines at least a portion of the ice making cell and a second portion extending from a predetermined point of the first portion. The tray may be provided in plurality. The plurality of trays may contact each other. For example, the tray disposed at the lower portion may include a plurality of trays. The tray disposed at the upper portion may include a plurality of trays. The refrigerator may include at least one tray disposed under the ice making cell. The refrigerator may further include a tray disposed above the ice making cell. The first portion and the second portion may have a structure inconsideration of a degree of heat transfer of the tray, a degree of cold transfer of the tray, a degree of deformation resistance of the tray, a recovery degree of the tray, a degree of supercooling of the tray, a degree of attachment between the tray and ice solidified in the tray, and coupling force between one tray and the other tray of the plurality of trays.

According to an embodiment, the tray case may be disposed between the tray and the storage chamber. That is, the tray case may be disposed so that at least a portion thereof surrounds the tray. The tray case may be provided in plurality. The plurality of tray cases may contact each other. The tray case may contact the tray to support at least a portion of the tray. The tray case may be configured to connect components except for the tray (e.g., a heater, a sensor, a power transmission member, etc.). The tray case may be directly coupled to the component or coupled to the component via a medium therebetween. For example, if the wall defining the ice making cell is provided as a thin film, and a structure surrounding the thin film is provided, the thin film may be defined as a tray, and the structure may be defined as a tray case. For another example, if a portion of the wall defining the ice making cell is provided as a thin film, and a structure includes a first portion defining the other portion of the wall defining the ice making cell and a second part surrounding the thin film, the thin film and the first portion of the structure are defined as trays, and the second portion of the structure is defined as a tray case.

According to an embodiment, the tray assembly may be defined to include at least the tray. According to an embodiment, the tray assembly may further include the tray case.

According to an embodiment, the refrigerator may include at least one tray assembly connected to the driver to move. The driver is configured to move the tray assembly in at least one axial direction of the X, Y, or Z axis or to rotate about the axis of at least one of the X, Y, or Z axis. The embodiment may include a refrigerator having the remaining configuration except for the driver and the power transmission member connecting the driver to the tray assembly in the contents described in the detailed description. According to an embodiment, the tray assembly may move in a first direction.

According to an embodiment, the cooler may be defined as a part configured to cool the storage chamber including at least one of an evaporator or a thermoelectric element.

According to an embodiment, the refrigerator may include at least one tray assembly in which the heater is disposed. The heater may be disposed in the vicinity of the tray assembly to heat the ice making cell defined by the tray assembly in which the heater is disposed. The heater may include a heater to be turned on in at least partial section while the cooler supplies cold so that bubbles dissolved in the water within the ice making cell moves from a portion, at which the ice is made, toward the water that is in a liquid state to make transparent ice. The heater may include a heater (hereinafter referred to as an "ice separation heater") controlled to be turned on in at least a section after the ice making is completed so that ice is easily separated from the tray assembly. The refrigerator may include a plurality of transparent ice heaters. The refrigerator may include a plurality of ice separation heaters. The refrigerator may include a transparent ice heater and an ice separation heater. In this case, the controller may control the ice separation heater so that a heating amount of ice separation heater is greater than that of transparent ice heater.

According to an embodiment, the tray assembly may include a first region and a second region, which define an outer circumferential surface of the ice making cell. The tray assembly may include a first portion that defines at least a portion of the ice making cell and a second portion extending from a predetermined point of the first portion.

For example, the first region may be defined in the first portion of the tray assembly. The first and second regions may be defined in the first portion of the tray assembly. Each of the first and second regions may be a portion of the one tray assembly. The first and second regions may be disposed to contact each other. The first region may be a lower portion of the ice making cell defined by the tray assembly. The second region may be an upper portion of an ice making cell defined by the tray assembly. The refrigerator may include an additional tray assembly. One of the first and second regions may include a region contacting the additional tray assembly. When the additional tray assembly is disposed in a lower portion of the first region, the additional tray assembly may contact the lower portion of the first region. When the additional tray assembly is disposed in an upper portion of the second region, the additional tray assembly and the upper portion of the second region may contact each other.

For another example, the tray assembly may be provided in plurality contacting each other. The first region may be disposed in a first tray assembly of the plurality of tray assemblies, and the second region may be disposed in a second tray assembly. The first region may be the first tray assembly. The second region may be the second tray assembly. The first and second regions may be disposed to contact each other. At least a portion of the first tray assembly may be disposed under the ice making cell defined by the first and second tray assemblies. At least a portion of the second tray assembly may be disposed above the ice making cell defined by the first and second tray assemblies.

The first region may be a region closer to the heater than the second region. The first region may be a region in which the heater is disposed. The second region may be a region closer to a heat absorbing part (i.e., a coolant pipe or a heat absorbing part of a thermoelectric module) of the cooler than the first region. The second region may be a region closer to the through-hole supplying cold to the ice making cell than the first region. To allow the cooler to supply the cold through the through-hole, an additional through-hole may be defined in another component. The second region may be a region closer to the additional through-hole than the first region. The heater may be a transparent ice heater. The heat insulation degree of the second region with respect to the cold may be less than that of the first region.

The heater may be disposed in one of the first and second tray assemblies of the refrigerator. For example, when the heater is not disposed on the other one, the controller may control the heater to be turned on in at least a section of the cooler to supply the cold air. For another example, when the additional heater is disposed on the other one, the controller may control the heater so that the heating amount of heater is greater than that of additional heater in at least a section of the cooler to supply the cold air. The heater may be a transparent ice heater.

The embodiment may include a refrigerator having a configuration excluding the transparent ice heater in the contents described in the detailed description.

The embodiment may include a pusher including a first edge having a surface pressing the ice or at least one surface of the tray assembly so that the ice is easily separated from the tray assembly. The pusher may include a bar extending from the first edge and a second edge disposed at an end of the bar. The controller may control the pusher so that a position of the pusher is changed by moving at least one of the pusher or the tray assembly. The pusher may be defined as a penetrating type pusher, a non-penetrating type pusher, a movable pusher, or a fixed pusher according to a view point.

A through-hole through which the pusher moves may be defined in the tray assembly, and the pusher may be configured to directly press the ice in the tray assembly. The pusher may be defined as a penetrating type pusher.

The tray assembly may be provided with a pressing part to be pressed by the pusher, the pusher may be configured to apply a pressure to one surface of the tray assembly. The pusher may be defined as a non-penetrating type pusher.

The controller may control the pusher to move so that the first edge of the pusher is disposed between a first point outside the ice making cell and a second point inside the ice making cell.

The pusher may be defined as a movable pusher. The pusher may be connected to a driver, the rotation shaft of the driver, or the tray assembly that is connected to the driver and is movable. The controller may control the pusher to move at least one of the tray assemblies so that the first edge of the pusher is disposed between the first point outside the ice making cell and the second point inside the ice making cell. The controller may control at least one of the tray assemblies to move to the pusher. Alternatively, the controller may control a relative position of the pusher and the tray assembly so that the pusher further presses the pressing part after contacting the pressing part at the first point outside the ice making cell. The pusher may be coupled to a fixed end. The pusher may be defined as a fixed pusher.

According to an embodiment, the ice making cell may be cooled by the cooler cooling the storage chamber. For example, the storage chamber in which the ice making cell is disposed may be a freezing compartment which is controlled at a temperature lower than 0 degree, and the ice making cell may be cooled by the cooler cooling the freezing compartment.

The freezing compartment may be divided into a plurality of regions, and the ice making cell may be disposed in one region of the plurality of regions.

According to an embodiment, the ice making cell may be cooled by a cooler other than the cooler cooling the storage chamber. For example, the storage chamber in which the ice making cell is disposed is a refrigerating compartment which is controlled to a temperature higher than 0 degree, and the ice making cell may be cooled by a cooler other than the cooler cooling the refrigerating compartment. That is, the refrigerator may include a refrigerating compartment and a freezing compartment, the ice making cell may be disposed inside the refrigerating compartment, and the ice maker cell may be cooled by the cooler that cools the freezing compartment.

The ice making cell may be disposed in a door that opens and closes the storage chamber.

According to an embodiment, the ice making cell is not disposed inside the storage chamber and may be cooled by the cooler. For example, the entire storage chamber defined inside the outer case may be the ice making cell. According to an embodiment, a degree of heat transfer indicates a degree of heat transfer from a high-temperature object to a low-temperature object and is defined as a value determined by a shape including a thickness of the object, a material of the object, and the like. In terms of the material of the object, a high degree of the heat transfer of the object may represent that thermal conductivity of the object is high. The thermal conductivity may be a unique material property of the object. Even when the material of the object is the same, the degree of heat transfer may vary depending on the shape of the object.

The degree of heat transfer may vary depending on the shape of the object. The degree of heat transfer from a point A to a point B may be influenced by a length of a path through which heat is transferred from the point A to the point B (hereinafter, referred to as a "heat transfer path"). The more the heat transfer path from the point A to the point B increases, the more the degree of heat transfer from the point A to the point B may decrease. The more the heat transfer path from the point A to the point B, the more the degree of heat transfer from the point A to the point B may increase.

The degree of heat transfer from the point A to the point B may be influenced by a thickness of the path through which heat is transferred from the point A to the point B. The more the thickness in a path direction in which heat is transferred from the point A to the point B decreases, the more the degree of heat transfer from the point A to the point B may decrease. The greater the thickness in the path direction from which the heat from point A to point B is transferred, the more the degree of heat transfer from point A to point B.

According to an embodiment, a degree of cold transfer indicates a degree of heat transfer from a low-temperature object to a high-temperature object and is defined as a value determined by a shape including a thickness of the object, a material of the object, and the like. The degree of cold transfer is a term defined in consideration of a direction in which cold air flows and may be regarded as the same concept as the degree of heat transfer. The same concept as the degree of heat transfer will be omitted.

According to an embodiment, a degree of supercooling is a degree of supercooling of a liquid and may be defined as a value determined by a material of the liquid, a material or shape of a container containing the liquid, an external factor applied to the liquid during a solidification process of the liquid, and the like. An increase in frequency at which the liquid is supercooled may be seen as an increase in degree of the supercooling. The lowering of the temperature at which the liquid is maintained in the supercooled state may be seen as an increase in degree of the supercooling. Here, the supercooling refers to a state in which the liquid exists in the liquid phase without solidification even at a temperature below a freezing point of the liquid. The supercooled liquid has a characteristic in which the solidification rapidly occurs from a time point at which the supercooling is terminated. If it is desired to maintain a rate at which the liquid is solidified, it is advantageous to be designed so that the supercooling phenomenon is reduced.

According to an embodiment, a degree of deformation resistance represents a degree to which an object resists deformation due to external force applied to the object and is a value determined by a shape including a thickness of the object, a material of the object, and the like. For example, the external force may include a pressure applied to the tray assembly in the process of solidifying and expanding water in the ice making cell. In another example, the external force may include a pressure on the ice or a portion of the tray assembly by the pusher for separating the ice from the tray assembly. For another example, when coupled between the tray assemblies, it may include a pressure applied by the coupling.

In terms of the material of the object, a high degree of the deformation resistance of the object may represent that rigidity of the object is high. The thermal conductivity may be a unique material property of the object. Even when the material of the object is the same, the degree of deformation resistance may vary depending on the shape of the object. The degree of deformation resistance may be affected by a deformation resistance reinforcement part extending in a direction in which the external force is applied. The more the rigidity of the deformation resistant resistance reinforcement part increases, the more the degree of deformation resistance may increase. The more the height of the extending deformation resistance reinforcement part increase, the more the degree of deformation resistance may increase.

According to an embodiment, a degree of restoration indicates a degree to which an object deformed by the external force is restored to a shape of the object before the external force is applied after the external force is removed and is defined as a value determined by a shape including a thickness of the object, a material of the object, and the like. For example, the external force may include a pressure applied to the tray assembly in the process of solidifying and expanding water in the ice making cell. In another example, the external force may include a pressure on the ice or a portion of the tray assembly by the pusher for separating the ice from the tray assembly. For another example, when coupled between the tray assemblies, it may include a pressure applied by the coupling force.

In view of the material of the object, a high degree of the restoration of the object may represent that an elastic modulus of the object is high. The elastic modulus may be a material property unique to the object. Even when the material of the object is the same, the degree of restoration may vary depending on the shape of the object. The degree of restoration may be affected by an elastic resistance reinforcement part extending in a direction in which the external force is applied. The more the elastic modulus of the elastic resistance reinforcement part increases, the more the degree of restoration may increase.

According to an embodiment, the coupling force represents a degree of coupling between the plurality of tray assemblies and is defined as a value determined by a shape including a thickness of the tray assembly, a material of the tray assembly, magnitude of the force that couples the trays to each other, and the like.

According to an embodiment, a degree of attachment indicates a degree to which the ice and the container are attached to each other in a process of making ice from water contained in the container and is defined as a value determined by a shape including a thickness of the container, a material of the container, a time elapsed after the ice is made in the container, and the like.

The refrigerator according to an embodiment includes a first tray assembly defining a portion of an ice making cell that is a space in which water is phase-changed into ice by cold, a second tray assembly defining the other portion of the ice making cell, a cooler supplying cold to the ice making cell, a water supply part supplying water to the ice making cell, and a controller. The refrigerator may further include a storage chamber in addition to the ice making cell. The storage chamber may include a space for storing food. The ice making cell may be disposed in the storage chamber. The refrigerator may further include a first temperature sensor sensing a temperature in the storage chamber. The refrigerator may further include a second temperature sensor sensing a temperature of water or ice of the ice making cell. The second tray assembly may contact the first tray assembly in the ice making process and may be connected to the driver to be spaced apart from the first tray assembly in the ice making process. The refrigerator may further include a heater disposed adjacent to at least one of the first tray assembly or the second tray assembly.

The controller may control at least one of the heater or the driver. The controller may control the cooler so that the cold is supplied to the ice making cell after the second tray assembly moves to an ice making position when the water is completely supplied to the ice making cell. The controller may control the second tray assembly so that the second tray assembly moves in a reverse direction after moving to an ice separation position in a forward direction so as to take out the ice in the ice making cell when the ice is completely made in the ice making cell. The controller may control the second tray assembly so that the supply of the water supply part after the second tray assembly moves to the water supply position in the reverse direction when the ice is completely separated.

Transparent ice will be described. Bubbles are dissolved in water, and the ice solidified with the bubbles may have low transparency due to the bubbles. Therefore, in the process of water solidification, when the bubble is guided to move from a freezing portion in the ice making cell to another portion that is not yet frozen, the transparency of the ice may increase.

A through-hole defined in the tray assembly may affect the making of the transparent ice. The through-hole defined in one side of the tray assembly may affect the making of the transparent ice. In the process of making ice, if the bubbles move to the outside of the ice making cell from the frozen portion of the ice making cell, the transparency of the ice may increase. The through-hole may be defined in one side of the tray assembly to guide the bubbles so as to move out of the ice making cell. Since the bubbles have lower density than the liquid, the through-hole (hereinafter, referred to as an "air exhaust hole") for guiding the bubbles to escape to the outside of the ice making cell may be defined in the upper portion of the tray assembly.

The position of the cooler and the heater may affect the making of the transparent ice. The position of the cooler and the heater may affect an ice making direction, which is a direction in which ice is made inside the ice making cell.

In the ice making process, when bubbles move or are collected from a region in which water is first solidified in the ice making cell to another predetermined region in a liquid state, the transparency of the made ice may increase. The direction in which the bubbles move or are collected may be similar to the ice making direction. The predetermined region may be a region in which water is to be solidified lately in the ice making cell.

The predetermined region may be a region in which the cold supplied by the cooler reaches the ice making cell late. For example, in the ice making process, the through-hole through which the cooler supplies the cold to the ice making cell may be defined closer to the upper portion than the lower part of the ice making cell so as to move or collect the bubbles to the lower portion of the ice making cell. For another example, a heat absorbing part of the cooler (that is, a refrigerant pipe of the evaporator or a heat absorbing part of the thermoelectric element) may be disposed closer to the upper portion than the lower portion of the ice making cell. According to an embodiment, the upper and lower portions of the ice making cell may be defined as an upper region and a lower region based on a height of the ice making cell.

The predetermined region may be a region in which the heater is disposed. For example, in the ice making process, the heater may be disposed closer to the lower portion than the upper portion of the ice making cell so as to move or collect the bubbles in the water to the lower portion of the ice making cell.

The predetermined region may be a region closer to an outer circumferential surface of the ice making cell than to a center of the ice making cell. However, the vicinity of the center is not excluded. If the predetermined region is near the center of the ice making cell, an opaque portion due to the bubbles moved or collected near the center may be easily visible to the user, and the opaque portion may remain until most of the ice until the ice is melted. Also, it may be difficult to arrange the heater inside the ice making cell containing water. In contrast, when the predetermined region is defined in or near the outer circumferential surface of the ice making cell, water may be solidified from one side of the outer circumferential surface of the ice making cell toward the other side of the outer circumferential surface of the ice making cell, thereby solving the above limitation. The transparent ice heater may be disposed on or near the outer circumferential surface of the ice making cell. The heater may be disposed at or near the tray assembly.

The predetermined region may be a position closer to the lower portion of the ice making cell than the upper portion of the ice making cell. However, the upper portion is also not excluded. In the ice making process, since liquid water having greater density than ice drops, it may be advantageous that the predetermined region is defined in the lower portion of the ice making cell.

At least one of the degree of deformation resistance, the degree of restoration, and the coupling force between the plurality of tray assemblies may affect the making of the transparent ice. At least one of the degree of deformation resistance, the degree of restoration, and the coupling force between the plurality of tray assemblies may affect the ice making direction that is a direction in which ice is made in the ice making cell. As described above, the tray assembly may include a first region and a second region, which define an outer circumferential surface of the ice making cell. For example, each of the first and second regions may be a portion of one tray assembly. For another example, the first region may be a first tray assembly. The second region may be a second tray assembly.

To make the transparent ice, it may be advantageous for the refrigerator to be configured so that the direction in which ice is made in the ice making cell is constant. This is because the more the ice making direction is constant, the more the bubbles in the water are moved or collected in a predetermined region within the ice making cell. It may be advantageous for the deformation of the portion to be greater than the deformation of the other portion so as to induce the ice to be made in the direction of the other portion in a portion of the tray assembly. The ice tends to be grown as the ice is expanded toward a potion at which the degree of deformation resistance is low. To start the ice making again after removing the made ice, the deformed portion has to be restored again to make ice having the same shape repeatedly. Therefore, it may be advantageous that the portion having the low degree of the deformation resistance has a high degree of the restoration than the portion having a high degree of the deformation resistance.

The degree of deformation resistance of the tray with respect to the external force may be less than that of the tray case with respect to the external force, or the rigidity of the tray may be less than that of the tray case. The tray assembly allows the tray to be deformed by the external force, while the tray case surrounding the tray is configured to reduce the deformation. For example, the tray assembly may be configured so that at least a portion of the tray is surrounded by the tray case. In this case, when a pressure is applied to the tray assembly while the water inside the ice making cell is solidified and expanded, at least a portion of the tray may be allowed to be deformed, and the other part of the tray may be supported by the tray case to restrict the deformation. In addition, when the external force is removed, the degree of restoration of the tray may be greater than that of the tray case, or the elastic modulus of the tray may be greater than that of the tray case. Such a configuration may be configured so that the deformed tray is easily restored.

The degree of deformation resistance of the tray with respect to the external force may be greater than that of the gasket of the refrigerator with respect to the external force, or the rigidity of the tray may be greater than that of the gasket. When the degree of deformation resistance of the tray is low, there may be a limitation that the tray is excessively deformed as the water in the ice making cell defined by the tray is solidified and expanded. Such a deformation of the tray may make it difficult to make the desired type of ice. In addition, the degree of restoration of the tray when the external force is removed may be configured to be less than that of the refrigerator gasket with respect to the external force, or the elastic modulus of the tray is less than that of the gasket.

The deformation resistance of the tray case with respect to the external force may be less than that of the refrigerator case with respect to the external force, or the rigidity of the tray case may be less than that of the refrigerator case. In general, the case of the refrigerator may be made of a metal material including steel. In addition, when the external force is removed, the degree of restoration of the tray case may be greater than that of the refrigerator case with respect to the external force, or the elastic modulus of the tray case is greater than that of the refrigerator case.

The relationship between the transparent ice and the degree of deformation resistance is as follows.

The second region may have different degree of deformation resistance in a direction along the outer circumferential surface of the ice making cell. The degree of deformation resistance of the portion of the second region may be greater than that of the another of the second region. Such a configuration may be assisted to induce ice to be made in a direction from the ice making cell defined by the second region to the ice making cell defined by the first region.

The first and second regions defined to contact each other may have different degree of deformation resistances in the direction along the outer circumferential surface of the ice making cell. The degree of deformation resistance of one portion of the second region may be greater than that of one portion of the first region. Such a configuration may be assisted to induce ice to be made in a direction from the ice making cell defined by the second region to the ice making cell defined by the first region.

In this case, as the water is solidified, a volume is expanded to apply a pressure to the tray assembly, which induces ice to be made in the other direction of the second region or in one direction of the first region. The degree of deformation resistance may be a degree that resists to deformation due to the external force. The external force may a pressure applied to the tray assembly in the process of solidifying and expanding water in the ice making cell. The external force may be force in a vertical direction (Z-axis direction) of the pressure. The external force may be force acting in a direction from the ice making cell defined by the second region to the ice making cell defined by the first region.

For example, in the thickness of the tray assembly in the direction of the outer circumferential surface of the ice making cell from the center of the ice making cell, one portion of the second region may be thicker than the other of the second region or thicker than one portion of the first region. One portion of the second region may be a portion at which the tray case is not surrounded. The other portion of the second region may be a portion surrounded by the tray case. One portion of the first region may be a portion at which the tray case is not surrounded. One portion of the second region may be a portion defining the uppermost portion of the ice making cell in the second region. The second region may include a tray and a tray case locally surrounding the tray. As described above, when at least a portion of the second region is thicker than the other part, the degree of deformation resistance of the second region may be improved with respect to an external force. A minimum value of the thickness of one portion of the second region may be greater than that of the thickness of the other portion of the second region or greater than that of one portion of the first region. A maximum value of the thickness of one portion of the second region may be greater than that of the thickness of the other portion of the second region or greater than that of one portion of the first region. When the through-hole is defined in the region, the minimum value represents the minimum value in the remaining regions except for the portion in which the through-hole is defined. An average value of the thickness of one portion of the second region may be greater than that of the thickness of the other portion of the second region or greater than that of one portion of the first region. The uniformity of the thickness of one portion of the second region may be less than that of the thickness of the other portion of the second region or less than that of one of the thickness of the first region.

For another example, one portion of the second region may include a first surface defining a portion of the ice making cell and a deformation resistance reinforcement part extending from the first surface in a vertical direction away from the ice making cell defined by the other of the second region. One portion of the second region may include a first surface defining a portion of the ice making cell and a deformation resistance reinforcement part extending from the first surface in a vertical direction away from the ice making cell defined by the first region. As described above, when at least a portion of the second region includes the deformation resistance reinforcement part, the degree of deformation resistance of the second region may be improved with respect to the external force.

For another example, one portion of the second region may further include a support surface connected to a fixed end of the refrigerator (e.g., the bracket, the storage chamber wall, etc.) disposed in a direction away from the ice making cell defined by the other of the second region from the first surface. One portion of the second region may further include a support surface connected to a fixed end of the refrigerator (e.g., the bracket, the storage chamber wall, etc.) disposed in a direction away from the ice making cell defined by the first region from the first surface. As described above, when at least a portion of the second region includes a support surface connected to the fixed end, the degree of deformation resistance of the second region may be improved with respect to the external force.

For another example, the tray assembly may include a first portion defining at least a portion of the ice making cell and a second portion extending from a predetermined point of the first portion. At least a portion of the second portion may extend in a direction away from the ice making cell defined by the first region. At least a portion of the second portion may include an additional deformation resistant resistance reinforcement part. At least a portion of the second portion may further include a support surface connected to the fixed end. As described above, when at least a portion of the second region further includes the second portion, it may be advantageous to improve the degree of deformation resistance of the second region with respect to the external force. This is because the additional deformation resistance reinforcement part is disposed at in the second portion, or the second portion is additionally supported by the fixed end.

For another example, one portion of the second region may include a first through-hole. As described above, when the first through-hole is defined, the ice solidified in the ice making cell of the second region is expanded to the outside of the ice making cell through the first through-hole, and thus, the pressure applied to the second region may be reduced. In particular, when water is excessively supplied to the ice making cell, the first through-hole may be contributed to reduce the deformation of the second region in the process of solidifying the water.

One portion of the second region may include a second through-hole providing a path through which the bubbles contained in the water in the ice making cell of the second region move or escape. When the second through-hole is defined as described above, the transparency of the solidified ice may be improved.

In one portion of the second region, a third through-hole may be defined to press the penetrating pusher. This is because it may be difficult for the non-penetrating type pusher to press the surface of the tray assembly so as to remove the ice when the degree of deformation resistance of the second region increases. The first, second, and third through-holes may overlap each other. The first, second, and third through-holes may be defined in one through-hole.

One portion of the second region may include a mounting part on which the ice separation heater is disposed. The induction of the ice in the ice making cell defined by the second region in the direction of the ice making cell defined by the first region may represent that the ice is first made in the second region. In this case, a time for which the ice is attached to the second region may be long, and the ice separation heater may be required to separate the ice from the second region. The thickness of the tray assembly in the direction of the outer circumferential surface of the ice making cell from the center of the ice making cell may be less than that of the other portion of the second region in which the ice separation heater is mounted. This is because the heat supplied by the ice separation heater increases in amount transferred to the ice making cell. The fixed end may be a portion of the wall defining the storage chamber or a bracket.

The relation between the coupling force of the transparent ice and the tray assembly is as follows.

To induce the ice to be made in the ice making cell defined by the second region in the direction of the ice making cell defined by the first region, it may be advantageous to increase in coupling force between the first and second regions arranged to contact each other. In the process of solidifying the water, when the pressure applied to the tray assembly while expanded is greater than the coupling force between the first and second regions, the ice may be made in a direction in which the first and second regions are separated from each other. In the process of solidifying the water, when the pressure applied to the tray assembly while expanded is low, the coupling force between the first and second regions is low, it also has the advantage of inducing the ice to be made so that the ice is made in a direction of the region having the smallest degree of deformation resistance in the first and second regions.

There may be various examples of a method of increasing the coupling force between the first and second regions. For example, after the water supply is completed, the controller may change a movement position of the driver in the first direction to control one of the first and second regions so as to move in the first direction, and then, the movement position of the driver may be controlled to be additionally changed into the first direction so that the coupling force between the first and second regions increases. For another example, since the coupling force between the first and second regions increase, the degree of deformation resistances or the degree of restorations of the first and second regions may be different from each other with respect to the force applied from the driver so that the driver reduces the change of the shape of the ice making cell by the expanding the ice after the ice making process is started (or after the heater is turned on). For another example, the first region may include a first surface facing the second region. The second region may include a second surface facing the first region. The first and second surfaces may be disposed to contact each other. The first and second surfaces may be disposed to face each other. The first and second surfaces may be disposed to be separated from and coupled to each other. In this case, surface areas of the first surface and the second surface may be different from each other. In this configuration, the coupling force of the first and second regions may increase while reducing breakage of the portion at which the first and second regions contact each other. In addition, there is an advantage of reducing leakage of water supplied between the first and second regions.

The relationship between transparent ice and the degree of restoration is as follows.

The tray assembly may include a first portion that defines at least a portion of the ice making cell and a second portion extending from a predetermined point of the first portion. The second portion is configured to be deformed by the expansion of the ice made and then restored after the ice is removed. The second portion may include a horizontal extension part provided so that the degree of restoration with respect to the horizontal external force of the expanded ice increases. The second portion may include a vertical extension part provided so that the degree of restoration with respect to the vertical external force of the expanded ice increases. Such a configuration may be assisted to induce ice to be made in a direction from the ice making cell defined by the second region to the ice making cell defined by the first region.

The second region may have different degree of restoration in a direction along the outer circumferential surface of the ice making cell. The first region may have different degree of deformation resistance in a direction along the outer circumferential surface of the ice making cell. The degree of restoration of one portion of the first region may be greater than that of the other portion of the first region. Also, the degree of deformation resistance of one portion may be less than that of the other portion. Such a configuration may be assisted to induce ice to be made in a direction from the ice making cell defined by the second region to the ice making cell defined by the first region.

The first and second regions defined to contact each other may have different degree of restoration in the direction along the outer circumferential surface of the ice making cell. Also, the first and second regions may have different degree of deformation resistances in the direction along the outer circumferential surface of the ice making cell. The degree of restoration of one of the first region may be greater than that of one of the second region. Also, the degree of deformation resistance of one of the first regions may be greater than that of one of the second region. Such a configuration may be assisted to induce ice to be made in a direction from the ice making cell defined by the second region to the ice making cell defined by the first region.

In this case, as the water is solidified, a volume is expanded to apply a pressure to the tray assembly, which induces ice to be made in one direction of the first region in which the degree of deformation resistance decreases, or the degree of restoration increases. Here, the degree of restoration may be a degree of restoration after the external force is removed. The external force may a pressure applied to the tray assembly in the process of solidifying and expanding water in the ice making cell. The external force may be force in a vertical direction (Z-axis direction) of the pressure. The external force may be force acting in a direction from the ice making cell defined by the second region to the ice making cell defined by the first region.

For example, in the thickness of the tray assembly in the direction of the outer circumferential surface of the ice making cell from the center of the ice making cell, one portion of the first region may be thinner than the other of the first region or thinner than one portion of the second region. One portion of the first region may be a portion at which the tray case is not surrounded. The other portion of the first region may be a portion that is surrounded by the tray case. One portion of the second region may be a portion that is surrounded by the tray case. One portion of the first region may be a portion of the first region that defines the lowermost end of the ice making cell. The first region may include a tray and a tray case locally surrounding the tray.

A minimum value of the thickness of one portion of the first region may be less than that of the thickness of the other portion of the second region or less than that of one of the second region. A maximum value of the thickness of one portion of the first region may be less than that of the thickness of the other portion of the first region or less than that of the thickness of one portion of the second region. When the through-hole is defined in the region, the minimum value represents the minimum value in the remaining regions except for the portion in which the through-hole is defined. An average value of the thickness of one portion of the first region may be less than that of the thickness of the other portion of the first region or may be less than that of one of the thickness of the second region. The uniformity of the thickness of one portion of the first region may be greater than that of the thickness of the other portion of the first region or greater than that of one of the thickness of the second region.

For another example, a shape of one portion of the first region may be different from that of the other portion of the first region or different from that of one portion of the second region. A curvature of one portion of the first region may be different from that of the other portion of the first region or different from that of one portion of the second region. A curvature of one portion of the first region may be less than that of the other portion of the first region or less than that of one portion of the second region. One portion of the first region may include a flat surface. The other portion of the first region may include a curved surface. One portion of the second region may include a curved surface. One portion of the first region may include a shape that is recessed in a direction opposite to the direction in which the ice is expanded. One portion of the first region may include a shape recessed in a direction opposite to a direction in which the ice is made. In the ice making process, one portion of the first region may be modified in a direction in which the ice is expanded or a direction in which the ice is made. In the ice making process, in an amount of deformation from the center of the ice making cell toward the outer circumferential surface of the ice making cell, one portion of the first region is greater than the other portion of the first region. In the ice making process, in the amount of deformation from the center of the ice making cell toward the outer circumferential surface of the ice making cell, one portion of the first region is greater than one portion of the second region.

For another example, to induce ice to be made in a direction from the ice making cell defined by the second region to the ice making cell defined by the first region, one portion of the first region may include a first surface defining a portion of the ice making cell and a second surface extending from the first surface and supported by one surface of the other portion of the first region. The first region may be configured not to be directly supported by the other component except for the second surface. The other component may be a fixed end of the refrigerator.

One portion of the first region may have a pressing surface pressed by the non-penetrating type pusher. This is because when the degree of deformation resistance of the first region is low, or the degree of restoration is high, the difficulty in removing the ice by pressing the surface of the tray assembly may be reduced.

An ice making rate, at which ice is made inside the ice making cell, may affect the making of the transparent ice. The ice making rate may affect the transparency of the made ice. Factors affecting the ice making rate may be an amount of cold and/or heat, which are/is supplied to the ice making cell. The amount of cold and/or heat may affect the making of the transparent ice. The amount of cold and/or heat may affect the transparency of the ice.

In the process of making the transparent ice, the transparency of the ice may be lowered as the ice making rate is greater than a rate at which the bubbles in the ice making cell are moved or collected. On the other hand, if the ice making rate is less than the rate at which the bubbles are moved or collected, the transparency of the ice may increase. However, the more the ice making rate decreases, the more a time taken to make the transparent ice may increase. Also, the transparency of the ice may be uniform as the ice making rate is maintained in a uniform range.

To maintain the ice making rate uniformly within a predetermined range, an amount of cold and heat supplied to the ice making cell may be uniform. However, in actual use conditions of the refrigerator, a case in which the amount of cold is variable may occur, and thus, it is necessary to allow a supply amount of heat to vary. For example, when a temperature of the storage chamber reaches a satisfaction region from a dissatisfaction region, when a defrosting operation is performed with respect to the cooler of the storage chamber, the door of the storage chamber may variously vary in state such as an opened state. Also, if an amount of water per unit height of the ice making cell is different, when the same cold and heat per unit height is supplied, the transparency per unit height may vary.

To solve this limitation, the controller may control the heater so that when a heat transfer amount between the cold within the storage chamber and the water of the ice making cell increases, the heating amount of transparent ice heater increases, and when the heat transfer amount between the cold within the storage chamber and the water of the ice making cell decreases, the heating amount of transparent ice heater decreases so as to maintain an ice making rate of the water within the ice making cell within a predetermined range that is less than an ice making rate when the ice making is performed in a state in which the heater is turned off.

The controller may control one or more of a cold supply amount of cooler and a heat supply amount of heater to vary according to a mass per unit height of water in the ice making cell. In this case, the transparent ice may be provided to correspond to a change in shape of the ice making cell.

The refrigerator may further include a sensor measuring information on the mass of water per unit height of the ice making cell, and the controller may control one of the cold supply amount of cooler and the heat supply amount of heater based on the information inputted from the sensor.

The refrigerator may include a storage part in which predetermined driving information of the cooler is recorded based on information on mass per unit height of the ice making cell, and the controller may control the cold supply amount of cooler to be changed based on the information.

The refrigerator may include a storage part in which predetermined driving information of the heater is recorded based on information on mass per unit height of the ice making cell, and the controller may control the heat supply amount of heater to be changed based on the information. For example, the controller may control at least one of the cold supply amount of cooler or the heat supply amount of heater to vary according to a predetermined time based on the information on the mass per unit height of the ice making cell. The time may be a time when the cooler is driven or a time when the heater is driven to make ice. For another example, the controller may control at least one of the cold supply amount of cooler or the heat supply amount of heater to vary according to a predetermined temperature based on the information on the mass per unit height of the ice making cell. The temperature may be a temperature of the ice making cell or a temperature of the tray assembly defining the ice making cell.

When the sensor measuring the mass of water per unit height of the ice making cell is malfunctioned, or when the water supplied to the ice making cell is insufficient or excessive, the shape of the ice making water is changed, and thus the transparency of the made ice may decrease. To solve this limitation, a water supply method in which an amount of water supplied to the ice making cell is precisely controlled is required. Also, the tray assembly may include a structure in which leakage of the tray assembly is reduced to reduce the leakage of water in the ice making cell at the water supply position or the ice making position. Also, it is necessary to increase the coupling force between the first and second tray assemblies defining the ice making cell so as to reduce the change in shape of the ice making cell due to the expansion force of the ice during the ice making. Also, it is necessary to decrease in leakage in the precision water supply method and the tray assembly and increase in coupling force between the first and second tray assemblies so as to make ice having a shape that is close to the tray shape.

The degree of supercooling of the water inside the ice making cell may affect the making of the transparent ice. The degree of supercooling of the water may affect the transparency of the made ice.

To make the transparent ice, it may be desirable to design the degree of supercooling or lower the temperature inside the ice making cell and thereby to maintain a predetermined range. This is because the supercooled liquid has a characteristic in which the solidification rapidly occurs from a time point at which the supercooling is terminated. In this case, the transparency of the ice may decrease.

In the process of solidifying the liquid, the controller of the refrigerator may control the supercooling release part to operate so as to reduce a degree of supercooling of the liquid if the time required for reaching the specific temperature below the freezing point after the temperature of the liquid reaches the freezing point is less than a reference value. After reaching the freezing point, it is seen that the temperature of the liquid is cooled below the freezing point as the supercooling occurs, and no solidification occurs.

An example of the supercooling release part may include an electrical spark generating part. When the spark is supplied to the liquid, the degree of supercooling of the liquid may be reduced. Another example of the supercooling release part may include a driver applying external force so that the liquid moves. The driver may allow the container to move in at least one direction among X, Y, or Z axes or to rotate about at least one axis among X, Y, or Z axes. When kinetic energy is supplied to the liquid, the degree of supercooling of the liquid may be reduced. Further another example of the supercooling release part may include a part supplying the liquid to the container. After supplying the liquid having a first volume less than that of the container, when a predetermined time has elapsed or the temperature of the liquid reaches a certain temperature below the freezing point, the controller of the refrigerator may control an amount of liquid to additionally supply the liquid having a second volume greater than the first volume. When the liquid is divided and supplied to the container as described above, the liquid supplied first may be solidified to act as freezing nucleus, and thus, the degree of supercooling of the liquid to be supplied may be further reduced.

The more the degree of heat transfer of the container containing the liquid increase, the more the degree of supercooling of the liquid may increase. The more the degree of heat transfer of the container containing the liquid decrease, the more the degree of supercooling of the liquid may decrease.

The structure and method of heating the ice making cell in addition to the heat transfer of the tray assembly may affect the making of the transparent ice. As described above, the tray assembly may include a first region and a second region, which define an outer circumferential surface of the ice making cell. For example, each of the first and second regions may be a portion of one tray assembly. For another example, the first region may be a first tray assembly. The second region may be a second tray assembly.

The cold supplied to the ice making cell and the heat supplied to the ice making cell have opposite properties. To increase the ice making rate and/or improve the transparency of the ice, the design of the structure and control of the cooler and the heater, the relationship between the cooler and the tray assembly, and the relationship between the heater and the tray assembly may be very important.

For a constant amount of cold supplied by the cooler and a constant amount of heat supplied by the heater, it may be advantageous for the heater to be arranged to locally heat the ice making cell so as to increase the ice making rate of the refrigerator and/or to increase the transparency of the ice. As the heat transmitted from the heater to the ice making cell is transferred to an area other than the area on which the heater is disposed, the ice making rate may be improved. As the heater heats only a portion of the ice making cell, the heater may move or collect the bubbles to an area adjacent to the heater in the ice making cell, thereby increasing the transparency of the ice.

When the amount of heat supplied by the heater to the ice making cell is large, the bubbles in the water may be moved or collected in the portion to which the heat is supplied, and thus, the made ice may increase in transparency. However, if the heat is uniformly supplied to the outer circumferential surface of the ice making cell, the ice making rate of the ice may decrease. Therefore, as the heater locally heats a portion of the ice making cell, it is possible to increase the transparency of the made ice and minimize the decrease of the ice making rate.

The heater may be disposed to contact one side of the tray assembly. The heater may be disposed between the tray and the tray case. The heat transfer through the conduction may be advantageous for locally heating the ice making cell.

At least a portion of the other side at which the heater does not contact the tray may be sealed with a heat insulation material. Such a configuration may reduce that the heat supplied from the heater is transferred toward the storage chamber.

The tray assembly may be configured so that the heat transfer from the heater toward the center of the ice making cell is greater than that transfer from the heater in the circumference direction of the ice making cell.

The heat transfer of the tray toward the center of the ice making cell in the tray may be greater than the that transfer from the tray case to the storage chamber, or the thermal conductivity of the tray may be greater than that of the tray case. Such a configuration may induce the increase in heat transmitted from the heater to the ice making cell via the tray. In addition, it is possible to reduce the heat of the heater is transferred to the storage chamber via the tray case.

The heat transfer of the tray toward the center of the ice making cell in the tray may be less than that of the refrigerator case toward the storage chamber from the outside of the refrigerator case (for example, an inner case or an outer case), or the thermal conductivity of the tray may be less than that of the refrigerator case. This is because the more the heat or thermal conductivity of the tray increases, the more the supercooling of the water accommodated in the tray may increase. The more the degree of supercooling of the water increase, the more the water may be rapidly solidified at the time point at which the supercooling is released. In this case, a limitation may occur in which the transparency of the ice is not uniform or the transparency decreases. In general, the case of the refrigerator may be made of a metal material including steel.

The heat transfer of the tray case in the direction from the storage chamber to the tray case may be greater than the that of the heat insulation wall in the direction from the outer space of the refrigerator to the storage chamber, or the thermal conductivity of the tray case may be greater than that of the heat insulation wall (for example, the insulation material disposed between the inner and outer cases of the refrigerator). Here, the heat insulation wall may represent a heat insulation wall that partitions the external space from the storage chamber. If the degree of heat transfer of the tray case is equal to or greater than that of the heat insulation wall, the rate at which the ice making cell is cooled may be excessively reduced.

The first region may be configured to have a different degree of heat transfer in a direction along the outer circumferential surface. The degree of heat transfer of one portion of the first region may be less than that of the other portion of the first region. Such a configuration may be assisted to reduce the heat transfer transferred through the tray assembly from the first region to the second region in the direction along the outer circumferential surface.

The first and second regions defined to contact each other may be configured to have a different degree of heat transfer in the direction along the outer circumferential surface. The degree of heat transfer of one portion of the first region may be configured to be less than the degree of heat transfer of one portion of the second region. Such a configuration may be assisted to reduce the heat transfer transferred through the tray assembly from the first region to the second region in the direction along the outer circumferential surface. In another aspect, it may be advantageous to reduce the heat transferred from the heater to one portion of the first region to be transferred to the ice making cell defined by the second region. As the heat transmitted to the second region is reduced, the heater may locally heat one portion of the first region. Thus, it may be possible to reduce the decrease in ice making rate by the heating of the heater. In another aspect, the bubbles may be moved or collected in the region in which the heater is locally heated, thereby improving the transparency of the ice. The heater may be a transparent ice heater.

For example, a length of the heat transfer path from the first region to the second region may be greater than that of the heat transfer path in the direction from the first region to the outer circumferential surface from the first region. For another example, in a thickness of the tray assembly in the direction of the outer circumferential surface of the ice making cell from the center of the ice making cell, one portion of the first region may be thinner than the other of the first region or thinner than one portion of the second region. One portion of the first region may be a portion at which the tray case is not surrounded. The other portion of the first region may be a portion that is surrounded by the tray case. One portion of the second region may be a portion that is surrounded by the tray case. One portion of the first region may be a portion of the first region that defines the lowest end of the ice making cell. The first region may include a tray and a tray case locally surrounding the tray.

As described above, when the thickness of the first region is thin, the heat transfer in the direction of the center of the ice making cell may increase while reducing the heat transfer in the direction of the outer circumferential surface of the ice making cell. For this reason, the ice making cell defined by the first region may be locally heated.

A minimum value of the thickness of one portion of the first region may be less than that of the thickness of the other portion of the second region or less than that of one of the second region. A maximum value of the thickness of one portion of the first region may be less than that of the thickness of the other portion of the first region or less than that of the thickness of one portion of the second region. When the through-hole is defined in the region, the minimum value represents the minimum value in the remaining regions except for the portion in which the through-hole is defined. An average value of the thickness of one portion of the first region may be less than that of the thickness of the other portion of the first region or may be less than that of one of the thickness of the second region. The uniformity of the thickness of one portion of the first region may be greater than that of the thickness of the other portion of the first region or greater than that of one of the thickness of the second region.

For example, the tray assembly may include a first portion defining at least a portion of the ice making cell and a second portion extending from a predetermined point of the first portion. The first region may be defined in the first portion. The second region may be defined in an additional tray assembly that may contact the first portion. At least a portion of the second portion may extend in a direction away from the ice making cell defined by the second region. In this case, the heat transmitted from the heater to the first region may be reduced from being transferred to the second region.

The structure and method of cooling the ice making cell in addition to the degree of cold transfer of the tray assembly may affect the making of the transparent ice. As described above, the tray assembly may include a first region and a second region, which define an outer circumferential surface of the ice making cell. For example, each of the first and second regions may be a portion of one tray assembly. For another example, the first region may be a first tray assembly. The second region may be a second tray assembly.

For a constant amount of cold supplied by the cooler and a constant amount of heat supplied by the heater, it may be advantageous to configure the cooler so that a portion of the ice making cell is more intensively cooled to increase the ice making rate of the refrigerator and/or increase the transparency of the ice. The more the cold supplied to the ice making cell by the cooler increases, the more the ice making rate may increase. However, as the cold is uniformly supplied to the outer circumferential surface of the ice making cell, the transparency of the made ice may decrease. Therefore, as the cooler more intensively cools a portion of the ice making cell, the bubbles may be moved or collected to other regions of the ice making cell, thereby increasing the transparency of the made ice and minimizing the decrease in ice making rate.

The cooler may be configured so that the amount of cold supplied to the second region differs from that of cold supplied to the first region so as to allow the cooler to more intensively cool a portion of the ice making cell. The amount of cold supplied to the second region by the cooler may be greater than that of cold supplied to the first region.

For example, the second region may be made of a metal material having a high cold transfer rate, and the first region may be made of a material having a cold rate less than that of the metal.

For another example, to increase the degree of cold transfer transmitted from the storage chamber to the center of the ice making cell through the tray assembly, the second region may vary in degree of cold transfer toward the central direction. The degree of cold transfer of one portion of the second region may be greater than that of the other portion of the second region. A through-hole may be defined in one portion of the second region. At least a portion of the heat absorbing surface of the cooler may be disposed in the through-hole. A passage through which the cold air supplied from the cooler passes may be disposed in the through-hole. The one portion may be a portion that is not surrounded by the tray case. The other portion may be a portion surrounded by the tray case. One portion of the second region may be a portion defining the uppermost portion of the ice making cell in the second region. The second region may include a tray and a tray case locally surrounding the tray. As described above, when a portion of the tray assembly has a high cold transfer rate, the supercooling may occur in the tray assembly having a high cold transfer rate. As described above, designs may be needed to reduce the degree of the supercooling.

A refrigerator according to an aspect may include a storage chamber configured to store food, a cooler configured to supply cold to the storage chamber, a first tray configured to form a portion of an ice making cell that is a space in which water is phase-changed into ice by the cold, a second tray configured to form another portion of the ice making cell, a heater configured to be positioned adjacent to at least one of the first tray and the second tray, and a controller configured to control the heater.

The refrigerator may further include a first temperature sensor configured to sense a temperature in the storage compartment. The refrigerator may further include a second temperature sensor configured to sense the temperature of water or ice in the ice making cell.

The controller may control the heater to be turned on in at least some section while the cooler supplies cold so that bubbles dissolved in the water inside the ice making cell move from an ice-generating portion to liquid water to generate transparent ice.

The controller may control the heating amount of the heater to increase in a case in which the heat transfer amount between the cold for cooling the ice making cell and water of the ice making cell increases and the heating amount of the heater to decrease in a case in which the heat transfer amount between the cold for cooling the ice making cell and water of the ice making cell decreases, so that the ice making speed of the water inside the ice making cell is capable of being maintained within a predetermined range lower than the ice dbqmaking speed in a case in which ice making is performed while the heater is turned off.

The controller may control the degree of supercooling of water in the tray or ice making cell to be reduced in at least one or more of a first section (pre-water supply process) from the completion of a preparation step for water supply until the start of the water supply, a second section (water supply process) from the start of the water supply until the completion of the water supply, and a third section (ice making process) from the start of the ice making process before the ice making process is completed.

The controller may control the generation of freezing nucleus in the water in the ice making cell to be activated so that the degree of supercooling is reduced.

The controller may control precooling for supplying cold to the ice making cell to be performed in at least a portion of the first section. That is, at least a portion of the first section may be a precooling section. The controller may control the water to be supplied to the ice making cell when the precooling section is ended. After the water is supplied, the controller may control the cooler to be turned on or maintained in a turn-on state so that at least a portion of the water contacting the tray is frozen. The controller may controls the precooling section to be ended based on a time when precooling is started and a temperature sensed by the second temperature sensor in the precooling section. When the reference time elapses after the preparation step is completed, the controller may control the precooling section to be ended. When the temperature sensed by the second temperature sensor reaches a reference temperature after the preparation step is completed, the controller may control the precooling section to be ended. The controller may control the precooling section to be ended when the temperature sensed by the second temperature sensor decreases by a reference temperature after preparation step is completed. The completion of the preparation step may be defined as including at least one of the fact that the controller detects that the ice made is removed from the tray and the fact that the controller detects that the second tray is moved from the ice separation position to the water supply position. When it is determined that the degree of supercooling is higher than the allowable reference in the ice making process of the previous step, the controller may control the first section to include the precooling section.

The controller may control the water supply to be stopped in some of the second section. The controller may control the water to be supplied to the ice making cell when the stop of the water supply is ended. The controller may control the cooler to be turned on or maintained in a turn-on state so that at least a portion of water in the ice making cell is frozen in a section in which the water supply is stopped. The controller may control the stop of water supply to be ended based on a time when water supply is stopped and a temperature by the second temperature sensor changed by the stop of water supply. When the reference time elapses after the water supply is stopped, the controller may control the stop of the water supply to be ended. When the temperature sensed by the second temperature sensor reaches a reference temperature after the water supply is stopped, the controller may control the stop of water supply to be ended. When the temperature sensed by the second temperature sensor decreases by a reference temperature after the water supply is stopped, the controller may control the stop of the water supply to be ended. When the temperature change amount per unit time of the second temperature sensor reaches within a set range after the water supply is stopped, the controller may control the stop of the water supply to be ended. The set range may include 0. When at least a portion of the water in the tray is phase-changed after the water supply is stopped, the controller may control the stop of the water supply to be ended. The controller may control so that the amount of water supplied before the water supply is stopped is less than the amount of water supplied after the stop of the water supply is end. The controller may control the water supply to be stopped in at least a portion of the second section when it is determined that the degree of supercooling is higher than the allowable reference in the ice making process of the previous step.

The controller may control mechanical energy to be supplied to the ice making cell in a portion of the third section. The controller may control the mechanical energy to be supplied again when a predetermined condition is satisfied after the supply of the mechanical energy is ended. The controller may control the cooler to be turned on or to be maintained in the turn-on state so that at least a portion of the water of the tray is frozen in a section to which the mechanical energy is supplied. The controller may control the supply of the mechanical energy to be ended based on the time at which the mechanical energy is supplied and the temperature of the tray changed by the supply of the mechanical energy. When a reference time elapses after the mechanical energy is supplied, the controller may control the supply of the mechanical energy to be ended. When the temperature sensed by the second temperature sensor reaches a reference temperature after the mechanical energy is supplied, the controller may control the supply of the mechanical energy to be ended. The controller may control the supply of the mechanical energy to be ended when the temperature sensed by the second temperature sensor decreases by a reference temperature after the mechanical energy is supplied. When the temperature change amount per unit time of the tray reaches within a set range after the mechanical energy is supplied, the controller may control the supply of the mechanical energy to be ended. The set range may include 0. The controller may control the supply of the mechanical energy to be stopped when at least a portion of the water in the tray is phase-changed after the mechanical energy is supplied. The supplied mechanical energy may include at least one of kinetic energy and potential energy. The controller may control the tray or the ice making cell to move in a first direction to supply mechanical energy to the ice making cell. The controller may control the tray or the ice making cell to move in a second direction opposite to the first direction to supply mechanical energy to the ice making cell. When it is determined that the degree of supercooling is higher than the allowable reference during the ice making process in the previous step, or it is determined that the degree of supercooling is higher than the allowable reference of the third section, the controller may control at least one of mechanical energy to be supplied to the ice making cell in at least a portion of the third section.

The controller may control to supply electrical energy to the ice making cell in some of the third sections. After the supply of the electrical energy is ended, the controller may control the electrical energy to be supplied again when a predetermined condition is satisfied. The controller may control the cooler to be turned on or to be maintained in the turn-on state so that at least a portion of the water in the tray is frozen in a section in which the electrical energy is supplied. The controller may control the supply of the electrical energy to be ended based on a time when the electrical energy is supplied and a temperature of the tray changed by the supply of the electrical energy. When a reference time elapses after the electrical energy is supplied, the controller may control the supply of the electrical energy to be ended. When the temperature of the second temperature sensor reaches a reference temperature after the electrical energy is supplied, the controller may control the supply of the electrical energy to be ended. When the temperature sensed by the second temperature sensor decreases by a reference temperature after the electrical energy is supplied, the controller may control the supply of the electrical energy to be ended. When the temperature change amount per unit time of the tray reaches within a set range after the electrical energy is supplied, the controller may control the supply of the electrical energy to be ended. The set range may include 0. The controller may control the supply of the electrical energy to be stopped when at least a portion of the water in the tray is phase-changed after the electrical energy is supplied. The supplied electrical energy may include at least one of current and spark. When it is determined that the degree of supercooling is higher than the allowable reference during the ice making process in the previous step, or it is determined that the degree of supercooling is higher than the allowable reference during the third section, the controller may control electrical energy to be supplied to the ice making cell in at least a portion of the third section.

The trays may define a plurality of ice making cells, and a passage through which freezing nucleus passes may be formed between the plurality of ice making cells.

When it is determined that the degree of supercooling is higher than the allowable reference, the controller may control at least one of cold, water, mechanical energy, and electrical energy supplied to the ice making cell to be adjusted so that the degree of supercooling is reduced.

The controller may determine that the degree of supercooling is higher than an acceptable reference when the temperature of the water reaches a specific sub-zero temperature below zero before the water in the ice making cell starts to be phase-changed. The specific temperature may be −5 degrees or higher than −5 degrees. More preferably, the specific temperature may be −4 degrees or higher than −4 degrees. More preferably, the specific temperature may be −3 degrees or higher than −3 degrees. The controller may determine that the degree of supercooling is higher than the allowable reference when the time taken from the time when the water supply to the ice making cell is completed until the temperature sensed by the second temperature sensor reaches a specific sub-zero temperature is less than a reference value. When the temperature sensed by the second temperature sensor reaches a specific temperature within a set time from a time point when the water supply to the ice making cell is completed, the controller may determine that the degree of supercooling is higher than an allowable reference. After the start of the ice making process, the controller may determine that the degree of supercooling is higher than the allowable reference if the change amount in temperature sensed by the second temperature sensor per unit time is greater than a reference value. The fact that the degree of supercooling is higher than the allowable reference may be defined that supercooling has occurred or is likely to occur in the water in the ice making cell. The first section from the completion of the preparation step for water supply until the start of the water supply may include a precooling section in which cold is supplied to the ice making cell. The controller may control the supply of water to the ice making cell to be stopped in a portion of the second section from the start of the water supply until the completion of the water supply. The controller may control mechanical energy and electrical energy to be supplied to the ice making cell in a portion of a third section from the beginning of the ice making process until the completion of the ice making process.

Figure 2:
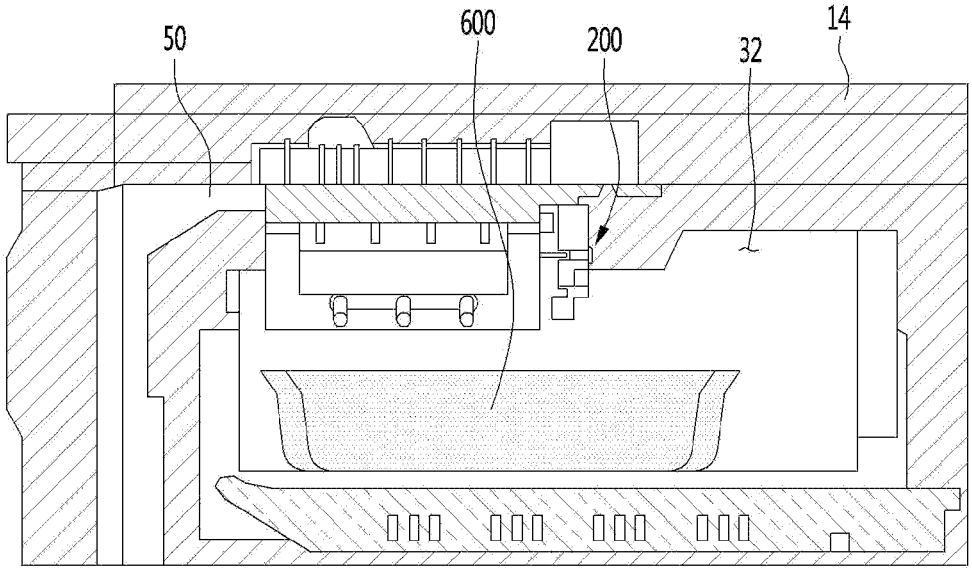
FIG. 2 is a side cross-sectional view illustrating a refrigerator in which an ice maker is installed.

FIG. 1 is a front view of a refrigerator according to an embodiment, and FIG. 2 is a side cross-sectional view illustrating a refrigerator in which an ice maker is installed.

As illustrated in FIG. 1, view (a), a refrigerator according to an embodiment of the present disclosure may include a plurality of doors 10, 20, and 30 for opening and closing a storage chamber for food. The doors 10, 20, and 30 may include doors 10 and 20 for opening and closing the storage chamber in a rotating manner and a door 30 for opening and closing the storage chamber in a sliding manner.

FIG. 1, view (b) is a cross-sectional view as viewed from the rear of the refrigerator. The refrigerator cabinet 14 may include a refrigerating compartment 18 and a freezing compartment 32. The refrigerating compartment 18 is disposed on the upper side, and the freezing compartment 32 is disposed on the lower side, so that each storage chamber can be opened and closed individually by each door. Unlike the present embodiment, this embodiment is also applicable to a refrigerator in which a freezing compartment is disposed on the upper side and a refrigerating compartment is disposed on the lower side.

In the freezing compartment 32, an upper space and a lower space may be separated from each other, and the lower space is provided with a drawer 40 capable of drawing in/out from the space. Although the freezing compartment 32 can be opened and closed by one door 30, the freezing compartment 32 may be provided to be separated into two spaces.

An ice maker 200 capable of manufacturing ice may be provided in the upper space of the freezing compartment 32.

An ice bin 600 in which ice produced by the ice maker 200 is fallen and stored may be provided under the ice maker 200. The user can take out the ice bin 600 and use the ice stored in the ice bin 600. The ice bin 600 may be mounted on an upper side of a horizontal wall separating the upper space and the lower space of the freezing compartment 32.

Referring to FIG. 2, the cabinet 14 is provided with a duct 50 for supplying cold air, which is an example of cold, to the ice maker 200. The duct 50 cools the ice maker 200 by discharging cold air supplied from an evaporator through which the refrigerant compressed by the compressor is evaporated. Ice may be generated in the ice maker 200 by the cold air supplied to the ice maker 200.

In FIG. 2, it is possible that the right side is the rear of the refrigerator and the left side is the front side of the refrigerator, that is, a part where a door is installed. At this time, the duct 50 may be disposed at the rear of the cabinet 14 to discharge cold air toward the front of the cabinet 14. The ice maker 200 is disposed in front of the duct 50.

The discharge port of the duct 50 is positioned on the ceiling of the freezing compartment 32, and it is possible to discharge cold air to the upper side of the ice maker 200.

Figure 3:
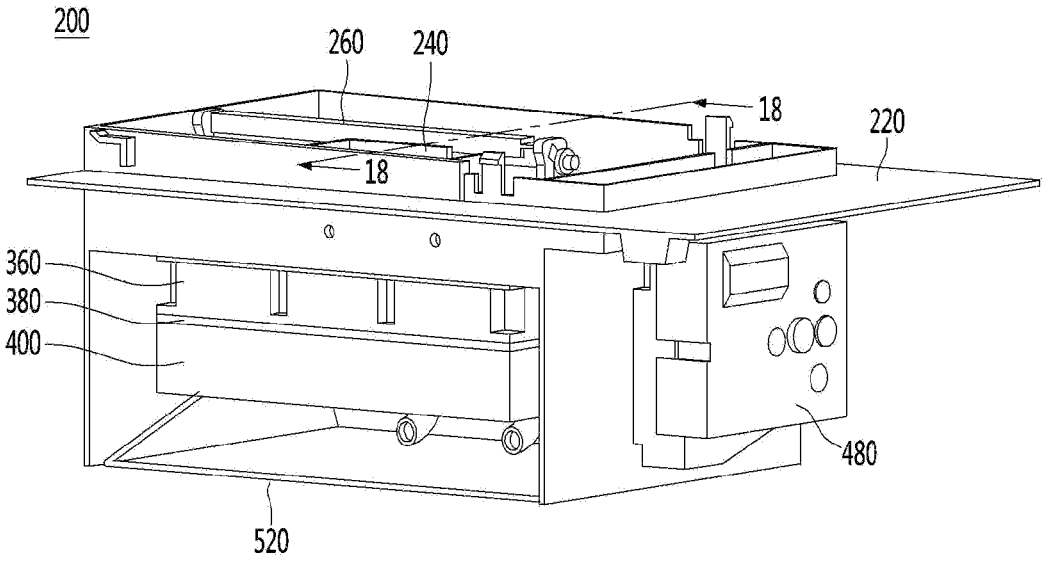
FIG. 3 is a perspective view of an ice maker according to an embodiment.
Figure 3:
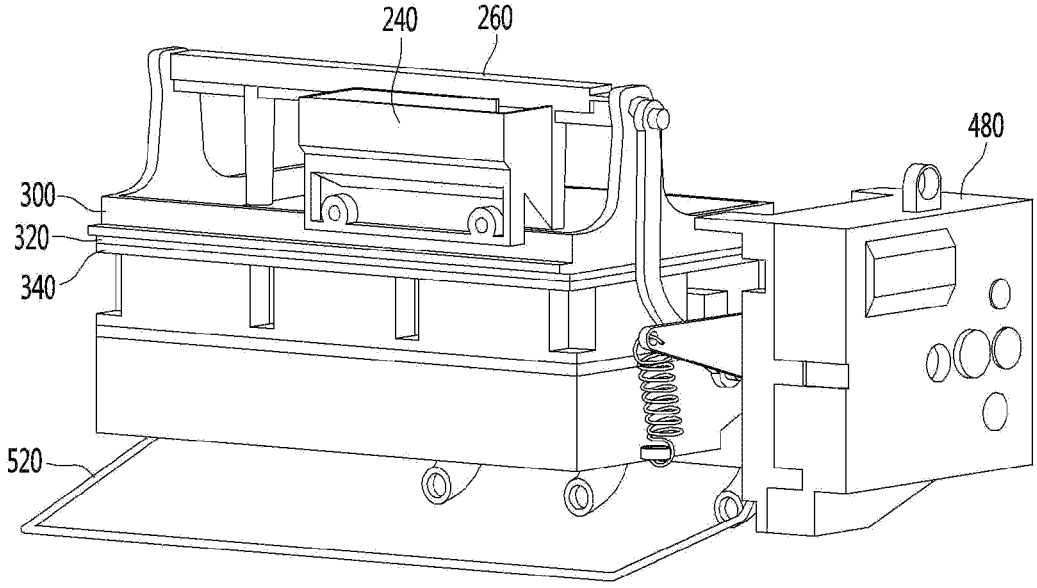
Figure 4:
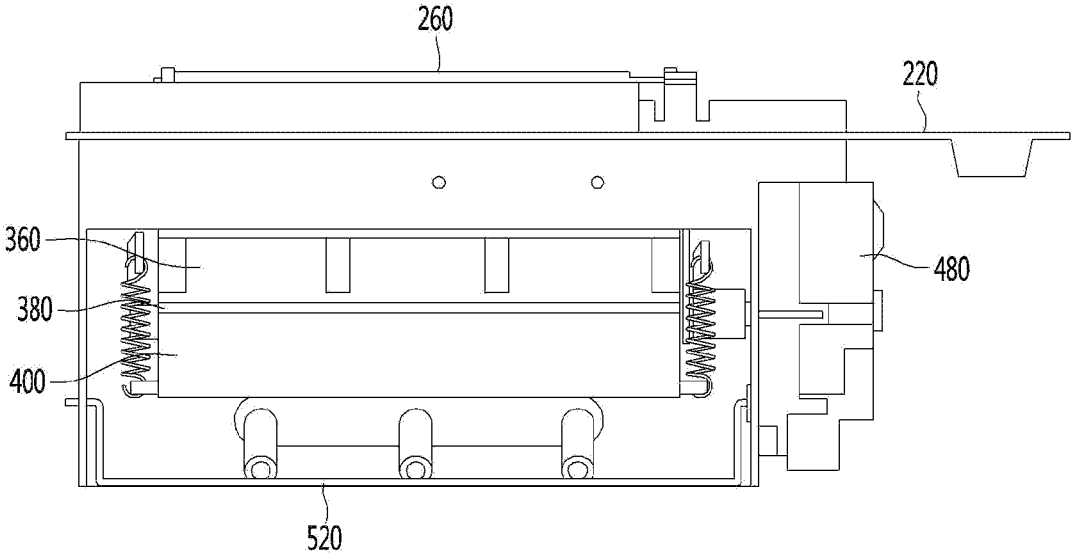
FIG. 4 is a front view illustrating an ice maker.
Figure 4:
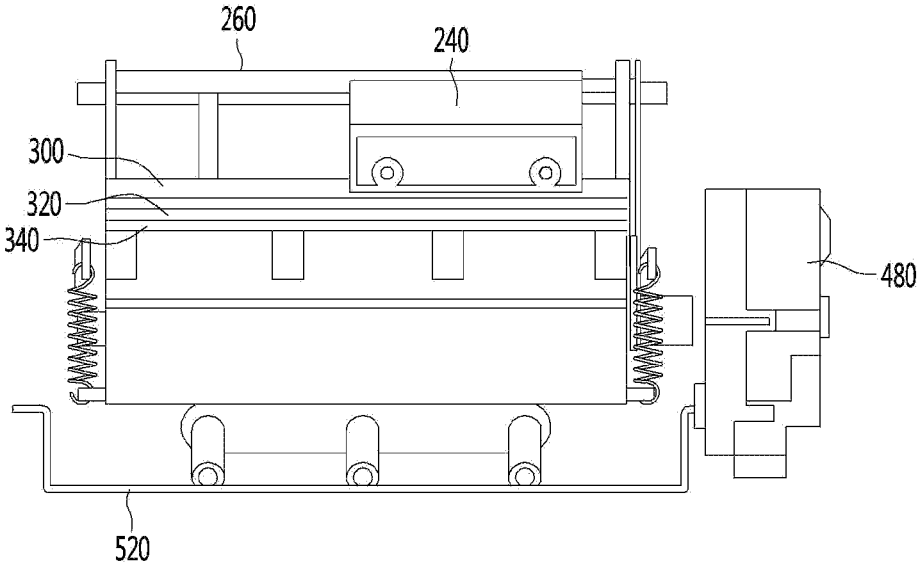
Figure 5:
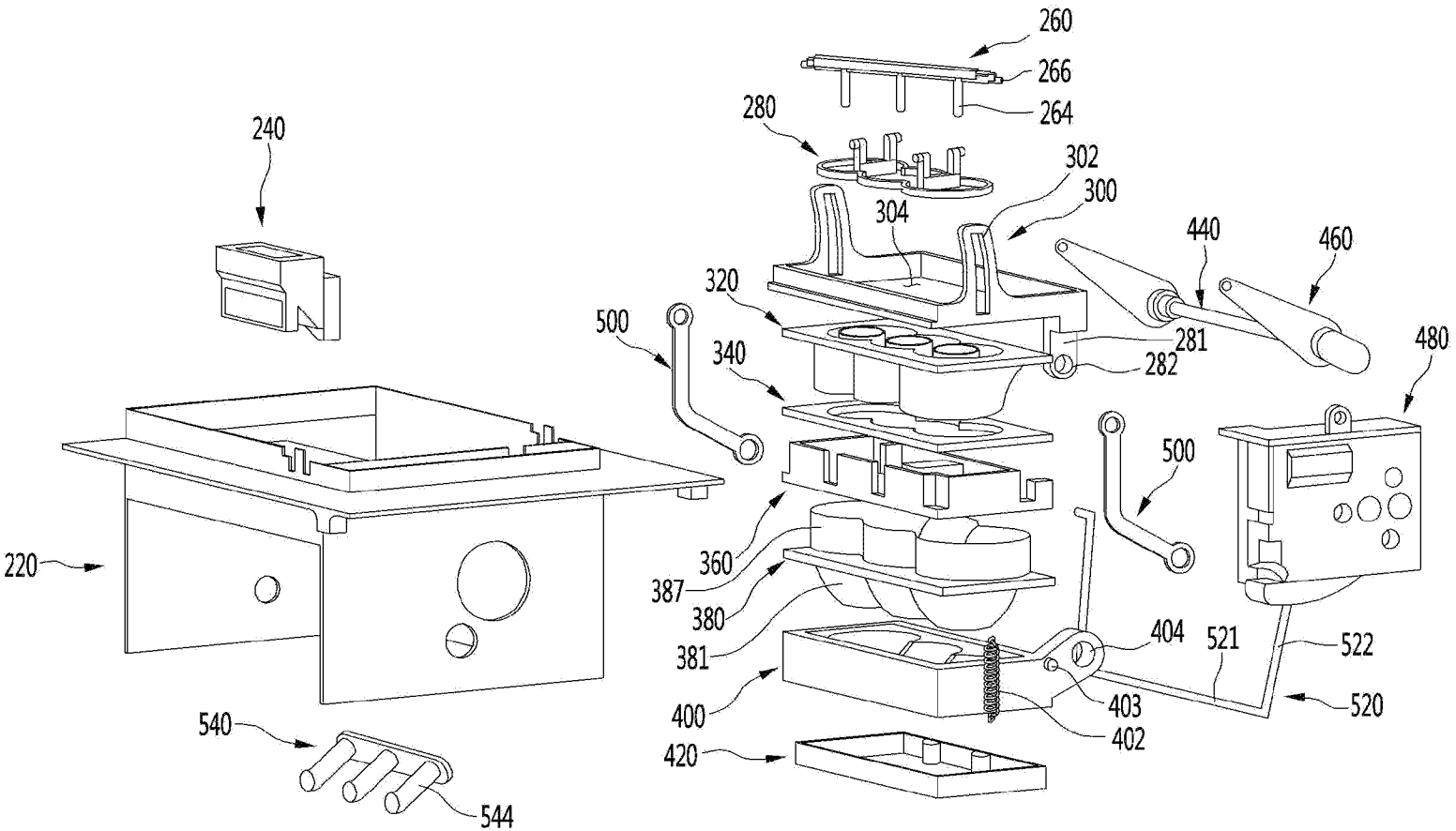
FIG. 5 is an exploded perspective view of an ice maker.

FIG. 3 is a perspective view of an ice maker according to an embodiment, FIG. 4 is a front view illustrating an ice maker, and FIG. 5 is an exploded perspective view of an ice maker.

FIGS. 3*a* and 4*a* are views including a bracket 220 for fixing the ice maker 200 to the freezing compartment 32, and FIGS. 3*b* and 4*b* are views illustrating a state in which the bracket 220 is removed. Each component of the ice maker 200 may be provided inside or outside the bracket 220, and thus, the ice maker 200 may constitute one assembly. Accordingly, the ice maker 200 may be installed on the ceiling of the freezing compartment 32.

A water supply part 240 is installed above the inner surface of the bracket 200. The water supply part 240 is provided with openings at the upper and lower sides, respectively, so that water supplied to the upper side of the water supply part 240 may be guided to the lower side of the water supply part 240. The upper opening of the water supply part 240 is larger than the lower opening thereof, and thus, a discharge range of water guided downward through the water supply part 240 may be limited.

A water supply pipe through which water is supplied is installed above the water supply part 240, so that water is supplied to the water supply part 240, and the supplied water may be moved downward. The water supply part 240 may prevent the water discharged from the water supply pipe from dropping from a high position, thereby preventing the water from splashing. Since the water supply part 240 is disposed below the water supply pipe, the water may be guided downward without splashing up to the water supply part 240, and an amount of splashing water may be reduced even if the water moves downward due to the lowered height.

Figure 18:
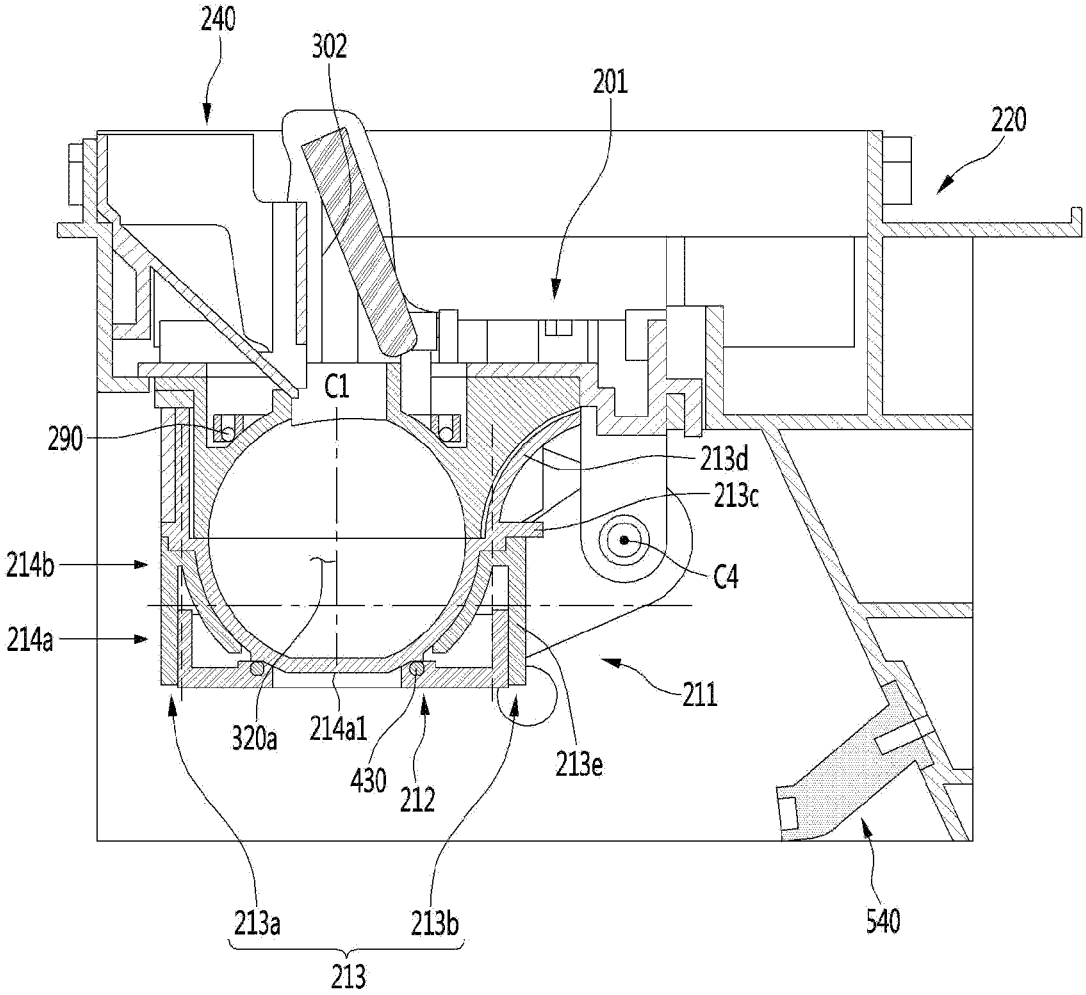
FIG. 18 is a cross-sectional view taken along line 18-18 of FIG. 3, view (a).

The ice maker 200 may include a tray forming an ice making cell 320*a* (see FIG. 18). The tray may include, for example, a first tray 320 forming a portion or a first portion of the ice making cell 320*a* and a second tray 380 forming another portion or a second portion of the ice making cell 320*a*.

The first tray 320 and the second tray 380 may define a plurality of ice making cells 320*a* in which a plurality of ice can be generated. A first cell provided in the first tray 320 and a second cell provided in the second tray 380 may form a complete ice making cell 320*a*.

The first tray 320 may have openings at upper and lower sides, respectively, so that water dropping from the upper side of the first tray 320 can be moved downward.

A first tray supporter 340 may be disposed under the first tray 320. The first tray supporter 340 has an opening formed to correspond to each cell shape of the first tray 320 and thus may be coupled to the lower surface of the first tray 320.

A first tray cover 300 may be coupled to an upper side of the first tray 320. The outer appearance of the upper side of the first tray 320 may be maintained. A first heater case 280 may be coupled to the first tray cover 300. Alternatively, the first heater case 380 may be integrally formed with the first tray cover 300.

The first heater case 280 is provided with a first heater (an ice separation heater) to supply heat to the upper portion of the ice maker 200. The first heater may be embedded in the heater case 280 or installed on one surface thereof.

The first tray cover 300 may be provided with a guide slot 302 inclined at an upper side and vertically extending at a lower side. The guide slot 302 may be provided inside a member extending upward of the tray case 300.

The guide protrusion 262 of the first pusher 260 is inserted into the guide slot 302, so that the guide protrusion 262 may be guided along the guide slot 302. The first pusher 260 is provided with an extension part 264 extending equal to the number of cells of each of the first tray 320, so that ice positioned in each cell may be pushed out.

The guide protrusion 262 of the first pusher 260 is coupled to the pusher link 500. At this time, the guide protrusion 262 is rotatably coupled to the pusher link 500 so that when the pusher link 500 moves, the first pusher 260 may also move along the guide slot 302.

A second tray cover 360 is provided on the upper side of the second tray 380 so that the outer appearance of the second tray 380 can be maintained. The second tray 380 has a shape protruding upward so that a plurality of cells constituting a space in which individual ice can be generated are separated, and the second tray cover 360 can surround a cell protruding upward.

A second tray supporter 400 is provided below the second tray 380 to maintain a cell shape protruding downward from the second tray 380. A spring 402 is provided on one side of the second tray supporter 400.

A second heater case 420 is provided under the second tray supporter 400. A second heater (transparent ice heater) is provided in the second heater case 420 to supply heat to the lower portion of the ice maker 200.

The ice maker 200 is provided with a driver 480 that provides rotational force.

A through-hole 282 is formed in an extension part extending downward on one side of the first tray cover 300. A through-hole 404 is formed in an extension part extending to one side of the second tray supporter 400. A shaft 440 penetrating the through-hole 282 and the through-hole 404 together is provided, and rotation arms 460 are provided at both ends of the shaft 440, respectively. The shaft 440 may be rotated by receiving a rotational force from the driver 480.

One end of the rotation arm 460 is connected to one end of the spring 402 so that when the spring 402 is tensioned, the position of the rotation arm 460 may be moved to an initial value by a restoring force.

A motor and a plurality of gears may be coupled to each other in the driver 480.

A full ice detection lever 520 is connected to the driver 480, so that the full ice detection lever 520 may be rotated by a rotational force provided by the driver 480.

The full ice detection lever 520 may have a '□' shape as a whole, and may include a portion extending vertically at both ends and a portion disposed horizontally connecting two portions extending vertically to each other. One of the two vertically extending portions is coupled to the driver 480 and the other is coupled to the bracket 220, so that the full ice detection lever 520 can detect the ice stored in the ice bin 600 while being rotated.

A second pusher 540 is provided on an inner lower surface of the bracket 220. The second pusher 540 is provided with a coupling piece 542 coupled to the bracket 220 and a plurality of extension parts 544 installed on the coupling piece 542. The plurality of extension parts 544 are provided to be equal to the number of the plurality of cells provided in the second tray 380, so that the extension part performs the function of pushing so that the ice generated in the cells of the second tray 380 can be separated from the second tray 380.

The first tray cover 300 and the second tray supporter 400 may be rotatably coupled to each other with respect to the shaft 440 and may be disposed so that an angle thereof is changed around the shaft 440.

Each of the first tray 320 and the second tray 380 is made of a material that is easily deformable, such as silicon, so that when pressed by each pusher, it is instantly deformed so that the generated ice can be easily separated from the tray.

FIGS. 6 to 11 are views illustrating a state in which some components of the ice maker are combined.

Figure 6:
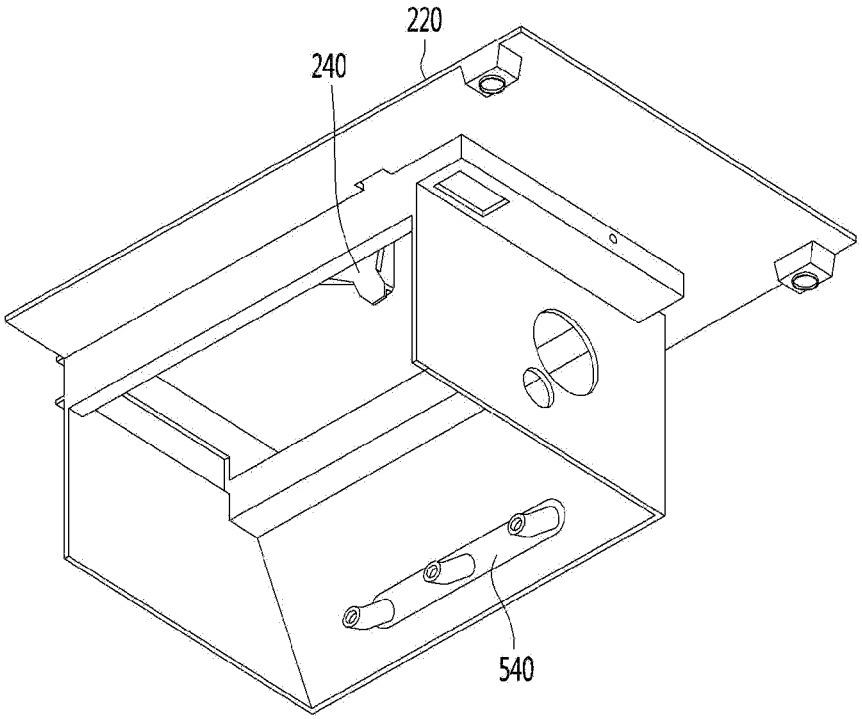
FIGS. 6 to 11 are views illustrating a state in which some components of the ice maker are combined.

FIG. 6 is a view for explaining a state in which the bracket 220, the water supply part 240, and the second pusher 540 are coupled. The second pusher 540 is installed on the inner surface of the bracket 220, and the extension part of the second pusher 540 is disposed so that the direction extending from the coupling piece 542 is not vertical but inclined downward.

Figure 7:
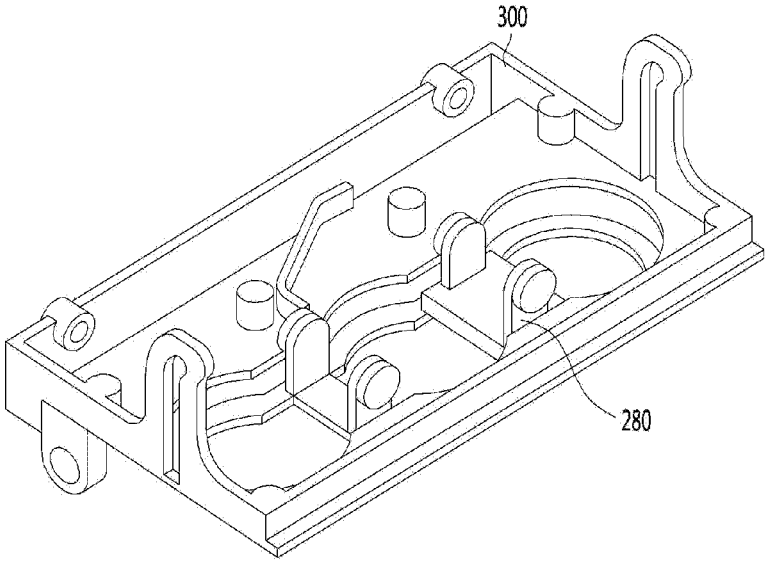

FIG. 7 is a view illustrating a state in which the first heater case 280 and the first tray cover 300 are coupled.

The first heater case 280 may be disposed such that a horizontal surface is spaced downward from the lower surface of the first tray cover 300. The first heater case 280 and the first tray cover 300 have an opening corresponding to each cell of the first tray 320 so that water can pass therethrough, and the shape of each opening can form a shape corresponding to each cell.

The first tray 320 is disposed between the first tray supporter 340 and the first tray cover 300.

The first tray cover 300, the first tray 320, and the first tray supporter 340 are combined as a single module, so that the first tray cover 300, the first tray 320, and the first tray supporter 340 may be disposed on the shaft 440 so as to be rotatable together with one member.

The first tray cover 300, the first tray 320, and the tray cover 340 are combined as a single module, so that the first tray cover 300, the first tray 320, and the tray cover 340 may be disposed on the shaft 440 so as to be rotatable together with one member.

Figure 9:
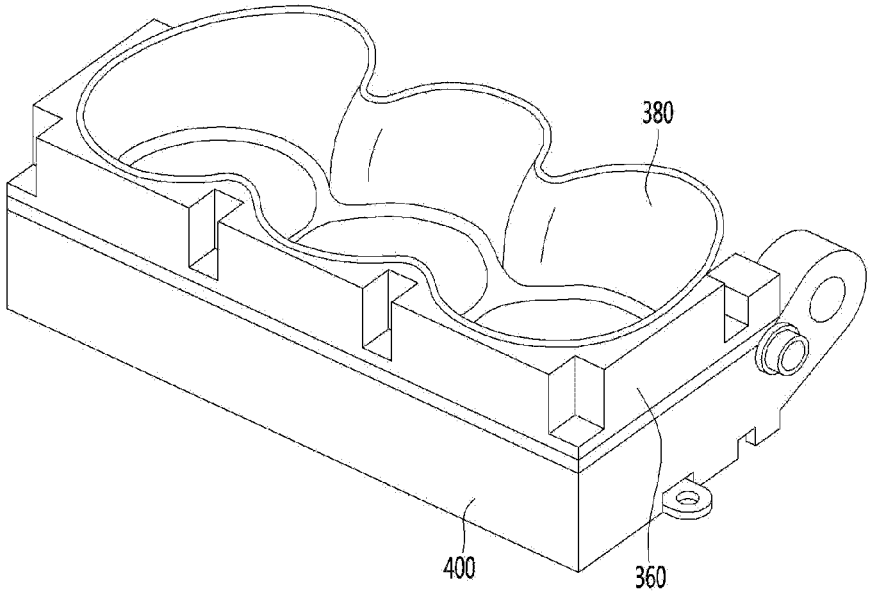

FIG. 9 is a view illustrating a state in which the second tray 380, the second tray cover 360, and the second tray supporter 400 are coupled.

With the second tray 380 interposed therebetween, the second tray cover 360 is disposed on the upper side of the second tray, and the second tray supporter 400 is disposed on the lower side of the second tray.

Each cell of the second tray 380 has a hemispherical shape to form a lower portion of the spherical ice.

Figure 10:
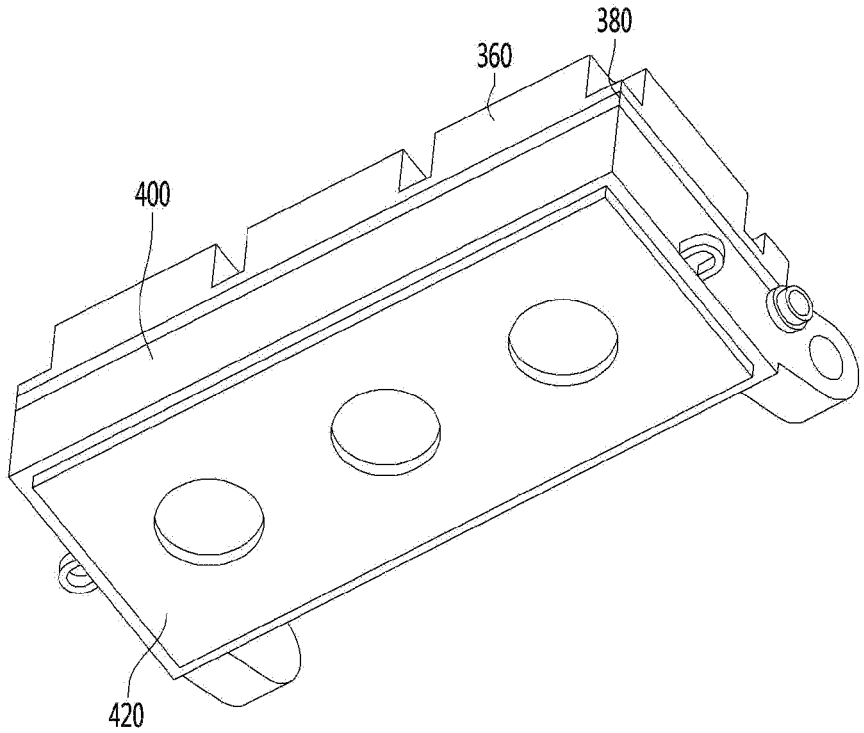

FIG. 10 is a view illustrating a state in which the second tray cover 360, the second tray 380, the second tray supporter 400, and the second heater case 420 are coupled.

The second heater case 420 may be disposed on a lower surface of the second tray case to fix a heater that supplies heat to the second tray 380.

Figure 8:
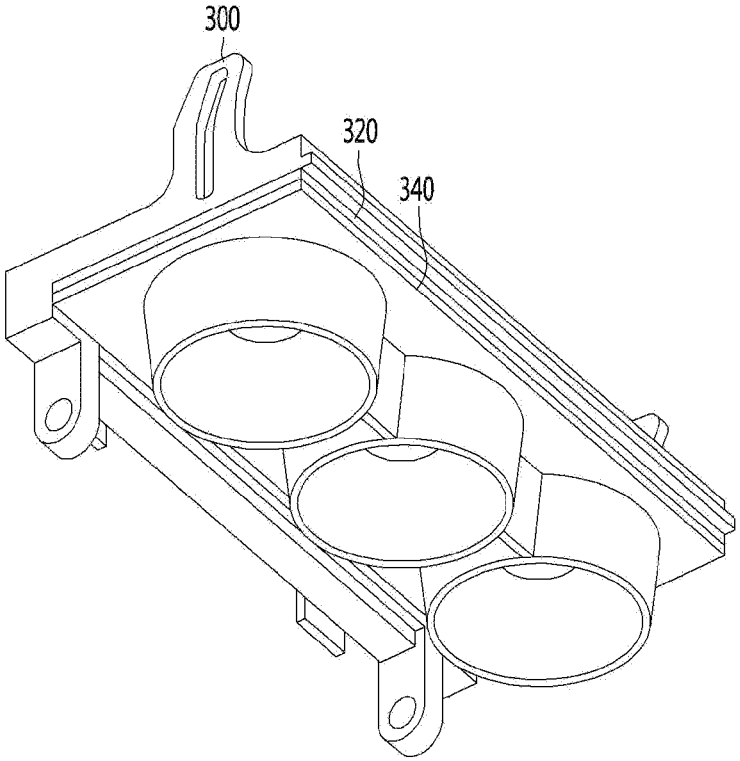
Figure 11:
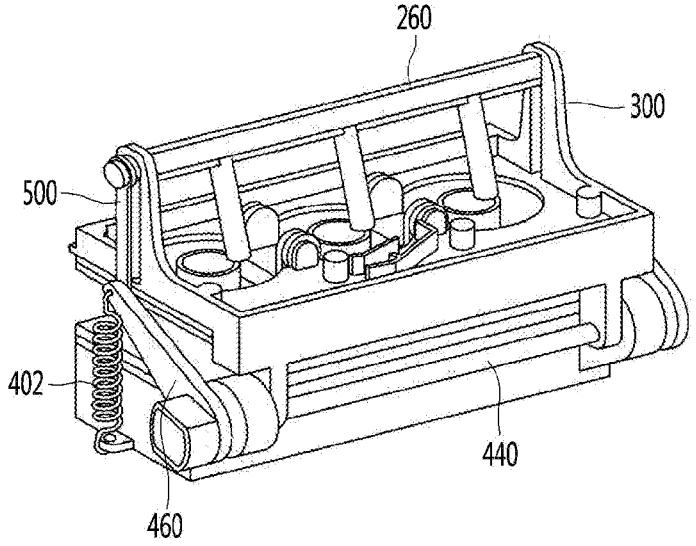

FIG. 11 is a view illustrating a state in which FIGS. 8 and 10 are combined, and the rotary arm 460, the shaft 440, and the pusher link 500 are combined.

One end of the rotation arm 460 is coupled to the shaft 440 and the other end thereof is coupled to the spring 402. One end of the pusher link 500 is coupled to the first pusher 260 and the other end thereof is disposed to be rotated with respect to the shaft 440.

Figure 12:
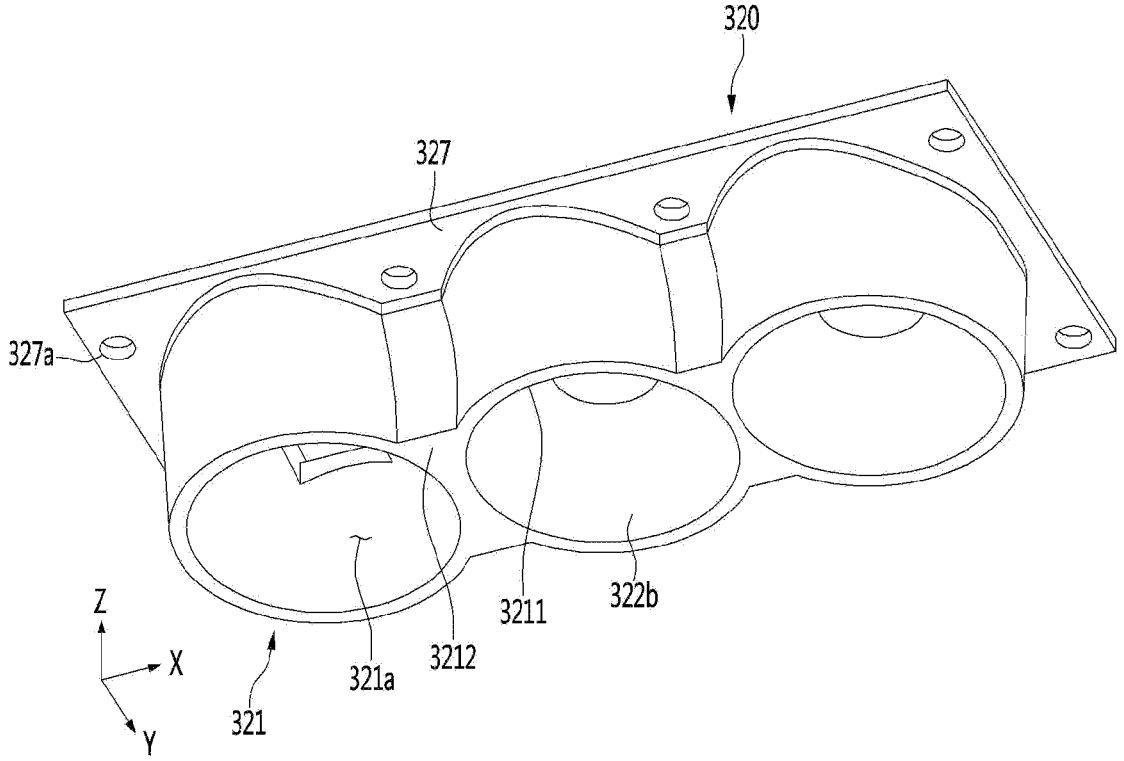
FIG. 12 is a perspective view of a first tray viewed from below according to an embodiment of the present disclosure.
Figure 13:
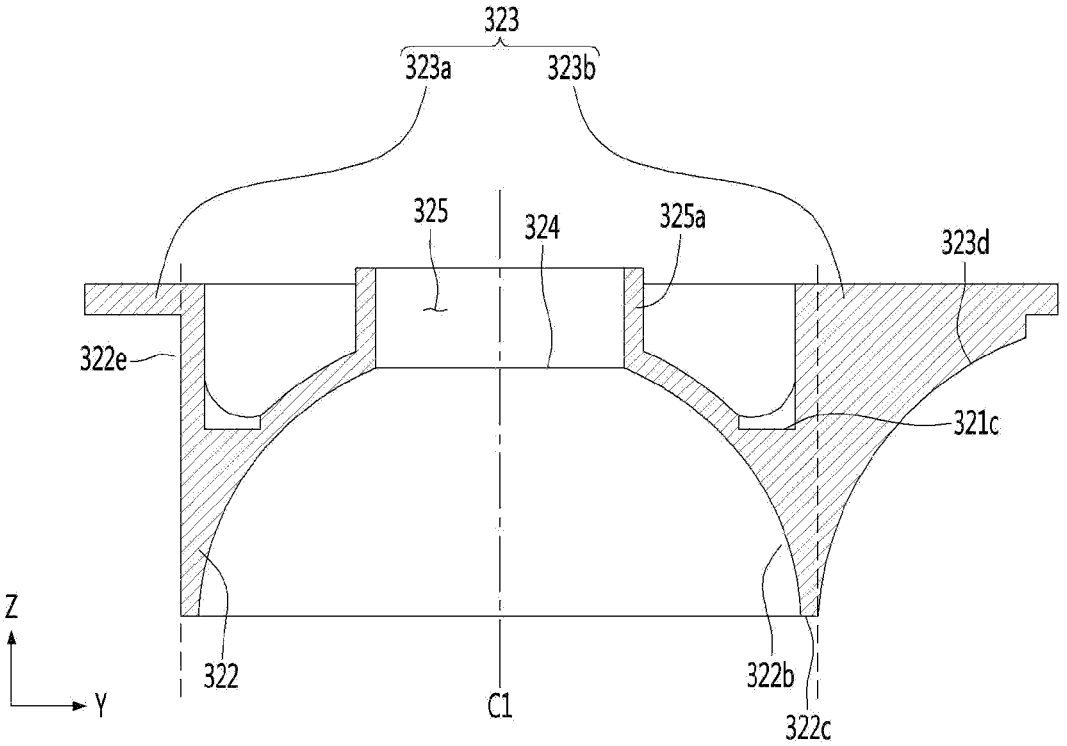
FIG. 13 is a cross-sectional view of a first tray according to an embodiment of the present disclosure.

FIG. 12 is a perspective view of a first tray viewed from below according to an embodiment of the present disclosure, and FIG. 13 is a cross-sectional view of a first tray according to an embodiment of the present disclosure.

Referring to FIGS. 12 and 13, the first tray 320 may define a first cell 321*a* that is a portion of the ice making cell 320*a*.

The first tray 320 may include a first tray wall 321 defining a portion of the ice making cell 320*a*.

For example, the first tray 320 may define a plurality of first cells 321*a*. For example, the plurality of first cells 321*a* may be arranged in a line. The plurality of first cells 321*a* may be arranged in an X-axis direction in FIG. 9. For example, the first tray wall 321 may define the plurality of first cells 321*a*.

The first tray wall 321 may include a plurality of first cell walls 3211 that respectively define the plurality of first cells 321*a*, and a connection wall 3212 connecting the plurality of first cell walls 3211 to each other. The first tray wall 321 may be a wall extending in the vertical direction.

The first tray 320 may include an opening 324. The opening 324 may communicate with the first cell 321*a*. The opening 324 may allow the cold air to be supplied to the first cell 321*a*. The opening 324 may allow water for making ice to be supplied to the first cell 321*a*. The opening 324 may provide a passage through which a portion of the first pusher 260 passes. For example, in the ice separation process, a portion of the first pusher 260 may be inserted into the ice making cell 320*a* through the opening 234.

The first tray 320 may include a plurality of openings 324 corresponding to the plurality of first cells 321*a*. One of the plurality of openings 324 324*a* may provide a passage of the cold air, a passage of the water, and a passage of the first pusher 260. In the ice making process, the bubbles may escape through the opening 324.

The first tray 320 may further include an auxiliary storage chamber 325 communicating with the ice making cell 320*a*. For example, the auxiliary storage chamber 325 may store water overflowed from the ice making cell 320*a*. The ice expanded in a process of phase-changing the supplied water may be disposed in the auxiliary storage chamber 325. That is, the expanded ice may pass through the opening 304 and be disposed in the auxiliary storage chamber 325. The auxiliary storage chamber 325 may be defined by a storage chamber wall 325*a*. The storage chamber wall 325*a* may extend upwardly around the opening 324. The storage chamber wall 325*a* may have a cylindrical shape or a polygonal shape. Substantially, the first pusher 260 may pass through the opening 324 after passing through the storage chamber wall 325*a*. The storage chamber wall 325*a* may define the auxiliary storage chamber 325 and also reduce deformation of the periphery of the opening 324 in the process in which the first pusher 260 passes through the opening 324 during the ice separation process.

The first tray 320 may include a first contact surface 322*c* contacting the second tray 380.

The first tray 320 may further include a first extension wall 327 extending in the horizontal direction from the first tray wall 321. For example, the first extension wall 327 may extend in the horizontal direction around an upper end of the first extension wall 327. One or more first coupling holes 327*a* may be provided in the first extension wall 327. Although not limited, the plurality of first coupling holes 327*a* may be arranged in one or more axes of the X axis and the Y axis.

In this specification, the "central line" is a line passing through a volume center of the ice making cell 320*a* or a center of gravity of water or ice in the ice making cell 320*a* regardless of the axial direction.

Meanwhile, referring to FIG. 13, the first tray 320 may include a first portion 322 that defines a portion of the ice making cell 320*a*. For example, the first portion 322 may be a portion of the first tray wall 321.

The first portion 322 may include a first cell surface 322*b* (or an outer circumferential surface) defining the first cell 321*a*. The first portion 322 may include the opening 324. In addition, the first portion 322 may include a heater accommodation part 321*c*. An ice separation heater may be accommodated in the heater accommodation part 321*c*. The first portion 322 may be divided into a first region positioned close to the second heater 430 in a Z-axis direction and a second region positioned away from the second heater 430. The first region may include the first contact surface 322*c*, and the second region may include the opening 324. The first portion 322 may be defined as an area between two dotted lines in FIG. 13.

In a degree of deformation resistance from the center of the ice making cell 320*a* in the circumferential direction, at least a portion of the upper portion of the first portion 322 is greater than at least a portion of the lower portion. The degree of deformation resistance of at least a portion of the upper portion of the first portion 322 is greater than that of the lowermost end of the first portion 322.

The upper and lower portions of the first portion 322 may be divided based on the extension direction of the central line C1 (or a vertical center line) in the Z axis direction in the ice making cell 320*a*. The lowermost end of the first portion 322 is the first contact surface 322*c* contacting the second tray 380.

The first tray 320 may further include a second portion 323 extending from a predetermined point of the first portion 322. The predetermined point of the first portion 322 may be one end of the first portion 322. Alternatively, the predetermined point of the first portion 322 may be one point of the first contact surface 322*c*. A portion of the second portion 323 may be defined by the first tray wall 321, and the other portion of the second portion 323 may be defined by the first extension wall 327. At least a portion of the second portion 323 may extend in a direction away from the second heater 430. At least a portion of the second portion 323 may extend upward from the first contact surface 322*c*. At least a portion of the second portion 323 may extend in a direction away from the central line C1. For example, the second portion 323 may extend in both directions along the Y axis from the central line C1. The second portion 323 may be disposed at a position higher than or equal to the uppermost end of the ice making cell 320*a*. The uppermost end of the ice making cell 320*a* is a portion at which the opening 324 is defined.

The second portion 323 may include a first extension part 323*a* and a second extension part 323*b*, which extend in different directions with respect to the central line C1. The first tray wall 321 may include one portion of the second extension part 323*b* of each of the first portion 322 and the second portion 323. The first extension wall 327 may include the other portion of each of the first extension part 323*a* and the second extension part 323*b*.

Referring to FIG. 13, the first extension part 323*a* may be disposed at the left side with respect to the central line C1, and the second extension part 323*b* may be disposed at the right side with respect to the central line C1.

The first extension part 323*a* and the second extension part 323*b* may have different shapes based on the central line C1. The first extension part 323*a* and the second extension part 323*b* may be provided in an asymmetrical shape with respect to the central line C1.

A length of the second extension part 323*b* in the Y-axis direction may be greater than that of the first extension part 323*a*. Therefore, while the ice is made and grown from the upper side in the ice making process, the degree of deformation resistance of the second extension part 323*b* may increase.

The second extension part 323*b* may be disposed closer to the shaft 440 that provides a center of rotation of the second tray than the first extension part 323*a*. In this embodiment, since the length of the second extension part 323*b* in the Y-axis direction is greater than that of the first extension part 323*a*, the second tray 380 contacting the first tray 320 may increase in radius of rotation. When the rotation radius of the second tray assembly increases, centrifugal force of the second tray may increase. Thus, in the ice separation process, separating force for separating the ice from the second tray may increase to improve ice separation performance.

The thickness of the first tray wall 321 is minimized at a side of the first contact surface 322*c*. At least a portion of the first tray wall 321 may increase in thickness from the first contact surface 322*c* toward the upper side. Since the thickness of the first tray wall 321 increases upward, a portion of the first portion 322 formed by the first tray wall 321 serves as a deformation resistance reinforcement part (or a first deformation resistance reinforcement part). In addition, the second portion 323 extending outward from the first portion 322 also serves as a deformation resistance reinforcement part (or a second deformation resistance reinforcement part).

The deformation resistance reinforcement parts may be directly or indirectly supported by the bracket 220. The deformation resistance reinforcement part may be connected to the first tray case and supported by the bracket 220 as an example. In this case, a portion of the first tray case in contact with the inner deformation reinforcement portion of the first tray 320 may also serve as an inner deformation reinforcement portion. Such a deformation resistance reinforcement part may cause ice to be generated from the first cell 321*a* formed by the first tray 320 in a direction of the second cell 381*a* formed by the second tray 380 during the ice making process.

Figure 14:
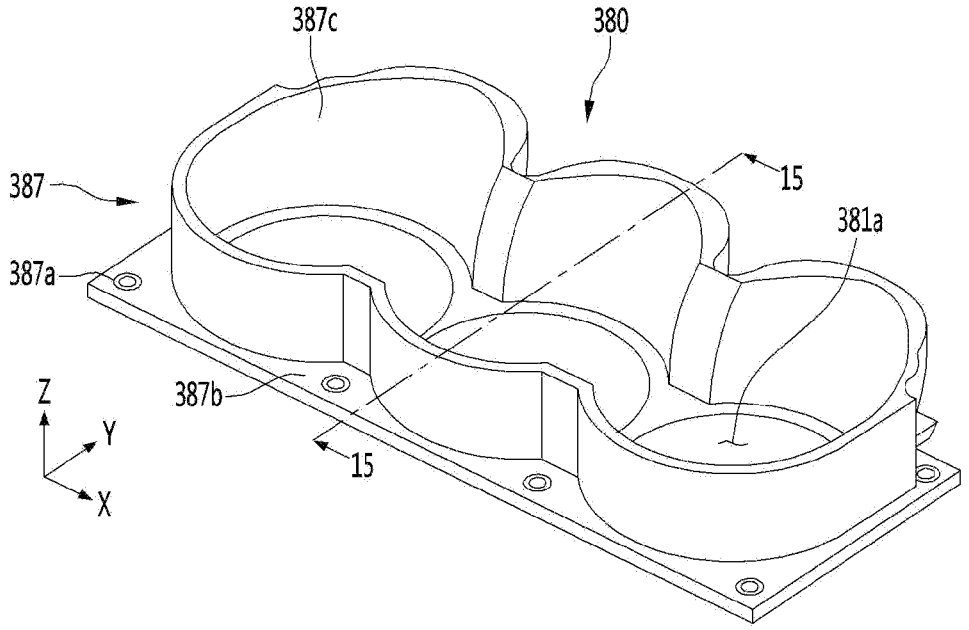
FIG. 14 is a perspective view of a second tray viewed from above according to an embodiment of the present disclosure.
Figure 15:
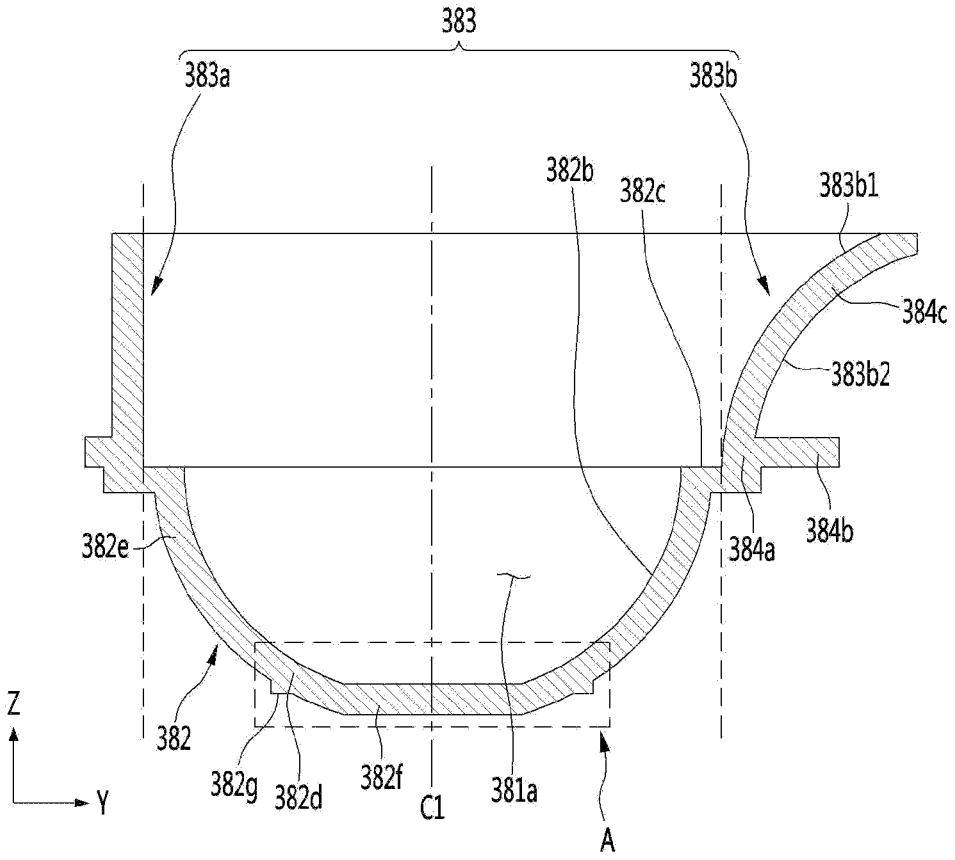
FIG. 15 is a cross-sectional view taken along line 15-15 of FIG. 14.

FIG. 14 is a perspective view of a second tray viewed from above according to an embodiment of the present disclosure, and FIG. 15 is a cross-sectional view taken along line 15-15 of FIG. 14.

Referring to FIGS. 14 and 1, the second tray 380 may define a second cell 381*a* which is another portion of the ice making cell 320*a*.

The second tray 380 may include a second tray wall 381 defining a portion of the ice making cell 320*a*.

For example, the second tray 380 may define a plurality of second cells 381*a*. For example, the plurality of second cells 381*a* may be arranged in a line. Referring to FIG. 14, the plurality of second cells 381*a* may be arranged in the X-axis direction. For example, the second tray wall 381 may define the plurality of second cells 381*a*.

The second tray 380 may include a circumferential wall 387 extending along a circumference of an upper end of the second tray wall 381. The circumferential wall 387 may be formed integrally with the second tray wall 381 and may extend from an upper end of the second tray wall 381. For another example, the circumferential wall 387 may be provided separately from the second tray wall 381 and disposed around the upper end of the second tray wall 381. In this case, the circumferential wall 387 may contact the second tray wall 381 or be spaced apart from the third tray wall 381. In any case, the circumferential wall 387 may surround at least a portion of the first tray 320. If the second tray 380 includes the circumferential wall 387, the second tray 380 may surround the first tray 320. When the second tray 380 and the circumferential wall 387 are provided separately from each other, the circumferential wall 387 may be integrally formed with the second tray case or may be coupled to the second tray case. For example, one second tray wall may define a plurality of second cells 381*a*, and one continuous circumferential wall 387 may surround the first tray 250.

The circumferential wall 387 may include a first extension wall 387*b* extending in the horizontal direction and a second extension wall 387*c* extending in the vertical direction. The first extension wall 387*b* may be provided with one or more second coupling holes 387*a* to be coupled to the second tray case. The plurality of second coupling holes 387*a* may be arranged in at least one axis of the X axis or the Y axis.

The second tray 380 may include a second contact surface 382*c* contacting the first contact surface 322*c* of the first tray 320. The first contact surface 322*c* and the second contact surface 382*c* may be horizontal planes. Each of the first contact surface 322*c* and the second contact surface 382*c* may be provided in a ring shape. When the ice making cell 320*a* has a spherical shape, each of the first contact surface 322*c* and the second contact surface 382*c* may have a circular ring shape.

The second tray 380 may include a first portion 382 that defines at least a portion of the ice making cell 320*a*. For example, the first portion 382 may be a portion or the whole of the second tray wall 381.

In this specification, the first portion 322 of the first tray 320 may be referred to as a third portion so as to be distinguished from the first portion 382 of the second tray 380. Also, the second portion 323 of the first tray 320 may be referred to as a fourth portion so as to be distinguished from the second portion 383 of the second tray 380.

The first portion 382 may include a second cell surface 382*b* (or an outer circumferential surface) defining the second cell 381*a* of the ice making cell 320*a*. The first portion 382 may be defined as an area between two dotted lines in FIG. 8. The uppermost end of the first portion 382 is the second contact surface 382*c* contacting the first tray 320.

The second tray 380 may further include a second portion 383. The second portion 383 may reduce transfer of heat, which is transferred from the second heater 430 to the second tray 380, to the ice making cell 320*a* defined by the first tray 320. That is, the second portion 383 serves to allow the heat conduction path to move in a direction away from the first cell 321*a*. The second portion 383 may be a portion or the whole of the circumferential wall 387. The second portion 383 may extend from a predetermined point of the first portion 382. In the following description, for example, the second portion 383 is connected to the first portion 382.

The predetermined point of the first portion 382 may be one end of the first portion 382. Alternatively, the predetermined point of the first portion 382 may be one point of the second contact surface 382*c*. The second portion 383 may include the other end that does not contact one end contacting the predetermined point of the first portion 382. The other end of the second portion 383 may be disposed farther from the first cell 321*a* than one end of the second portion 383.

At least a portion of the second portion 383 may extend in a direction away from the first cell 321*a*. At least a portion of the second portion 383 may extend in a direction away from the second cell 381*a*. At least a portion of the second portion 383 may extend upward from the second contact surface 382*c*. At least a portion of the second portion 383 may extend horizontally in a direction away from the central line C1. A center of curvature of at least a portion of the second portion 383 may coincide with a center of rotation of the shaft 440 which is connected to the driver 480 to rotate.

The second portion 383 may include a first part 384*a* extending from one point of the first portion 382. The second portion 383 may further include a second part 384*b* extending in the same direction as the extending direction with the first part 384*a*. Alternatively, the second portion 383 may further include a third part 384*b* extending in a direction different from the extending direction of the first part 384*a*. Alternatively, the second portion 383 may further include a second part 384*b* and a third part 384*c* branched from the first part 384*a*.

For example, the first part 384*a* may extend in the horizontal direction from the first part 382. A portion of the first part 384*a* may be disposed at a position higher than that of the second contact surface 382*c*. That is, the first part 384*a* may include a horizontally extension part and a vertically extension part. The first part 384*a* may further include a portion extending in the vertical direction from the predetermined point. For example, a length of the third part 384*c* may be greater than that of the second part 384*b*.

The extension direction of at least a portion of the first part 384*a* may be the same as that of the second part 384*b*. The extension directions of the second part 384*b* and the third part 384*c* may be different from each other. The extension direction of the third part 384*c* may be different from that of the first part 384*a*. The third part 384*a* may have a constant curvature based on the Y-Z cutting surface. That is, the same curvature radius of the third part 384*a* may be constant in the longitudinal direction. The curvature of the second part 384*b* may be zero. When the second part 384*b* is not a straight line, the curvature of the second part 384*b* may be less than that of the third part 384*a*. The curvature radius of the second part 384*b* may be greater than that of the third part 384*a*.

At least a portion of the second portion 383 may be disposed at a position higher than or equal to that of the uppermost end of the ice making cell 320*a*. In this case, since the heat conduction path defined by the second portion 383 is long, the heat transfer to the ice making cell 320*a* may be reduced. A length of the second portion 383 may be greater than the radius of the ice making cell 320*a*. The second portion 383 may extend up to a point higher than the center of rotation of the shaft 440. For example, the second portion 383 may extend up to a point higher than the uppermost end of the shaft 440.

The second portion 383 may include a first extension part 383*a* extending from a first point of the first portion 382 and a second extension part 383*b* extending from a second point of the first portion 382 so that transfer of the heat of the second heater 430 to the ice making cell 320*a* defined by the first tray 320 is reduced. For example, the first extension part 383*a* and the second extension part 383*b* may extend in different directions with respect to the central line C1.

Referring to FIG. 15, the first extension part 383*a* may be disposed at the left side with respect to the central line C1, and the second extension part 383*b* may be disposed at the right side with respect to the central line C1. The first extension part 383*a* and the second extension part 383*b* may have different shapes based on the central line C1. The first extension part 383*a* and the second extension part 383*b* may be provided in an asymmetrical shape with respect to the central line C1. A length (horizontal length) of the second extension part 383*b* in the Y-axis direction may be longer than the length (horizontal length) of the first extension part 383*a*. The second extension part 383*b* may be disposed closer to the shaft 440 that provides a center of rotation of the second tray assembly than the first extension part 383*a*.

In this embodiment, a length of the second extension part 383*b* in the Y-axis direction may be greater than that of the first extension part 383*a*. In this case, the heat conduction path may increase while reducing the width of the bracket 220 relative to the space in which the ice maker 200 is installed.

Since the length of the second extension part 383*b* in the Y-axis direction is greater than that of the first extension part 383*a*, the second tray assembly including the second tray 380 contacting the first tray 320 may increase in radius of rotation. When the rotation radius of the second tray assembly increases centrifugal force of the second tray assembly may increase. Thus, in the ice separation process, separating force for separating the ice from the second tray assembly may increase to improve ice separation performance. The center of curvature of at least a portion of the second extension part 383*b* may be a center of curvature of the shaft 440 which is connected to the driver 480 to rotate.

A distance between an upper portion of the first extension part 383*a* and an upper portion of the second extension part 383*b* may be greater than that between a lower portion of the first extension part 383*a* and a lower portion of the second extension part 383*b* with respect to the Y-Z cutting surface passing through the central line C1. For example, a distance between the first extension part 383*a* and the second extension part 383*b* may increase upward. Each of the first extension part 383*a* and the third extension part 383*b* may include first to third parts 384*a*, 384*b*, and 384*c*. In another aspect, the third part 384*c* may also be described as including the first extension part 383*a* and the second extension part 383*b* extending in different directions with respect to the central line C1.

The first portion 382 may include a first region 382*d* (see region A in FIG. 15) and a second region 382*e* (remaining areas excluding region A). The curvature of at least a portion of the first region 382*d* may be different from that of at least a portion of the second region 382*e*. The first region 382*d* may include the lowermost end of the ice making cell 320*a*. The second region 382*e* may have a diameter greater than that of the first region 382*d*. The first region 382*d* and the second region 382*e* may be divided vertically. The second heater 430 may contact the first region 382*d*. The first region 382*d* may include a heater contact surface 382*g* contacting the second heater 430. The heater contact surface 382*g* may be, for example, a horizontal plane. The heater contact surface 382*g* may be disposed at a position higher than that of the lowermost end of the first portion 382. The second region 382*e* may include the second contact surface 382*c*. The first region 382*d* may have a shape recessed in a direction opposite to a direction in which ice is expanded in the ice making cell 320*a*.

A distance from the center of the ice making cell 320*a* to the second region 382*e* may be less than that from the center of the ice making cell 320*a* to the portion at which the shape recessed in the first area 382*d* is disposed.

For example, the first region 382*d* may include a pressing part 382*f* that is pressed by the second pusher 540 during the ice separation process. When pressing force of the second pusher 540 is applied to the pressing part 382*f*, the pressing part 382*f* is deformed, and thus, ice is separated from the first portion 382. When the pressing force applied to the pressing part 382*f* is removed, the pressing part 382*f* may return to its original shape. The central line C1 may pass through the first region 382*d*. For example, the central line C1 may pass through the pressing part 382*f*. The heater contact surface 382*g* may be disposed to surround the pressing unit 382*f*. The heater contact surface 382*g* may be disposed at a position higher than that of the lowermost end of the pressing part 382*f*.

At least a portion of the heater contact surface 382*g* may be disposed to surround the central line C1. Accordingly, at least a portion of the transparent ice heater 430 contacting the heater contact surface 382*g* may be disposed to surround the central line C1. Therefore, the second heater 430 may be prevented from interfering with the second pusher 540 while the second pusher 540 presses the pressing unit 382*f*. A distance from the center of the ice making cell 320*a* to the pressing part 382*f* may be different from that from the center of the ice making cell 320*a* to the second region 382*e*.

Figure 16:
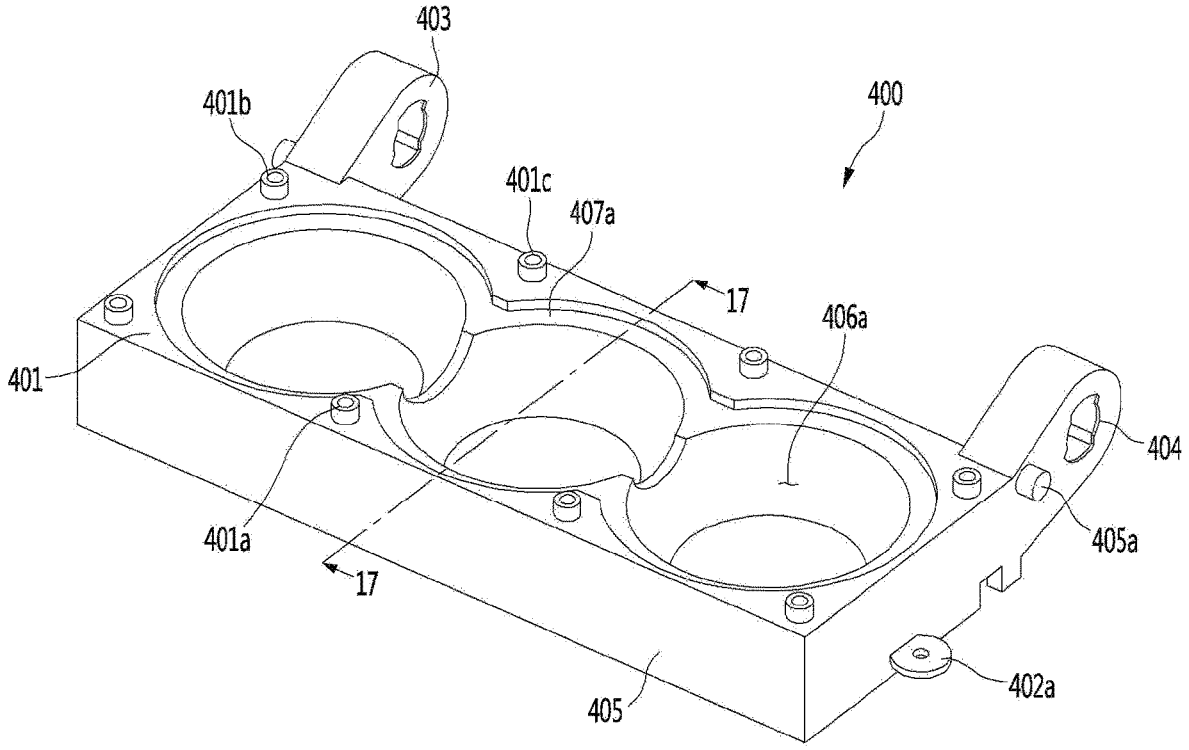
FIG. 16 is a top perspective view of a second tray supporter.
Figure 17:
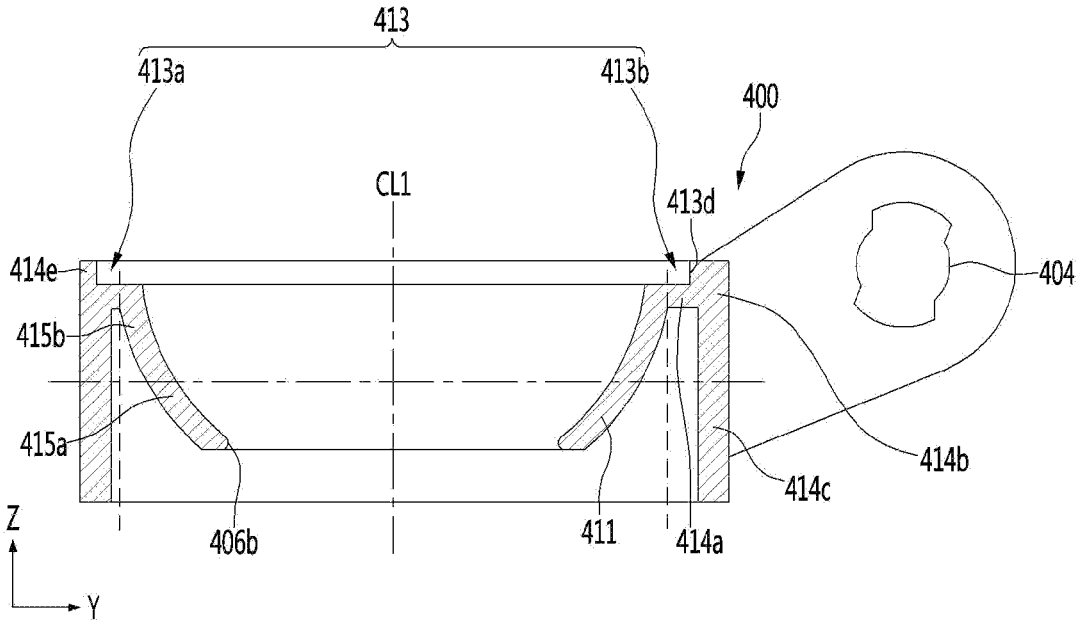
FIG. 17 is a cross-sectional view taken along line 17-17 of FIG. 16.

FIG. 16 is a top perspective view of a second tray supporter, and FIG. 17 is a cross-sectional view taken along line 17-17 of FIG. 16.

Referring to FIGS. 16 and 17, the second tray supporter 400 may include a support body 407 on which a lower portion of the second tray 380 is seated. The support body 407 may include an accommodation space 406*a* in which a portion of the second tray 380 is accommodated. The accommodation space 406*a* may be defined corresponding to the first portion 382 of the second tray 380, and a plurality of accommodation spaces 406*a* may be provided.

The support body 407 may include a lower opening 406*b* (or a through-hole) through which a portion of the second pusher 540 passes. For example, three lower openings 406*b* may be provided in the support body 407 to correspond to the three accommodation spaces 406*a*. A portion of the lower portion of the second tray 380 may be exposed by the lower opening 406*b*. At least a portion of the second tray 380 may be disposed in the lower opening 406*b*. A top surface 407*a* of the support body 407 may extend in the horizontal direction.

The second tray supporter 400 may include a top surface 407*a* of the support body 407 and a stepped lower plate 401. The lower plate 401 may be disposed at a position higher than that of the top surface 407*a* of the support body 407. The lower plate 401 may include a plurality of coupling parts 401*a*, 401*b*, and 401*c* to be coupled to the second tray cover 360. The second tray 380 may be inserted and coupled between the second tray cover 360 and the second tray supporter 400.

For example, the second tray 380 may be disposed below the second tray cover 360, and the second tray 380 may be accommodated above the second tray supporter 400.

The first extension wall 387*b* of the second tray 380 may be coupled to the coupling parts 361*a*, 361*b*, and 361*c* of the second tray cover 360 and the coupling parts 400*a*, 401*b*, and 401*c* of the second tray supporter 400.

The second tray supporter 400 may further include a vertical extension wall 405 extending vertically downward from an edge of the lower plate 401. One surface of the vertical extension wall 405 may be provided with a pair of extension parts 403 coupled to the shaft 440 to allow the second tray 380 to rotate. The pair of extension parts 403 may be spaced apart from each other in the X-axis direction of FIG. 32. Also, each of the extension parts 403 may further include a through-hole 404. The shaft 440 may pass through the through-hole 404, and the extension part 281 of the first tray cover 300 may be disposed inside the pair of extension parts 403.

The second tray supporter 400 may further include a spring coupling part 402*a* to which a spring 402 is coupled. The spring coupling part 402*a* may provide a ring to be hooked with a lower end of the spring 402.

The second tray supporter 400 may further include a link connection part 405*a* to which the pusher link 500 is coupled. For example, the link connection part 405*a* may protrude from the vertical extension wall 405.

Referring to FIG. 17, the second tray supporter 400 may include a first portion 411 supporting the second tray 380 defining at least a portion of the ice making cell 320*a*. In FIG. 17, the first portion 411 may be an area between two dotted lines. For example, the support body 407 may define the first portion 411.

The second tray supporter 400 may further include a second portion 413 extending from a predetermined point of the first portion 411. The second portion 413 may reduce transfer of heat, which is transfer from the second heater 430 to the second tray supporter 400, to the ice making cell 320*a* defined by the first tray 320. At least a portion of the second portion 413 may extend in a direction away from the first cell 321*a* defined by the first tray 320. The direction away from the first cell 321 may be a horizontal direction passing through the center of the ice making cell 320*a*. The direction away from the first cell 321 may be a downward direction with respect to a horizontal line passing through the center of the ice making cell 320*a*.

The second portion 413 may include a first part 414*a* extending in the horizontal direction from the predetermined point and a second part 414*b* extending in the same direction as the first part 414*a*.

The second portion 413 may include a first part 414*a* extending in the horizontal direction from the predetermined point, and a third part 414*c* extending in a direction different from that of the first part 414*a*.

The second portion 413 may include a first part 414*a* extending in the horizontal direction from the predetermined point, and a second part 414*b* and a third part 414*c*, which are branched from the first part 414*a*.

A top surface 407*a* of the support body 407 may provide, for example, the first part 414*a*. The first part 414*a* may further include a fourth part 414*d* extending in the vertical line direction. The lower plate 401 may provide, for example, the fourth part 414*d*. The vertical extension wall 405 may provide, for example, the third part 414*c*.

A length of the third part 414*c* may be greater than that of the second part 414*b*. The second part 414*b* may extend in the same direction as the first part 414*a*. The third part 414*c* may extend in a direction different from that of the first part 414*a*. The second portion 413 may be disposed at the same height as the lowermost end of the first cell 321*a* or extend up to a lower point. The second portion 413 may include a first extension part 413*a* and a second extension part 413*b* which are disposed opposite to each other with respect to the center line CL1 corresponding to the center line C1 of the ice making cell 320*a*.

Referring to FIG. 17, the first extension part 413*a* may be disposed at a left side with respect to the center line CL1, and the second extension part 413*b* may be disposed at a right side with respect to the center line CL1.

The first extension part 413*a* and the second extension part 413*b* may have different shapes with respect to the center line CL1. The first extension part 413*a* and the second extension part 413*b* may have shapes that are asymmetrical to each other with respect to the center line CL1.

A length of the second extension part 413*b* may be greater than that of the first extension part 413*a* in the horizontal direction. That is, a length of the thermal conductivity of the second extension part 413*b* is greater than a length of the first extension part 413*a*. The second extension part 413*b* may be disposed closer to the shaft 440 that provides a center of rotation of the second tray assembly than the first extension part 413*a*.

In this embodiment, since the length of the second extension part 413*b* in the Y-axis direction is greater than that of the first extension part 413*a*, the second tray assembly including the second tray 380 contacting the first tray 320 may increase in radius of rotation.

A center of curvature of at least a portion of the second extension part 413*a* may coincide with a center of rotation of the shaft 440 which is connected to the driver 480 to rotate.

The first extension part 413*a* may include a portion 414*e* extending upwardly with respect to the horizontal line. The portion 414*e* may surround, for example, a portion of the second tray 380.

In another aspect, the second tray supporter 400 may include a first region 415*a* including the lower opening 406*b* and a second region 415*b* having a shape corresponding to the ice making cell 320*a* to support the second tray 380. For example, the first region 415*a* and the second region 415*b* may be divided vertically. In FIG. 11, for example, the first region 415*a* and the second region 415*b* are divided by a dashed-dotted line. The first region 415*a* may support the second tray 380. The controller controls the ice maker to allow the second pusher 540 to move from a first point outside the ice making cell 320*a* to a second point inside the second tray supporter 400 via the lower opening 406*b*. A degree of deformation resistance of the second tray supporter 400 may be greater than that of the second tray 380. A degree of restoration of the second tray supporter 400 may be less than that of the second tray 380.

In another aspect, the second tray supporter 400 includes a first region 415*a* including a lower opening 406*b* and a second region 415*b* disposed farther from the second heater 430 than the first region 415*a*.

Figure 19:
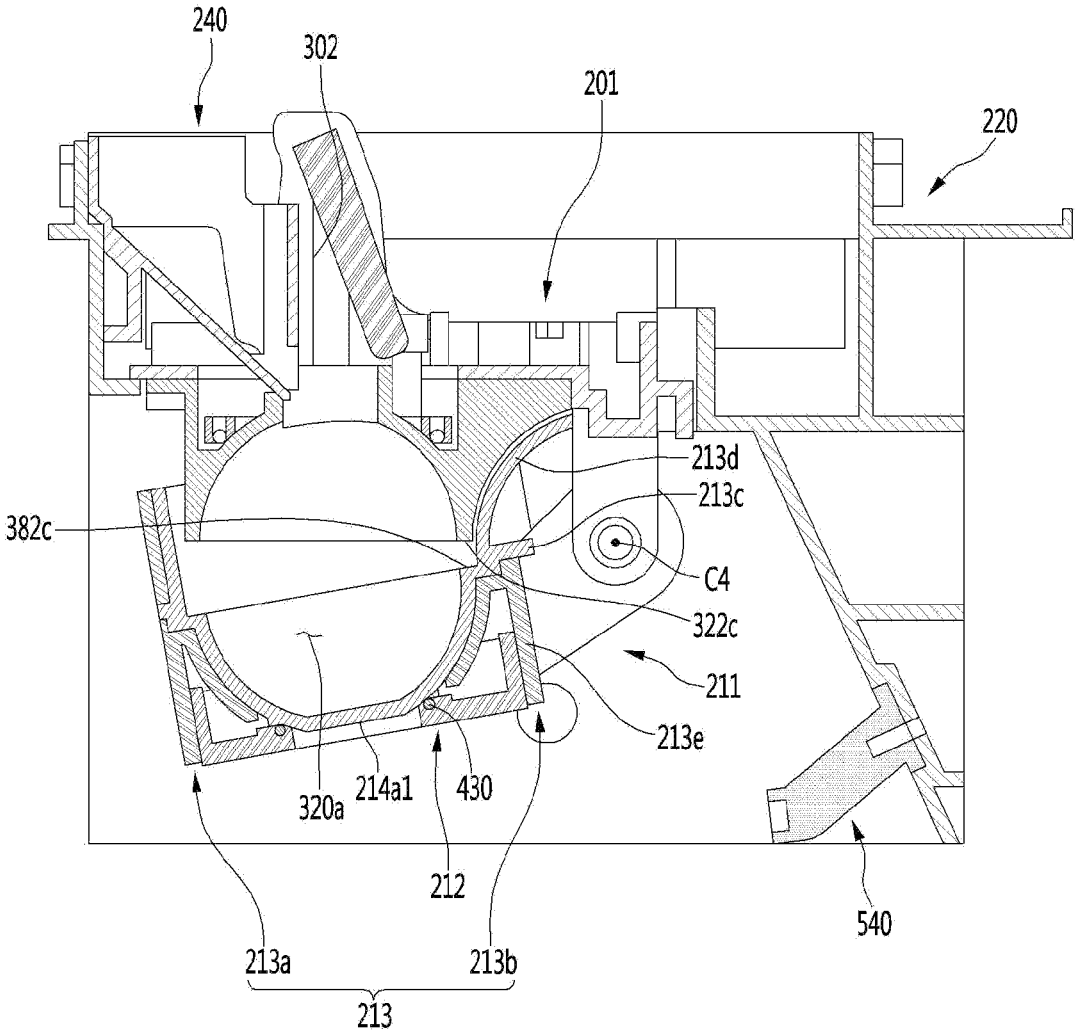
FIG. 19 is a view illustrating a state in which the second tray is moved to the water supply position in FIG. 18.

FIG. 18 is a cross-sectional view taken along line 18-18 of FIG. 3, view (a), and FIG. 19 is a view illustrating a state in which the second tray is moved to the water supply position in FIG. 18.

Referring to FIGS. 18 and 19, the ice maker 200 may include a first tray assembly 201 and a second tray assembly 211, which are connected to each other.

The first tray assembly 201 may include a first portion forming at least a portion of the ice making cell 320*a* and a second portion connected from the first portion to a predetermined point.

The first portion of the first tray assembly 201 may include a first portion 322 of the first tray 320, and the second portion of the first tray assembly 201 may include a second portion 322 of the first tray 320. Accordingly, the first tray assembly 201 includes the deformation resistance reinforcement parts of the first tray 320.

The first tray assembly 201 may include a first region and a second region positioned further from the second heater 430 than the first region. The first region of the first tray assembly 201 may include a first region of the first tray 320, and the second region of the first tray assembly 201 may include a second region of the first tray 320.

The second tray assembly 211 may include a first portion 212 defining at least a portion of the ice making cell 320*a* and a second portion 213 extending from a predetermined point of the first portion 212. The second portion 213 may reduce transfer of heat from the second heater 430 to the ice making cell 320*a* defined by the first tray assembly 201. The first portion 212 may be an area disposed between two dotted lines in FIG. 12.

The predetermined point of the first portion 212 may be an end of the first portion 212 or a point at which the first tray assembly 201 and the second tray assembly 211 meet each other. At least a portion of the first portion 212 may extend in a direction away from the ice making cell 320*a* defined by the first tray assembly 201. At least two portions of the second portion 213 may be branched to reduce heat transfer in the direction extending to the second portion 213. A portion of the second portion 213 may extend in the horizontal direction passing through the center of the ice making cell 320*a*. A portion of the second portion 213 may extend in an upward direction with respect to a horizontal line passing through the center of the ice making chamber 320*a*.

The second portion 213 includes a first part 213*c* extending in the horizontal direction passing through the center of the ice making cell 320*a*, a second part 213*d* extending upward with respect to the horizontal line passing through the center of the ice making cell 320*a*, a third part 213*e* extending downward.

The first portion 212 may have different degree of heat transfer in a direction along the outer circumferential surface of the ice making cell 320*a* to reduce transfer of heat, which is transferred from the second heater 430 to the second tray assembly 211, to the ice making cell 320*a* defined by the first tray assembly 201. The second heater 430 may be disposed to heat both sides with respect to the lowermost end of the first portion 212.

The first portion 212 may include a first region 214*a* and a second region 214*b*. In FIG. 18, the first region 214*a* and the second region 214*b* are divided by a dashed-dotted line. The second region 214*b* may be a region defined above the first region 214*a*. The degree of heat transfer of the second region 214*b* may be greater than that of the first region 214*a*.

The first region 214*a* may include a portion at which the second heater 430 is disposed. That is, the first region 214*a* may include the second heater 430.

The lowermost end 214*a*1 of the ice making cell 320*a* in the first region 214*a* may have a heat transfer rate less than that of the other portion of the first region 214*a*. The distance from the center of the ice making cell 320*a* to the outer circumferential surface is greater in the second region 214*b* than in the first region 214*a*.

The second region 214*b* may include a portion in which the first tray assembly 201 and the second tray assembly 211 contact each other. The first region 214*a* may provide a portion of the ice making cell 320*a*. The second region 214*b* may provide the other portion of the ice making cell 320*a*. The second region 214*b* may be disposed farther from the second heater 430 than the first region 214*a*.

Part of the first region 214*a* may have the degree of heat transfer less than that of the other part of the first region 214*a* to reduce transfer of heat, which is transferred from the second heater 430 to the first region 314*a*, to the ice making cell 320*a* defined by the second region 214*b*.

To make ice in the direction from the ice making cell 320*a* defined by the first region 214*a* to the ice making cell 320*a* defined by the second region 214*b*, a portion of the first region 214*a* may have a degree of deformation resistance less than that of the other portion of the first region 214*a* and a degree of restoration greater than that of the other portion of the first region 214*a*.

A portion of the first region 214*a* may be thinner than the other portion of the first region 214*a* in the thickness direction from the center of the ice making cell 320*a* to the outer circumferential surface direction of the ice making cell 320*a*.

For example, the first region 214*a* may include a second tray case surrounding at least a portion of the second tray 380 and at least a portion of the second tray 380. For example, the first region 214*a* may include the pressing part 382*f* of the second tray 380. The rotation center C4 may be disposed closer to the second pusher 540 than to the ice making cell 320*a*. The second portion 213 may include a first extension part 213*a* and a second extension part 323*b*, which are disposed at sides opposite to each other with respect to the central line C1.

The first extension part 213*a* may be disposed at a left side of the center line C1 in FIG. 18, and the second extension part 213*b* may be disposed at a right side of the center line C1 in FIG. 41. The water supply part 240 may be disposed close to the first extension part 213*a*. The first tray assembly 301 may include a pair of guide slots 302, and the water supply part 240 may be disposed in a region between the pair of guide slots 302.

The ice maker 200 according to this embodiment may be designed such that the position of the second tray 380 is different from a water supply position and an ice making position. In FIG. 19, as an example, a water supply position of the second tray 380 is illustrated. For example, in the water supply position as illustrated in FIG. 19, at least a portion of the first contact surface 322*c* of the first tray 320 and the second contact surface 382*c* of the second tray 380 may be spaced apart. In FIG. 19, for example, it is illustrated that all of the first contact surfaces 322*c* are spaced apart from all of the second contact surfaces 382*c*. Accordingly, in the water supply position, the first contact surface 322*c* may be inclined to form a predetermined angle with the second contact surface 382*c*.

Although not limited, in the water supply position, the first contact surface 322*c* may be substantially horizontal, and the second contact surface 382*c* may be disposed to be inclined below the first tray 320 with respect to the first contact surface 322*c*.

Meanwhile, in the ice making position (see FIG. 18), the second contact surface 382*c* may contact at least a portion of the first contact surface 322*c*. The angle formed between the second contact surface 382*c* of the second tray 380 and the first contact surface 322*c* of the first tray 320 at the ice making position is smaller than the angle formed between the second contact surface 382*c* of the second tray 380 and the first contact surface 322*c* of the first tray 320 at the water supply position.

In the ice making position, all of the first contact surface 322*c* may contact the second contact surface 382*c*. In the ice making position, the second contact surface 382*c* and the first contact surface 322*c* may be disposed to be substantially horizontal.

In this embodiment, the reason why the water supply position and the ice making position of the second tray 380 are different is that in a case in which the ice maker 200 includes a plurality of ice making cells 320*a*, water is to be uniformly distributed to the plurality of ice making cells 320*a* without forming water passage for communication between respective ice making cells 320*a* in he first tray 320 and/or the second tray 380.

If the ice maker 200 includes the plurality of ice making cells 320*a*, when a water passage is formed in the first tray 320 and/or the second tray 380, the water supplied to the ice maker 200 is distributed to the plurality of ice making cells 320*a* along the water passage. However, in a state in which the water is distributed to the plurality of ice making cells 320*a*, water exists in the water passage, and when ice is generated in this state, ice generated in the ice making cell 320*a* is connected by ice generated in the water passage portion. In this case, there is a possibility that the ice will be attached to each other even after the ice separation is completed, and even if the ice is separated from each other, some of the plurality of ice contain ice generated in the water passage portion, so there is a problem that the shape of the ice is different from the shape of the ice making cell.

However, as in the present embodiment, in a case in which the second tray 380 is spaced apart from the first tray 320 at the water supply position, the water dropped to the second tray 380 may be uniformly distributed to the plurality of second cells 381*a* of the second tray 380.

The water supply part 240 may supply water to one of the plurality of openings 324. In this case, the water supplied through the one opening 324 drops into the second tray 380 after passing through the first tray 320. During the water supply process, water may drop into any one second cell 381*a* of the plurality of second cells 381*a* of the second tray 380. Water supplied to one second cell 381*a* overflows from one second cell 381*a*.

In the present embodiment, since the second contact surface 382*c* of the second tray 380 is spaced apart from the first contact surface 322*c* of the first tray 320, the water overflowing from the second cell 381*a* moves to another adjacent second cell 381*a* along the second contact surface 382*c* of the second tray 380. Accordingly, the plurality of second cells 381*a* of the second tray 380 may be filled with water.

In addition, in a state in which the water supply is completed, a portion of the water supplied is filled in the second cell 381*a*, and another part of the water supplied may be filled in the space between the first tray 320 and the second tray 380. When the second tray 380 moves from the water supply position to the ice making position, water in the space between the first tray 320 and the second tray 380 may be uniformly distributed to the plurality of first cells 321*a*.

Meanwhile, when a water passage is formed in the first tray 320 and/or the second tray 380, ice generated in the ice making cell 320*a* is also generated in the water passage portion.

In this case, in order to generate transparent ice, if the controller of the refrigerator controls one or more of the cooling power of the cooler and the heating amount of the second heater 430 to be varied according to the mass per unit height of water in the ice making cell 320*a*, in the portion in which the water passage is formed, one or more of the cooling power of the cooler and the heating amount of the second heater 430 is controlled to rapidly vary several times or more.

This is because the mass per unit height of water is rapidly increased several times or more in the portion where the water passage is formed. In this case, reliability problems of parts may occur, and expensive parts with large widths of the maximum and minimum outputs can be used, which may be disadvantageous in terms of power consumption and cost of the parts. As a result, the present disclosure may require a technique related to the above-described ice making position to generate transparent ice.

Figure 20:
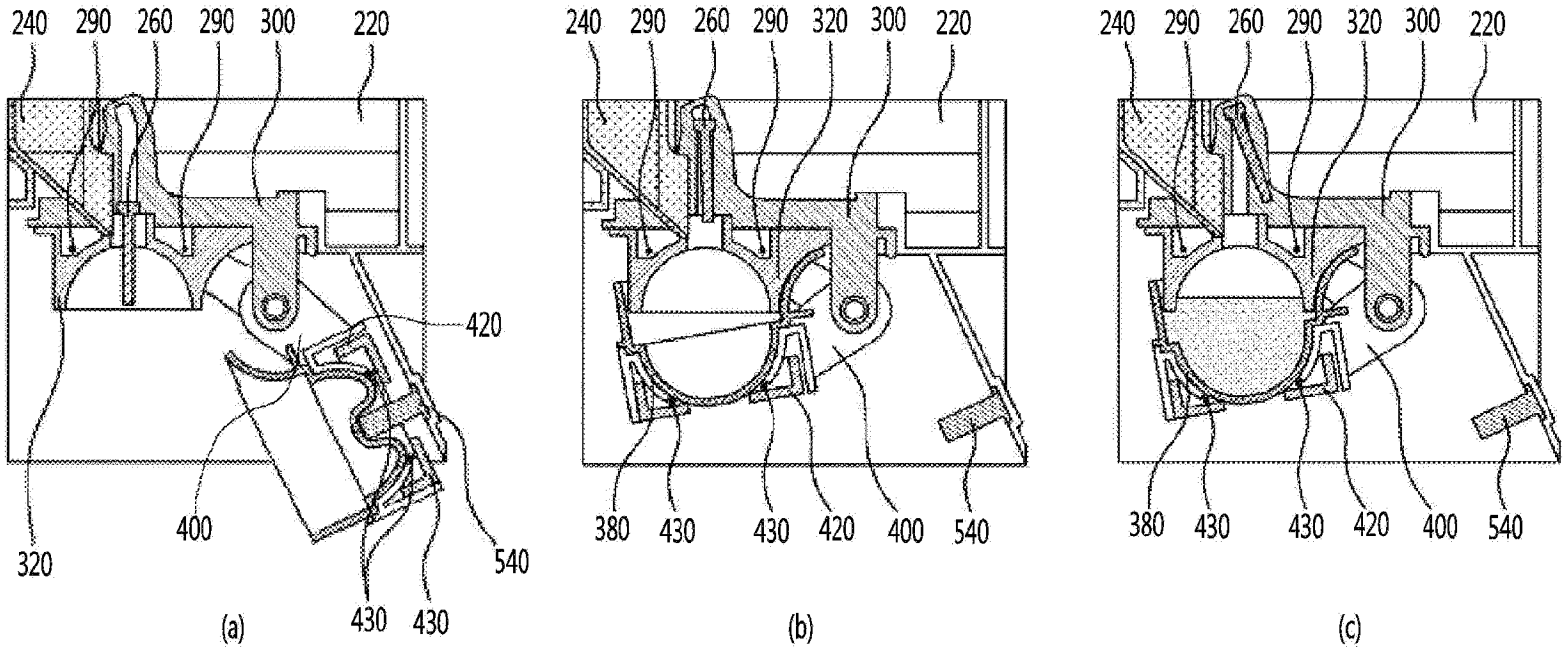
FIGS. 20 and 21 are views for explaining a process of supplying water to the ice maker.
Figure 21:
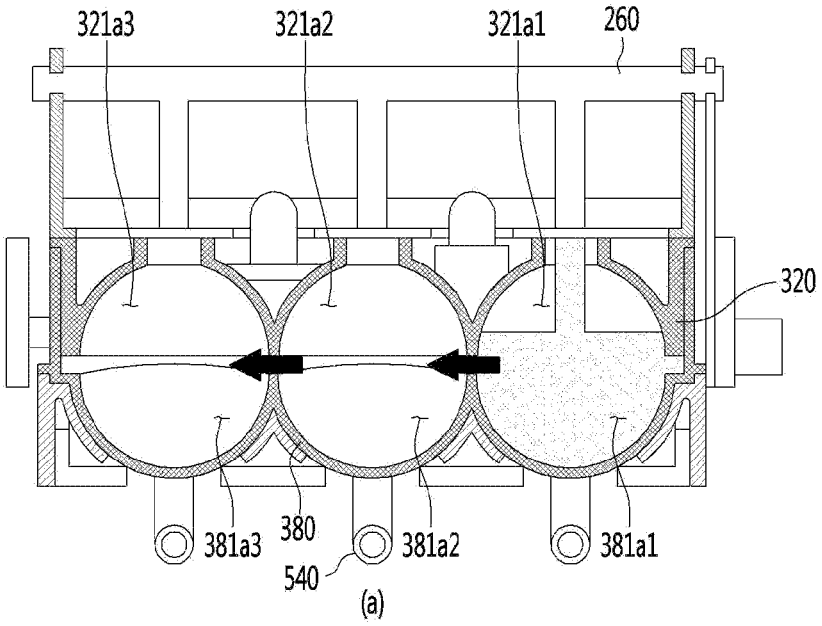
Figure 21:
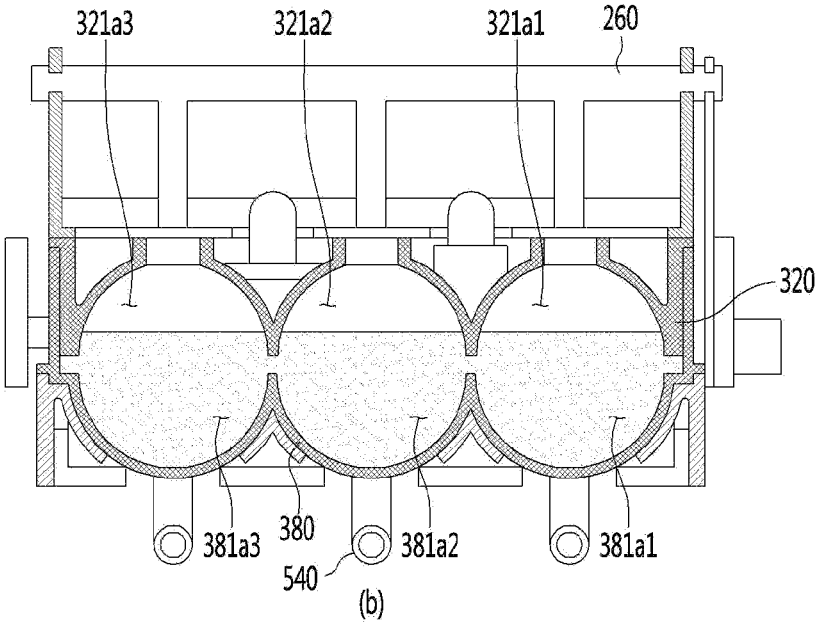

FIGS. 20 and 21 are views for explaining a process of supplying water to the ice maker.

FIG. 20 is a view illustrating a process of supplying water while viewing the ice maker from the side, and FIG. 21 is a view illustrating a process of supplying water while viewing the ice maker from the front.

As illustrated in FIG. 20, view (a), the first tray 320 and the second tray 380 are disposed in a state of being separated from each other, and then, as illustrated in FIG. 20, view (b), the second tray 380 is rotated in the reverse direction toward the tray 320. At this time, although a part of the first tray 320 and the second tray 380 overlap, the first tray 320 and the second tray 380 are completely engaged so that the inner space thereof does not form a spherical shape.

As illustrated in FIG. 20, view (c), water is supplied into the tray through the water supply part 240. Since the first tray 320 and the second tray 380 are not fully engaged, some of the water passes out of the first tray 320. However, since the second tray 380 includes a peripheral wall formed to surround the upper side of the first tray 320 to be spaced apart, water does not overflow from the second tray 380.

FIG. 21 is a view for specifically explaining FIG. 20, view (c), wherein the state changes in the order of FIG. 21, view (a) and FIG. 21, view (b).

As illustrated in FIG. 20, view (c), when water is supplied to the first tray 320 and the second tray 380 through the water supply part 240, the water supply part 240 is disposed to be biased toward one side of the tray.

That is, the first tray 320 is provided with a plurality of cells 321*a*1, 321*a*2, 321*a*3 for generating a plurality of independent ices. The second tray 380 is also provided with a plurality of cells 381*a*1, 381*a*2, 381*a*3 for generating a plurality of independent ices. As the cells disposed in the first tray 320 and the cells disposed in the second tray 380 are combined, one spherical ice may be generated.

In FIG. 21, the first tray 320 and the second tray 380 do not completely contact as in FIG. 20, view (c) and the front sides of the first tray and the second tray are separated from each other, so that the water in each cell can move between the cells.

As illustrated in FIG. 21, view (a), when water is supplied to the upper side of the cells 321*a*1 and 381*a*1 positioned on one side, the water moves into the inside of the cells 321*a*1 and 381*a*1. At this time, when water overflows from the lower cell 381*a*1, water may be moved to the adjacent cells 321*a*2 and 381*a*2. Since the plurality of cells are not completely isolated from each other, when the water level in the cell rises above a certain level, each cell can be filled with the water while the water moves to the surrounding cells and.

In a case in which predetermined water is supplied from a water supply valve disposed in a water supply pipe provided outside the ice maker 200, a flow path may be closed so that water is no longer supplied to the ice maker 200.

Figure 22:
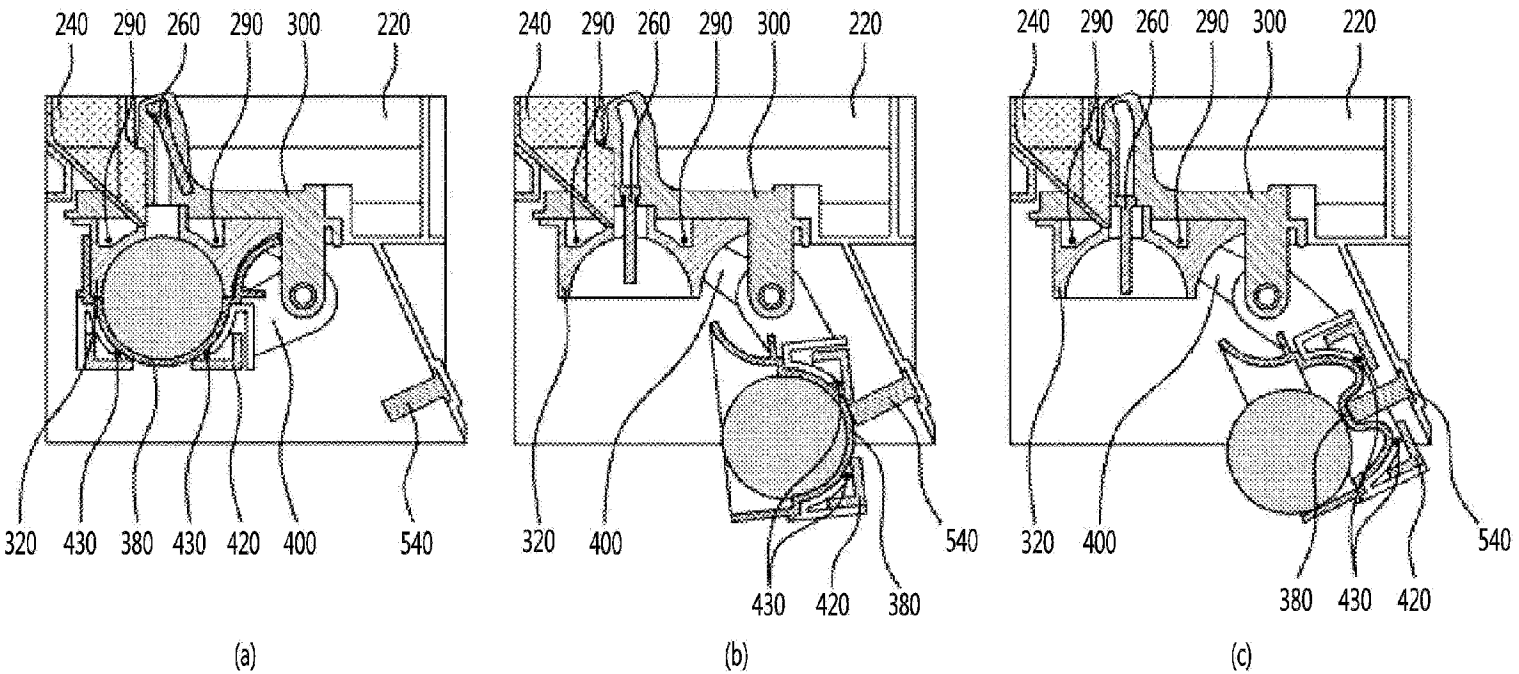
FIG. 22 is a view for explaining a process of ice being separated from an ice maker.

FIG. 22 is a diagram illustrating a process of ice being separated in an ice maker.

Referring to FIG. 22, when the second tray 380 is further rotated in the reverse direction in FIG. 20, view (c), as illustrated in FIG. 21, view (a), the first tray 320 may be disposed so as to form a spherical shape together with the second tray 380 and the cell. The second tray 380 and the first tray 320 are completely combined to each other and disposed so that water may be separated in each cell.

When cold air is supplied for a predetermined time in the state of FIG. 22, view (a), ice is generated in the ice making cell of the tray. While the water is changed to ice by cold air, the first tray 320 and the second tray 380 are engaged with each other as illustrated in FIG. 22, view (a) to maintain a state in which water does not move.

When ice is generated in the ice making cell of the tray, as illustrated in FIG. 22, view (b), in a state in which the first tray 320 is stopped, the second tray 380 is rotated in the forward direction.

At this time, since the ice has own weight thereof, the ice may drop from the first tray 320. Since the first pusher 260 presses the ice while descending, it is possible to prevent ice from being attached to the first tray 320.

Since the second tray 380 supports the lower portion of the ice, even if the second tray 380 is moved in the forward direction, the state in which the ice is mounted on the second tray 380 is maintained. As illustrated in FIG. 22, view (b), even in a state in which the second tray 380 is rotated to exceed a vertical angle, there may be a case where ice is attached to the second tray 380.

Therefore, in this embodiment, the second pusher 540 deforms the pressing part of the second tray 380, and as the second tray 380 is deformed, the attachment force between the ice and the second tray 380 is weakened and thus ice may fall from the second tray 380.

After the ice has fallen from the second tray 380, although not illustrated in FIG. 22, the ice may fall into the ice bin 600.

Figure 23:
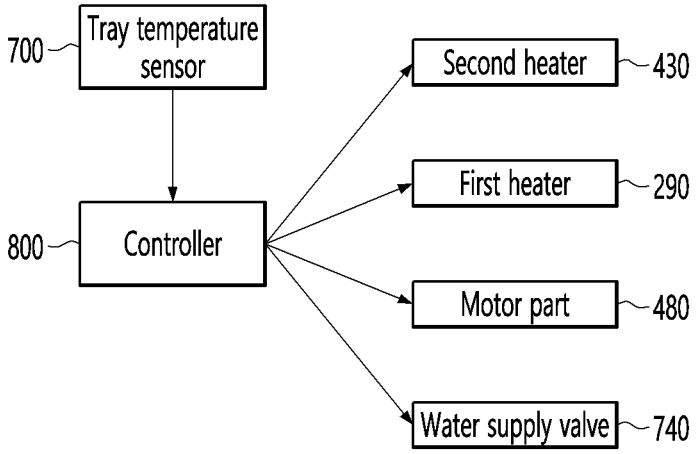
FIG. 23 is a control block diagram according to an embodiment.

FIG. 23 is a control block diagram according to an embodiment.

Referring to FIG. 23, in an embodiment of the present disclosure, a tray temperature sensor 700 for measuring the temperature of the first tray 320 or the second tray 380 is provided.

The temperature sensed by the tray temperature sensor 700 represents the temperature of water or ice in the ice making cell 320*a*. Accordingly, it can be understood that the tray temperature sensor 700 indirectly senses the temperature of water or ice in the ice making cell 320*a*.

The temperature measured by the tray temperature sensor 700 is transmitted to the controller 800.

The controller 800 may control the driver 480 (or the motor part) to rotate the motor in the driver 480.

The controller 800 may control a water supply valve 740 that opens and closes a flow path of water supplied to the ice maker 200 so that water is supplied to the ice maker 200 or the supply of water to the ice maker is stopped.

When the driver 480 is operated, the second tray 380 or the full ice detection lever 520 may be rotated.

A second heater 430 may be installed in the second heater case 420. The second heater 430 may supply heat to the second tray 380. Since the second heater 430 is disposed under the second tray 380, it may be referred to as a lower heater.

A second heater 290 may be provided in the first heater case 280. The first heater 290 may supply heat to the first tray 320. Since the first heater 290 is disposed above the second heater 430, the first heater 290 may be referred to as an upper heater.

Power is supplied to the first heater 290 and the second heater 430 according to a command of the controller 800 to generate heat.

Figure 24:
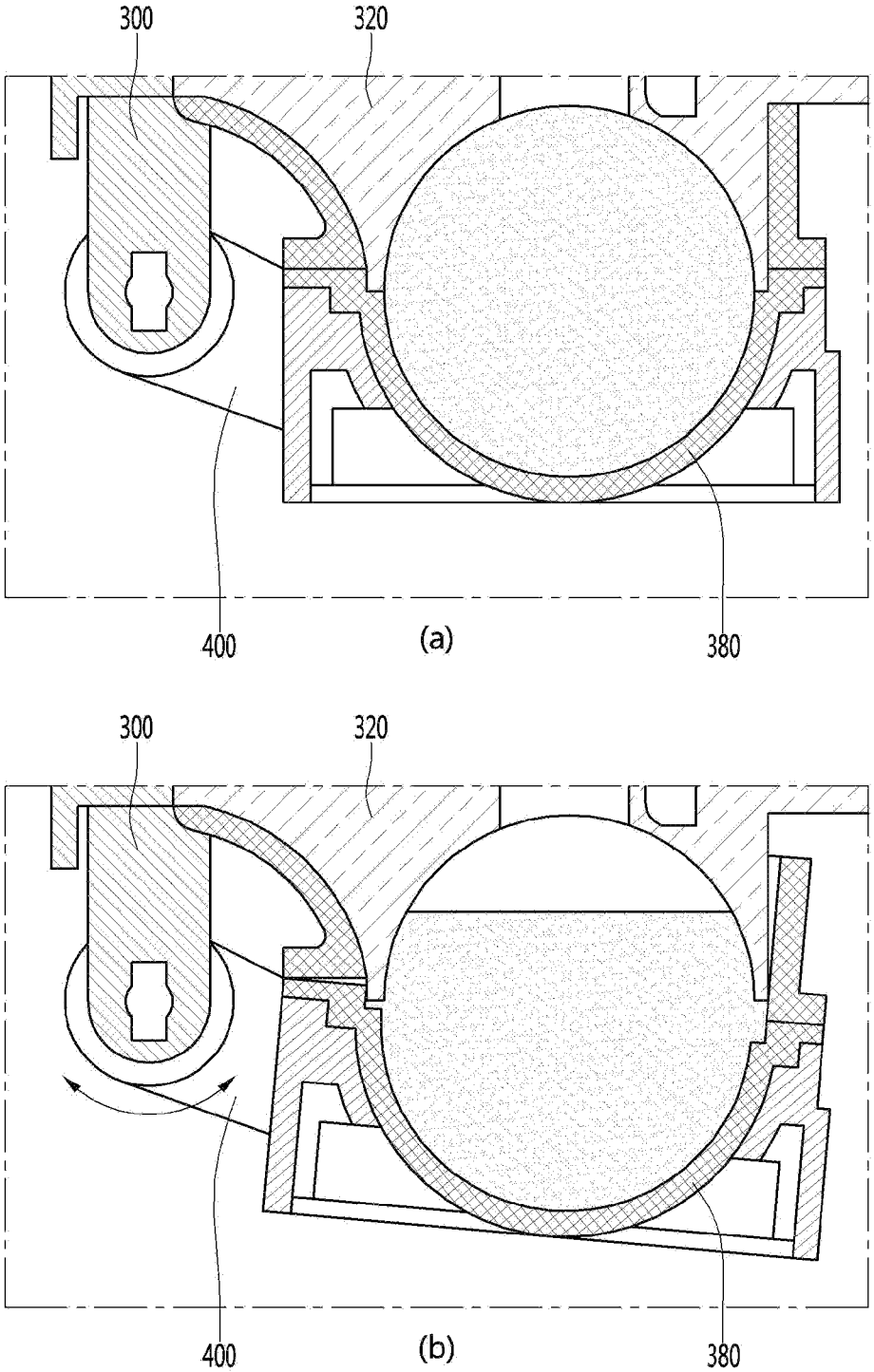
FIG. 24 is a view for explaining a process of releasing supercooling according to an embodiment.

FIG. 24 is a view for explaining a process of releasing supercooling according to an embodiment.

Referring to FIG. 24, after water is supplied to the ice maker 200, cold air is supplied to the ice maker 200. While ice is generated in the tray, the tray temperature sensor 700 measures the temperature.

After the temperature measured by the tray temperature sensor 700 decreases to a reference temperature (for example, a temperature which is 0 degrees Celsius or lower than 0 degrees Celsius), in a case in which the temperature decreases to a specific temperature (for example, a temperature which is −3° C. or higher than −3° C.), it may be determined that supercooling occurs. That is, the controller 700 determines that supercooling occurs when the temperature of the tray drops to 0 degrees and then drops to −3 degrees at a relatively high speed.

At this time, the controller 800 moves the second tray 380 in the first direction in a state in which the second tray 380 is positioned in the ice making position. That is, in a state in which the first tray 320 and the second tray 380 are in contact with each other as illustrated in FIG. 24, view (a), the second tray 380 is moved in the first direction as illustrated in FIG. 24, view (b), and thus at least a portion of the first tray 320 and the second tray 380 may be spaced apart. For example, the second tray 380 may be moved to a water supply position or between a water supply position and an ice separation position. The ice making position, the water supply position, and the ice separation positions may alternatively be referred to as first, second, and third positions.

Accordingly, as the movement of water accommodated in the first tray 320 and the second tray 380 occurs, supercooling may be released. The second tray 380 may rotate, for example. After the second tray 380 is rotated to a predetermined angle, the second tray returns to the position as illustrated in FIG. 24, view (a). That is, the second tray 380 moves in a second direction opposite to the first direction.

After the second tray 380 moves in the second direction, if the temperature measured by the tray temperature sensor 700 rises −3° C. or more, it may be determined that supercooling has been released and the second tray 380 may not move any more.

Meanwhile, if the temperature measured by the tray temperature sensor continues to drop even after the second tray 380 is moved once, it is determined that supercooling has not been released, and the second tray 380 may be moved again.

Figure 25:
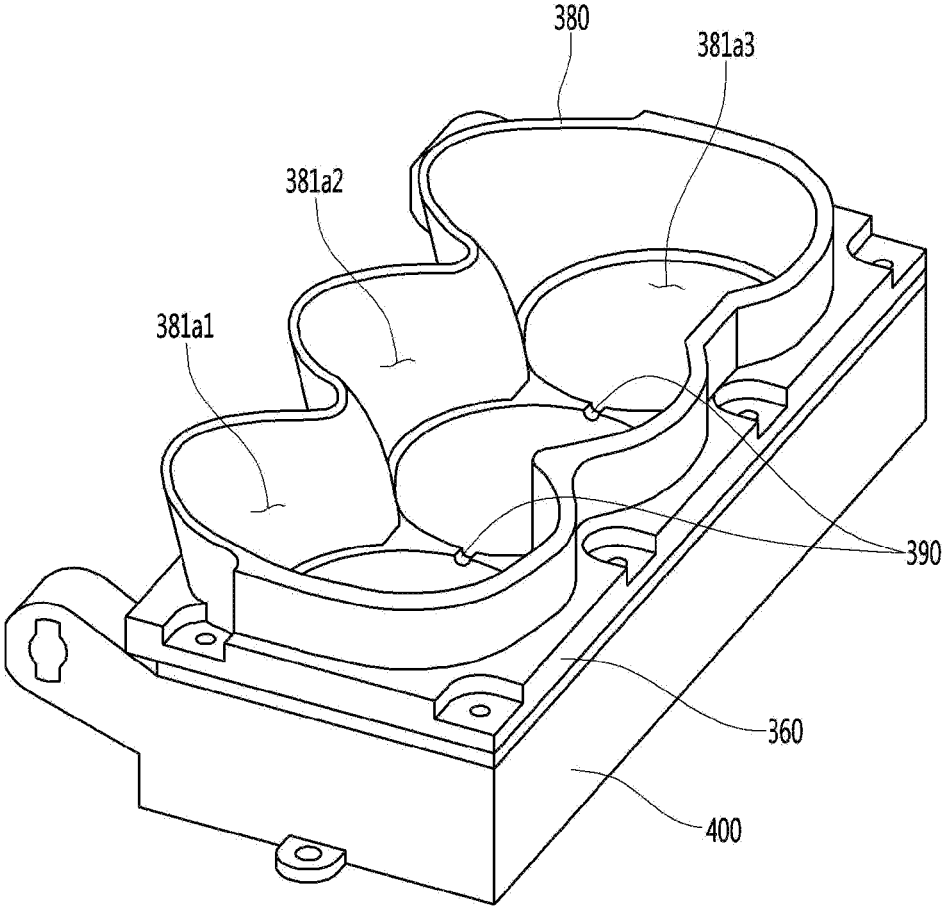
FIG. 25 is a view illustrating a second tray and related portions according to another embodiment.
Figure 26:
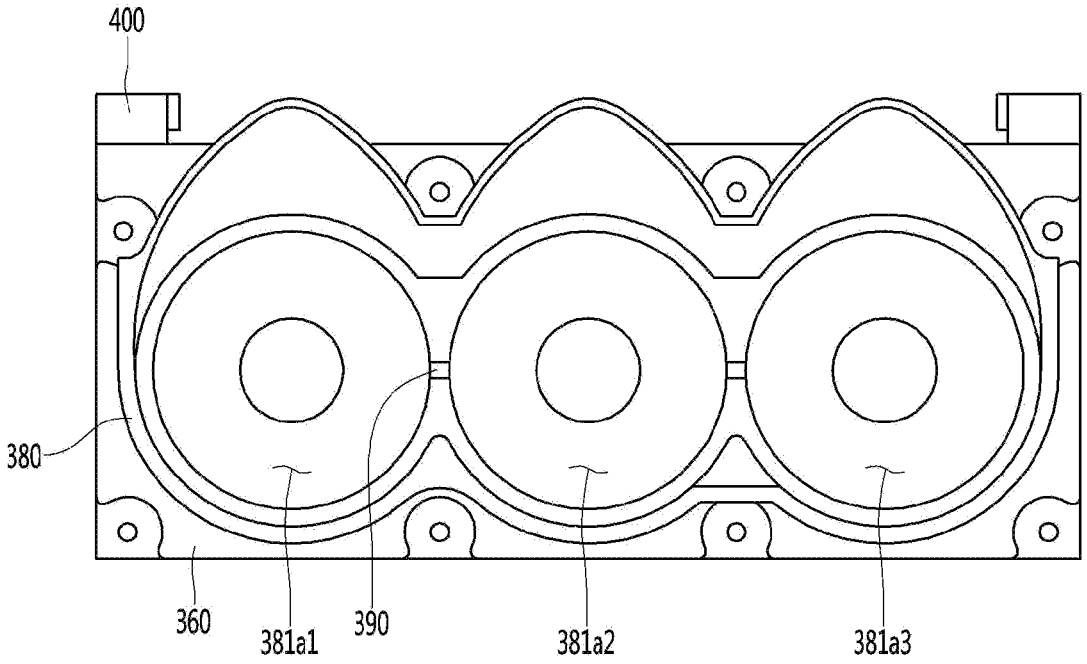
FIG. 26 is a plan view of FIG. 25.

FIG. 25 is a view illustrating a second tray and related portions according to another embodiment, and FIG. 26 is a plan view of FIG. 25.

Referring to FIGS. 25 and 26, in another embodiment, a communication hole or passage 390 is provided to connect the second cells 381*a*1, 381*a*2, and 381*a*3 of the second tray.

The communication hole 390 connects each of the second cells 381*a*1, 381*a*2, 381*a*3 and the second cells 381*a*1, 381*a*2, 381*a*3 adjacent to the cell. It is not easy for water to freely move between the second cells 381*a*1, 381*a*2, 381*a*3 through the communication hole 390, but since there is the communication hole 390, each of the second cells 381*a*1, 381*a*2, 381*a*3 is not completely isolated.

In a case in which supercooling is released in any one of the second cells 381*a*1, 381*a*2, 381*a*3, through the communication hole 390, the effect of also releasing the supercooling in other cells among the second cells 381*a*1, 381*a*2, and 381*a*3 may be successively generated.

Since there is an effect that all the plurality of second cells 381*a*1, 381*a*2, 381*a*3 become one container through the communication hole 390, the effect of releasing the supercooling can be transferred to other cells.

The communication hole 390 is provided smaller than the size of the second cells 381*a*1, 381*a*2, 381*a*3 but may have a semicircle or polygonal cross section. The communication hole 390 may be implemented so that the second cells 381*a*1, 381*a*2, and 381*a*3 are provided at positions adjacent to each other, respectively, so that the length of the communication hole 390 may be shortened as much as possible.

The communication hole 390 connects each of the second cells 381*a*1, 381*a*2, and 381*a*3 to have a linear distance, so that the volume occupied by the second tray 380 may be reduced. The communication hole 390 may be disposed on an extension line connecting the center of each of the second hemispherical cells.

The communication hole 390 may be disposed on the upper surface of the second tray 380. For example, the communication hole 390 may be formed by being recessed in a direction away from the first tray 320 (for example, downward) from the second contact surface of the second tray 380.

The upper surface of the second tray 380 is a surface in contact with the first contact surface 322*c* (see FIG. 13) of the first tray 380.

Each of the second cells 381*a*1, 381*a*2, 381*a*3 has a hemispherical shape as a whole, and when each second cell is combined with the first cell of the first tray, it has a spherical shape as a whole. The upper surface of the second tray 380 may mean a hemispherical upper surface forming the second cells 381*a*1, 381*a*2, and 381*a*3.

Since the communication hole 390 is not a passage for moving water between each of the second cells 381*a*1, 381*a*2, and 381*a*3, the communication hole 390 may be formed to have a smaller size than a flow path for moving water.

Through the communication hole 390, freezing nucleus generated when supercooling is released in any one of the plurality of second cells 381*a*1, 381*a*2, 381*a*3 are propagated to other second cells, so that the supercooling can be released in the entire second cell. in a state in which the communication hole 390 and the second cell 381*a*1, 381*a*2, 381*a*3 are filled with water, the moment when the supercooling is released in any one of the second cells, such an effect is transferred to the entire second cells 381*a*1, 381*a*2, 381*a*3 through each communication hole 390. This is because the communication hole 390 is filled with water in the process of supplying water to the second tray 380.

At the ice making position of the second tray 380, the communication hole 390 has a cross-sectional size such that it does not significantly deform the spherical ice and thus may be separated from the spherical ice when the final ice is provided to the user. In a process in which ice is being separated, ice falls into the ice bin 600, and the ice generated in the spherical ice due to the communication hole 390 due to the impact generated at that time is separated from the spherical ice, so that the spherical ice may be maintained.

Meanwhile, when cold air is supplied to the ice maker 200 in a state in which the second tray 380 and the first tray 320 are completely coupled to each other, each of the second cells 381*a*1, 381*a*2, 381*a*3 maintains in a state of being connected to each other.

Unlike FIGS. 25 and 26, the communication hole 390 may be disposed in the first tray 320 instead of the second tray 380. For example, the communication hole 390 may be disposed on the first contact surface 322*c* (see FIG. 13) of the first tray 320. The communication hole 390 may be recessed from the first contact surface 322*c* of the first tray 320 in a direction away from the second tray (for example).

In a case in which the communication hole 390 is provided in the first tray 320, when the supercooling is cancelled in any one of a plurality of the first cells 321*a*1, 321*a*2, 321*a*3 through the communication hole 390, the freezing nuclei generated propagate to another first cell, so that supercooling may be cancelled in the entire first cell.

In addition, the communication hole 390 may be disposed in the second tray 380 and the first tray 320 at the same time.

Another embodiment of the present disclosure will be described with reference to FIG. 23.

In another embodiment, after lowering the temperature of the tray, water is supplied to produce a small amount of ice to prevent supercooling.

As illustrated in FIG. 23, in another embodiment, cold air is supplied to the first tray 320 and the second tray 380. At this time, water is not supplied to the second tray 380. For example, cold air may be supplied to the ice making cell at a water supply position of the second tray 320.

That is, since the water supply valve 740 does not open a flow path, water is not supplied to the ice maker 200. In that state, since the cold air is supplied to the ice maker 200, the first tray 320 and the second tray 380 are cooled. That is, since the second tray 380 is cooled in a state in which water is not stored, the first tray 320 and the second tray 380 may be cooled to 0 degrees or less faster than in a state in which water is present therein.

The temperature of the first tray 320 or the second tray 380 is measured through the tray temperature sensor 700. At this time, it is determined whether the temperature measured by the tray temperature sensor 700 is lower than a set temperature.

At this time, it is preferable that the set temperature is 0 degrees or less. For example, it may mean −10 degrees Celsius or less, but since ice may be formed at temperatures 0 degrees Celsius or less, it is desirable to keep the temperature 0 degrees or less.

When the temperature measured by the tray temperature sensor 700 is lower than the set temperature, the water supply valve 740 opens a flow path to supply water to the second tray 380. Since the temperature of the first tray 320 and the second tray 380 is considerably low, the temperature may decrease more rapidly as the supplied water exchanges heat with the first tray 320 or the second tray 380. Therefore, as ice is generated more quickly, ice may be generated without going through a supercooled state.

In this embodiment, the tray is cooled by cold air before water is supplied to the tray. Since water is not supplied, the temperature of the tray decreases relatively quickly. If water is supplied in a state in which the temperature of the tray is sufficiently lowered, the water cools rapidly and does not undergo supercooling, or the water quickly escapes from supercooling and can be phase-changed to ice.

After the tray has cooled sufficiently, water starts to be supplied. When water starts to be supplied, water is supplied in a set amount without stopping the water supply. After the water supply is completed, ice is generated by continuously supplying cold air to the tray. While ice is being generated, water is not additionally supplied, and cold air is supplied to finally generate ice in a state of being maintaining the initially supplied amount.

Figure 27:
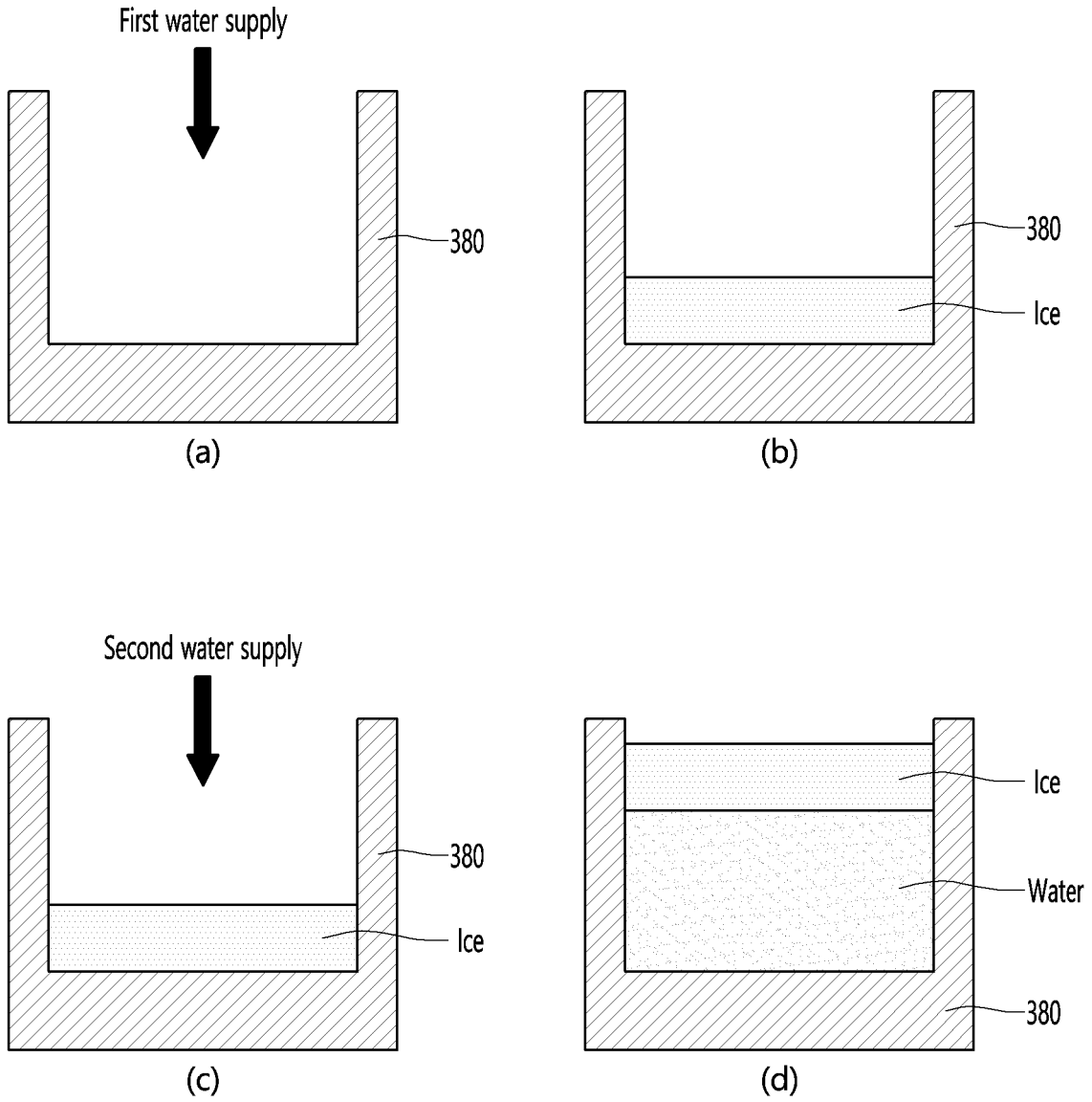
FIG. 27 is a view for explaining a method for making ice according to another embodiment.

FIG. 27 is a view for explaining a method for making ice according to another embodiment.

Another embodiment of the present disclosure will be described with reference to FIGS. 23 and 27.

In another embodiment, water is firstly supplied to the tray, that is, the second tray 380 as illustrated in view (a) of FIG. 27. For example, the first water supply may be performed at the water supply position of the second tray 380.

Then, as illustrated in FIG. 27, view (b), cold air is supplied to the tray to cool water to generate ice. In this case, the second tray 380 may be positioned at a water supply position or may be moved to an ice making position. At this time, by measuring the temperature of the tray by the tray temperature sensor 700 or determining whether a specific time has elapsed, it is possible to detect whether ice is frozen.

If it is determined that the ice is frozen, as in FIG. 27, view (c), water is secondarily supplied to the second tray 380 in which ice is generated. For example, the second water supply may be performed at the water supply position of the second tray 380. If, after the first water supply, the second tray 380 has moved to the ice making position, the second tray 380 may move back to the water supply position for the second water supply.

Then, since water has a higher density than ice, ice rises and water drops as illustrated in FIG. 27, view (d).

In this state, when cold air is supplied to the ice maker 200 and cooled, crystallization proceeds around the already generated ice. Therefore, the water supercooling phenomenon does not occur in the process of generating ice after the second water supply. Therefore, it can generate transparent ice.

To explain with a more specific example, about 10 grams of water is supplied and the ice maker is cooled. It can be detected whether the temperature of the tray measured by the tray temperature sensor 700 reaches −10 degrees Celsius or about 60 minutes have elapsed since the completion of the first water supply. If one of the two conditions is satisfied or both conditions are satisfied, water is supplied to the tray by second water supply. At this time, in the second water supply, water is sufficiently supplied so that spherical ice can be generated from the tray, and additional water supply is not provided until the ice is discharged.

It can be cooled by supplying cold air to the ice maker while additional water supply is in progress. When sufficiently cooled, the additionally supplied water is also cooled to ice, so that spherical transparent ice can be provided to the user.

In this embodiment, since water is supplied in stages, the initially supplied water can be quickly cooled to ice, compared to a method in which water is supplied at a time to generate ice. In the process of generating ice by additional water supply, since supercooling is not performed in a case in which water is supplied in the presence of ice, the supercooling phenomenon does not occur, and thus transparent ice can be provided to the user. After the initially supplied water is converted to ice, since the ice serves as a freezing nucleus, the additionally supplied water may not be supercooled and may be phase-changed to ice.

Of course, it is also possible to generate transparent ice by supplying water in a state in which ice is initially input, rather than a process of dividing water supply. Since the initially input ice performs a freezing nucleus function, it is possible to be immediately phase-changed to ice without going through a supercooled state in the process of freezing water.

Meanwhile, the process of dividing water supply can be divided into a first water supply supplying water initially and a second water supply supplying water later. At this time, it is possible to generate ice more quickly in the first water supply by supplying more water than the first water supply in the second water supply.

In addition, it is possible to implement so that the temperature of the ice maker can be lowered in the process of supplying water performed by continuously supplying cold air to the ice maker in both first water supply and second water supply.

In another aspect, the controller 800 may control the water supply valve 740 to turn off the water supply valve 740 while water supply is performed to stop water supply. After the water supply valve 740 is turned off, the controller 800 may turn on the water supply valve 740 for additional water supply again. The water supply amount before the water supply is stopped may be less than the water supply amount after the water supply is stopped.

The controller 800 may control the water supply stop to be ended based on a time when water supply is stopped and a temperature changed by the water supply stop.

For example, when a reference time elapses after water supply is stopped, the controller 800 may control the stop of water supply to be ended.

Alternatively, the controller 800 may control the stop of water supply to be ended when the temperature sensed by the tray temperature sensor 700 for sensing the temperature of the ice making cell reaches a reference temperature after water supply is stopped.

Alternatively, after the water supply is stopped, when the temperature sensed by the tray temperature sensor 700 decreases by a reference temperature, the controller 800 may control the stop of water supply to be ended.

Alternatively, when the temperature change amount per unit time of the temperature sensed by the tray temperature sensor 700 reaches within a set range after the water supply is stopped, the controller 800 may control the stop of the water supply to be ended. The set range may include 0.

Alternatively, after the water supply is stopped, when at least a portion of the water in the ice making cell is phase-changed, the controller 800 may control the stop of water supply to be ended.

Figure 28:
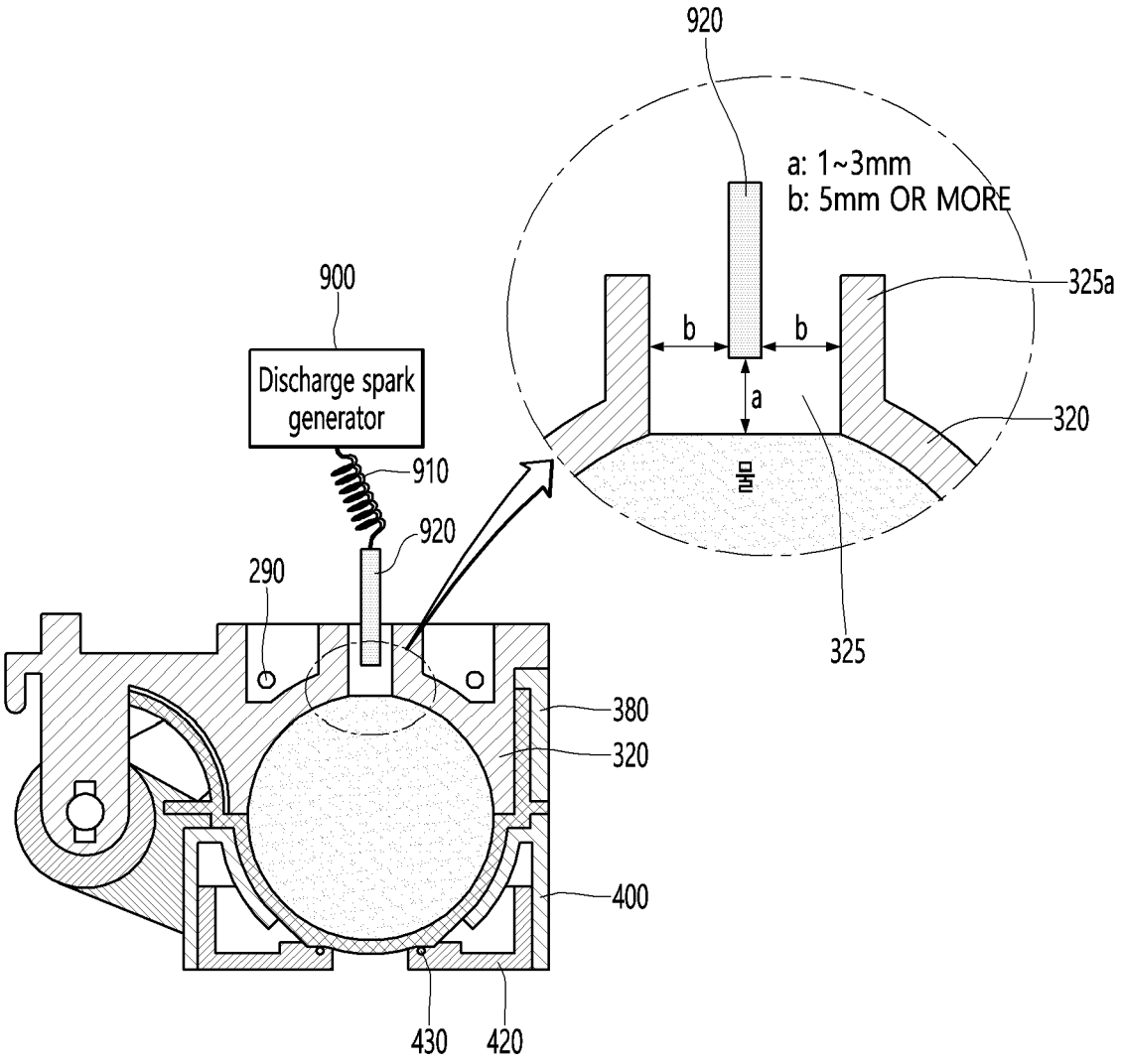
FIG. 28 is a view for explaining a method for making ice according to another embodiment.

FIG. 28 is a view for explaining a method for making ice according to another embodiment.

Referring to FIG. 28, in the process of generating ice while heating water by a heater, the cooling rate of water is slowed. Therefore, since water is slowly cooled while achieving a stable state, supercooling can easily occur.

In the supercooled state which is maintained in a liquid state at the freezing point or less, the time to be phase-changed into ice after the supercooling is released is very short. If a phase change occurs due to a large temperature difference in a short time, there is a high possibility that opaque ice is generated because air cannot escape from the ice. Therefore, in order to make transparent ice, it is necessary to prevent supercooling from occurring or to release supercooling at the beginning of supercooling. In this embodiment, by applying a spark discharged at a high voltage to water, freezing nucleus is generated and energy imbalance may be caused to release supercooling.

When a high voltage is applied between conductors that are not in contact with each other, air, which is an insulator, loses insulation and a discharge phenomenon occurs in which a current flows into the air. Using this phenomenon, a discharge spark generator 900 may be provided.

Since general water acts as a conductor, a spark may be generated on the surface of the supercooled coolant using an electric wire 910 connected from the discharge spark generator 900 and the electrode 920 connected to one end of the electric wire. A method of effectively releasing supercooling by generating freezing nucleus and energy imbalance in the supercooled water by using the spark generated by the discharge spark generator 900 is made.

The discharge spark generator 900 may be positioned in a controller of an ice maker or a refrigerator. Since a discharge spark has to be applied to the exposed upper surface of the water, the electrode 920 is fixed adjacent to the water supply position so as to insulate the first tray 320. At this time, a distance of 1 to 3 mm is maintained so that the upper surface of the water (the uppermost end of the ice making cell) and the exposed electrode 920 do not contact each other. The uppermost end of the ice making cell may have the same height as the opening 324 of the first tray 320.

In addition, the first tray 320 and the exposed electrode 920 have to have a distance of 5 mm or more so that the discharged spark does not occur to the first tray 320. That is, the electrode 920 may be spaced apart from the inner peripheral surface of the storage chamber wall 325*a*. In addition, the electrode 920 may be spaced apart from the opening 324. The electrode 920 may be positioned higher than the opening 324.

The electrode 920 is disposed at the center of an auxiliary storage chamber 325 inside the storage chamber wall 325*a* formed in the first tray 320 so as not to contact the water.

When the temperature of the water is measured by the tray temperature sensor 700 and reaches any supercooled specific temperature (−3° C. to −1° C.), the controller 800 controls the electrode 920 to generate a spark once. When the temperature of the water is measured after a certain time (for example, 5 minutes) and the supercooling is not released (reaching 0° C.), that is, when the additionally measured temperature is equal to or lower than the previously measured temperature, it is possible to generate additional sparks until the supercooling is released. Whether supercooling has not been released may be determined by the temperature measured by the tray temperature sensor 700.

The temperature measured by the tray temperature sensor 700 is similar to the temperature of water stored in the tray.

In addition, when supercooling is not released, it is possible to continuously generate sparks at a specific period. In this case, the specific period may be an interval of 1 second, or an interval of 1 second or more.

The present disclosure is not limited to the above-described embodiments, and as can be seen from the appended claims, modifications may be made by those of ordinary skill in the field to which the present disclosure belongs, and such modifications are within the scope of the present disclosure.

The invention claimed is:

1. An ice maker comprising:

a first tray configured to form a first portion of each of a plurality of cells;

a first tray cover in contact with the first tray;

a first tray supporter in contact with the first tray, a portion of the first tray being disposed between the first tray cover and the first tray supporter;

a second tray configured to be rotatable with respect to the first tray and to form a second portion of each of the plurality of cells, each of the first and second portions forming a space in which liquid is phase-changed to ice, the second tray configured to move to a first position and a second position, the first position being a position where the second portion is spaced apart from the first portion, and the second position being a position where the second portion contacts the first portion;

a communication passage provided in the second tray and between adjacent cells of the plurality of cells, wherein, when the second tray is moved to the second position, the plurality of cells are isolated from each other except through the communication passage.

2. The ice maker of claim 1, wherein:

the first tray includes a first contact surface, the second tray includes a second contact surface, and the communication passage is formed in the second contact surface.

3. The ice maker of claim 2, wherein the communication passage is formed in the second contact surface to be recessed in a direction away from the first tray.

4. The ice maker of claim 3, wherein the second tray is provided below the first tray in the second position, and the communication passage is recessed in a downward direction.

5. The ice maker of claim 2, wherein, at the first position, the second contact surface is at least partially spaced apart from the first contact surface.

6. The ice maker of claim 5, wherein, at the first position, the second contact surface is completely spaced apart from the first contact surface.

7. The ice maker of claim 1, wherein the communication passage has a semicircular or polygonal cross sectional shape.

8. The ice maker of claim 1, wherein the communication passage is provided at a position aligning with centers of each of the plurality of cells.

9. The ice maker of claim 1, wherein the plurality of cells includes three cells, and the communication passage includes two communication passages aligned on a horizontal center line of the three cells.

10. The ice maker of claim 1, wherein the second tray includes an extension extending from the second portion toward the first tray such that, at the first position, the extension contacts the first tray to prevent an overflow of liquid supplied to the space of the cell.

11. The ice maker of claim 10, wherein:

the first tray includes a first contact surface, the second tray includes a second contact surface configured to contact the first contact surface at the second position, wherein the extension extends beyond the second contact surface, and the communication passage is formed in the second contact surface.

12. The ice maker of claim 1, wherein a portion of the first tray passes through the first tray supporter.

13. The ice maker of claim 1, wherein s portion of the first tray supporter is closer to the second tray than thes portion of the first tray cover.

14. The ice maker of claim 1, wherein the first tray includes an extension wall extended from the first portion, and a portion of the first tray cover and a portion of the first tray supporter are in contact with the extension wall.

15. A refrigerator comprising:

a storage chamber;

a cooler configured to supply cold air; and an ice maker comprising:

a first tray configured to form a first portion of each of a plurality of cells;

a second tray configured to be rotatable with respect to the first tray and to form a second portion of each of the plurality of cells, the first and second portions being configured to form a space in which liquid is phase-changed into ice, the second tray configured to move to a first position and a second position, the first position being a position where the second portion is spaced apart from the first portion, and the second position being a position where the second portion contacts the first portion;

a second tray cover in contact with the second tray;

a second tray supporter in contact with the second tray, the second tray being coupled to the second tray cover and the second tray supporter, and a portion of the second tray being disposed between the second tray cover and the second tray supporter;

a liquid supply configured to supply liquid to the space; and at least one communication passage provided in the second tray and provided between adjacent cells of the plurality of cells, wherein, when the second tray is moved to the second position, the plurality of cells are isolated except through the at least one communication passage, and the second tray cover is spaced apart from the at least one communication passage, and a portion of the second tray passes through the second tray cover.

16. The refrigerator of claim 15, wherein the first tray includes a first contact surface, the second tray includes a second contact surface, wherein, at the second position, the first contact surface contacts the second contact surface except at a position where the at least one communication passage is provided.

17. The refrigerator of claim 15, wherein a portion of the second tray cover is closer to the first tray than a portion of the second tray supporter.

18. The refrigerator of claim 15, wherein the second tray includes an extension wall extended outward from the second portion, and the second tray cover and the second tray supporter are in contact with the extension wall.

19. The refrigerator of claim 18, wherein the first tray includes a first contact surface, the second tray includes a second contact surface, wherein, at the second position, the first contact surface contacts the second contact surface except at a position where the at least one communication passage is provided, and a portion of the second tray cover that is in contact with the extension wall is spaced apart from the first contact surface.

20. A refrigerator comprising:

a storage chamber;

a cooler configured to supply cold air; and an ice maker comprising:

a first tray configured to form a first portion of each of a plurality of cells;

a first tray cover in contact with the first tray;

a first tray supporter in contact with the first tray, a portion of the first tray being disposed between the first tray cover and the first tray supporter;

a second tray configured to be rotatable with respect to the first tray and to form a second portion of each of the plurality of cells, the first and second portions being configured to form a space in which liquid is phase-changed into ice, a second tray cover in contact with the second tray;

a second tray supporter in contact with the second tray, the second tray being coupled to the second tray cover and the second tray supporter, and a portion of the second tray being disposed between the second tray cover and the second tray supporter; and at least one communication passage provided between adjacent cells of the plurality of cells.

21. The refrigerator of claim 20, wherein a portion of the first tray supporter is closer to the second tray than the portion of the first tray cover, a portion of the second tray cover is closer to the first tray than a portion of the second tray supporter, wherein a portion of the first tray passes through the first tray supporter, or a portion of the second tray passes through the second tray cover.

* * * * *